US005135839A

United States Patent [19]

Szajewski

[11] Patent Number: 5,135,839

[45] Date of Patent: Aug. 4, 1992

[54] SILVER HALIDE MATERIAL WITH DIR AND BLEACH ACCELERATOR RELEASING COUPLERS

[75] Inventor: Richard P. Szajewski, Rochester, N.Y.

[73] Assignee: Eastman Kodak Company, Rochester, N.Y.

[21] Appl. No.: 612,341

[22] Filed: Nov. 13, 1990

[51] Int. Cl.[5] ..... G03C 7/30; G03C 7/32

[52] U.S. Cl. ..... 430/382; 430/544; 430/549; 430/955; 430/957

[58] Field of Search ..... 436/382, 544, 549, 955, 436/957

[56] References Cited

U.S. PATENT DOCUMENTS 4,248,962 2/1981 Lau ..... 430/382
4,409,323 10/1983 Sato et al. ..... 430/544
4,579,816 4/1986 Öhlschläger et al. ..... 430/544
4,791,049 12/1988 Kojima et al. ..... 430/544
4,912,024 3/1990 Michno et al. ..... 430/553
4,959,299 9/1990 Sakanoue et al. ..... 430/544

FOREIGN PATENT DOCUMENTS 0169458 7/1985 European Pat. Off. .
0193389 2/1986 European Pat. Off. .
0272573 12/1987 European Pat. Off. .

*Primary Examiner*—Richard L. Schilling
*Attorney, Agent, or Firm*—Gordon M. Stewart

[57] ABSTRACT

A photographic silver halide element comprises a combination of a first coupler that is capable of releasing a development inhibitor moiety during photographic processing that enhances development inhibition and a second coupler that enables release of a bleach accelerator group upon processing. The photographic silver halide element is useful in photographic imaging.

10 Claims, No Drawings

SILVER HALIDE MATERIAL WITH DIR AND BLEACH ACCELERATOR RELEASING COUPLERS

FIELD OF THE INVENTION

This invention relates to photographic materials and elements, specifically to materials and elements having a coupler that releases a development inhibitor compound and another coupler that releases another releasable compound.

BACKGROUND OF THE INVENTION

Development inhibitor releasing compounds or couplers (DIR's) are compounds that release development inhibitor compounds upon reaction with oxidized developer. DIR's are used in photographic materials to improve image sharpness (actance), reduce gamma-normalized granularity (a measure of signal to noise ratio with a low gamma-normalized granularity indicating a beneficial high signal to noise ratio), control tone scale, and control color correction.

It is often desirable to maximize the amount of development inhibitor that is released in order to maximize the amount of sharpness and minimize the contrast-(gamma)-normalized granularity of the image produced in a photographic material. However, the amount of tone scale control and color correction control must usually be maintained within specific limits for visually pleasing image reproduction. This often limits the degree of sharpness and gamma-normalized granularity improvement that can be obtained through the use of DIR compounds.

This problem has been addressed in a number of ways. One way to increase image sharpness provided by a DIR compound is to increase the effective mobility of the released inhibitor compound by linking it to a coupler moiety through a timing group. Upon reaction with oxidized developer, the timing-inhibitor moiety is cleaved from the coupler moiety. The inhibitor moiety releases from the timing group and thus becomes active, but only after a delay during which the timing-inhibitor moiety could move in the material. The incorporation of such timing groups in DIR's and the advantages thereby achieved are described in, for example, U.S. Pat. Nos. 4,284,962 and 4,409,323. An example of such a timed DIR is:

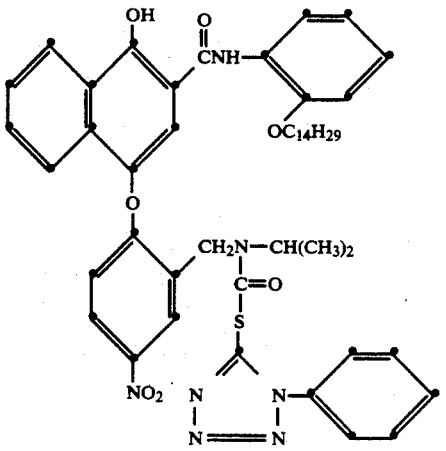

DIR-1

These compounds may provide undesirably high levels of color correction. A technique to control the amount of color correction, the so-called interimage effect, utilizes a DIR that releases an inhibitor moiety that comprises a ballasting group —Q enabling, upon exposure and processing of the material, reduced interlayer interimage effect without reduced image acutance. Such DIR's are described in the U.S. patent application Ser. No. 366,730 filed Jun. 15, 1989, now U.S. Pat. No. 5,006,448. These DIR's, however, do not provide both the high photographic speed and the reductions in gamma-normalized granularity to the extent that is often desirable.

It would therefore be highly desirable to provide a photographic material that offered the concomitant advantages of high image sharpness, low interlayer interimage effect, high photographic speed and low gamma-normalized granularity.

In an unrelated area, it has been taught to incorporate bleach accelerator-releasing compounds (BARC's) in photographic materials to aid in the bleaching step of photographic processing. European Patent Application Publication No. 193,389 discloses BARC's having a releasable thioether bonded to an alkylene group or heterocyclic nucleus with a solubilizing group attached thereto. One such BARC, having the formula:

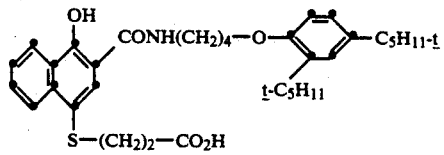

B-1 has been used as such in a color negative film, which also contained the above-identified DIR-1. This DIR does not have a —Q ballasting group. This combination, as shown below by comparative data, did not provide both high photographic speed and as great a reduction in gamma-normalized granularity as might be desired.

European Patent Applications 169,458 and 272,573 and German OLS 3,626,219, 3,636,824, 3,644,405 and 3,644,416 disclose photographic elements comprising couplers which release monocyclic triazole development inhibitor moieties, several of which are substituted with thioalkyl moieties. The photographic elements of these applications are described as exhibiting large interimage effects. No mention is made of BARC couplers in these applications.

U.S. Pat. No. 4,791,049 discloses photographic elements comprising inhibitor releasing developers which release thiadiazole development inhibitor moieties, several of which are substituted with thioalkyl moieties. The photographic elements of this application are described as exhibiting large interimage effects. No mention is made of BARC couplers in this application.

SUMMARY OF THE INVENTION

It has been found that the described advantages are provided by a photographic element comprising a support bearing at least one photographic silver halide emulsion layer and, in reactive association, a first coupler (A) that is represented by the formula (I):

$$COUP_1—(TIME)_n—INH—(Q)_m$$

wherein:

COUP is a coupler moiety from which (TIME)-n—INH—(Q)m is released during development;

TIME is a timing group;

INH—(Q)m together constitute a development inhibitor moiety; and

Q comprises from 1 to 4 thioether moieties, in each of which the sulfur atom is directly bonded to a saturated carbon atom but is not directly bonded to an INH heterocyclic ring;

n is 0, 1, or 2; and m is 1, 2 or 3; and.

a second coupler (B) represented by the formula (II):

$$COUP_2—(TIME)_n—S—R_1—R_2$$

wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

The combination of couplers (A) and (B) provides photographic elements with low interlayer interimage effect, high image sharpness, high photographic speed and low gamma-normalized granularity. When used with coupler (A), coupler (B) provides greater improvements in speed and gamma-normalized granularity than when used with other DIR's.

DESCRIPTION OF THE PREFERRED EMBODIMENTS

A typical development inhibitor releasing coupler (A) as described is represented by the formula:

$$COUP_1—(TIME)_n—INH—(Q)m$$

wherein:

$COUP_1$ is a coupler moiety, and TIME, n, m and INH—(Q)m are as defined above.

TIME is bonded to the coupling position of $COUP_1$. TIME, along with the attached INH—(Q)m moiety, is released from $COUP_1$ upon exposure and processing of the photographic recording material. The controlled release of INH—(Q)m is advantageous for particular photographic applications.

Coupler (A), and specifically, the —Q moiety, enables reduced interlayer interimage effect without reduced acutance to be observed in a photographic silver halide element because the inhibitor moiety with —Q has reduced transportability in the structure of the photographic element and is more absorbing to silver or silver halide than inhibitors without the —Q group. A highly preferred INH—Q moiety that has the described characteristics is a 1-(2-methylmercaptophenyl)-5-mercapto-tetrazole moiety. This moiety has highly preferred transportability characteristics and is preferred in combination with a timing group (T) that also enables preferred transportability. Such a preferred moiety enables a lower degree of interimage effect and accordingly a lower degree of color correction. But also, this moiety enables an image that has a degree of acutance that is unexpectedly high. As a result the coupler (A) enables acutance enhancement as effective as other DIR couplers, for example those DIR couplers containing phenylmercaptotetrazole as an inhibitor moiety, but without the high interimage effects observed with those DIR couplers.

The most effective image is observed when in coupler (A) the coupler moiety and the inhibitor moiety are separated by a group that enables timing of release of the inhibitor moiety from the carrier moiety during photographic processing. The reaction of coupler (A) with an oxidized color developing agent cleaves the bond between the carrier moiety and the timing group. Then, the bond between the timing group and the inhibitor moiety is cleaved by means of an intramolecular nucleophilic displacement reaction enabling the development inhibitor moiety to perform its intended function. Bond cleavage between the timing group and the inhibitor moiety does not involve the action of oxidized color developing agent.

A preferred coupler (A) is represented by formula (I) wherein $COUP_1$ is a coupler moiety. As used herein the terms "coupler" and "coupler compound" refer to the entire compound, including the coupler moiety, the timing group, and the inhibitor moiety, while the term "coupler moiety" refers to the portion of the compound other than the timing group and the inhibitor moiety.

The coupler moiety can be any moiety that will react with oxidized color developing agent to cleave the bond between the timing group and the coupler moiety. It includes coupler moieties employed in conventional color-forming couplers that yield colorless products, as well as coupler moieties that yield colored products on reaction with oxidized color developing agents. Both types of coupler moieties are known to those skilled in the photographic art.

The coupler moiety can be unballasted or ballasted with an oil-soluble or fat-tail group. It can be monomeric, or it can form part of a dimeric, oligomeric or polymeric coupler, in which case more than one INH group can be contained in the coupler, or it can form part of a bis compound in which the timing and inhibitor groups form part of the link between two coupler moieties.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless and diffusible or nondiffusible, in which case it will not contribute to image density. In cases (2) and (3) the reaction product may be initially colored and/or nondiffusible but converted to colorless and/or diffusible products during the course of processing.

The timing group, T, is joined to the coupler moiety at any of the positions from which groups released from couplers by reaction with oxidized color developing agent can be attached. Preferably, the timing group is attached at the coupling position of the coupler moiety so that upon reaction of the coupler with oxidized color developing agent the timing group will be displaced. However, the timing group can be attached to a non-coupling position of the coupler moiety from which it will be displaced as a result of reaction of the coupler with oxidized color developing agent. In the case where the timing group is at a non-coupling position of the coupler moiety, other groups can be in the coupling position, including conventional coupling-off groups or the same or different inhibitor moieties from that contained in the described inhibitor moiety of the invention. Alternatively, the coupler moiety can have a timing and inhibitor group at each of the coupling position and a non-coupling position. Accordingly, couplers of this invention can release more than one mole of inhibitor per mole of coupler. Each of these inhibitors can be the same or different and can be released at the same or different times and rates.

The timing group can be any organic group that will serve to connect $COUP_1$ to the inhibitor moiety and which, after cleavage from $COUP_1$, will cleave from the inhibitor moiety preferably by an intramolecular nucleophilic displacement reaction of the type described in, for example, U.S. Pat. No. 4,248,962 or by electron transfer down a conjugated chain as described in, for example, U.S. Pat. No. 4,409,323, the disclosures of which are incorporated herein by reference. Timing groups utilizing the mechanism in which there is electron transfer down a conjugated chain are especially preferred.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have a nucleophilic group and electrophilic group spatially related by the configuration of the molecule to promote reactive proximity. Preferably the nucleophilic group and the electrophilic group are located in the compound so that a cyclic organic ring, or a transient cyclic organic ring, can be easily formed by an intramolecular reaction involving the nucleophilic center and the electrophilic center.

A useful illustrative class of timing group (T) is represented by the structure:

$$\text{(Nu—X—E)}$$

wherein:

Nu is a nucleophilic group attached to a position on $COUP_1$ from which it will be displaced upon reaction of $COUP_1$ with oxidized color developing agent, E is an electrophilic group attached to an inhibitor moiety as described and is displaceable therefrom by Nu after Nu is displaced from $COUP_1$, and X is a linking group for spatially relating Nu and E, upon displacement of Nu from $COUP_1$, to undergo an intramolecular nucleophilic displacement reaction with the formation of a 3- to 7-membered ring and thereby release $INH—R^1$.

A nucleophilic group (Nu) is understood to be a grouping of atoms one of which is electron rich. This atom is referred to as the nucleophilic center. An electrophilic group (E) is understood to be a grouping of atoms one of which is electron deficient. This atom is referred to as the electrophilic center.

In photographic couplers as described, the timing group can contain a nucleophilic group and an electrophilic group that are spatially related with respect to one another by a linking group (X) so that upon release from the coupler moiety, the nucleophilic center and the electrophilic center will react to effect displacement of the inhibitor moiety from the timing group. The nucleophilic center should be prevented from reacting with the electrophilic center until release from the coupler moiety and the electrophilic center should be resistant to external attack such as hydrolysis. Premature reaction can be prevented by attaching the coupler moiety to the timing group at the nucleophilic center or an atom in conjunction with a nucleophilic center, so that cleavage of the timing group and the inhibitor moiety from the coupler moiety unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUG), or precursors thereof, which may remain attached to the timing group or be released.

It should be understood that for an intramolecular reaction to occur between the nucleophilic group and the electrophilic group, the groups should be spatially related after cleavage from the coupler, so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It should be further understood that for an intramolecular reaction to occur in the aqueous alkaline environment encountered during photographic processing, thereby displacing the timing group from the coupler moiety, the thermodynamics should be such and the groups be selected so that the free energy of ring closure plus the bond energy of the bond formed between the nucleophilic group and the electrophilic group is greater than the bond energy between the electrophilic group and other groups. Not all possible combinations of nucleophilic group, linking group, and electrophilic group will yield a thermodynamic relationship favorable to breaking of the bond between the electrophilic group and the inhibitor moiety; however, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

In the following listings of representative Nu and E groups, the groups are oriented so that the lefthand bond of Nu is joined to $COUP_1$ and the righthand bond of Nu is joined to X, while the lefthand bond of E is joined to X and the righthand bond of E is joined to INH.

Representative Nu groups include:

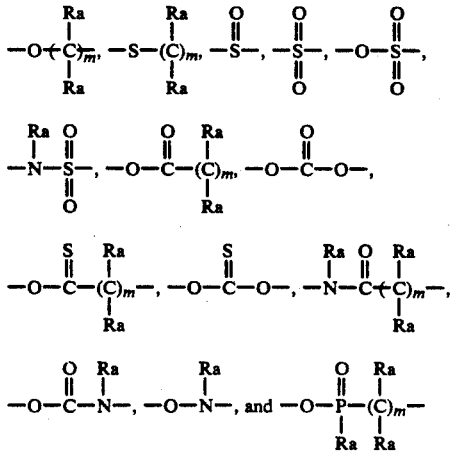

where each Ra is independently hydrogen, alkyl, such as alkyl of 1 to 20 carbon atoms including substituted alkyl such as methyl, ethyl, propyl, hexyl, decyl, pentadecyl, octadecyl, carboxyethyl, hydroxypropyl, sulfonamidobutyl and the like, or aryl, such as aryl of 6 to 20 carbon atoms including substituted aryl such as phenyl, naphthyl, benzyl, tolyl, t-butylphenyl, carboxyphenyl, chlorophenyl, hydroxyphenyl and the like, and m is an integer from 0 to 4 such that the ring formed by Nu, X and E upon nucleophilic attack of Nu upon the electrophilic center in E contains 3 to 7 ring atoms. Preferably Ra is hydrogen, alkyl of 1 to 4 carbon atoms or aryl of 6 to 10 carbon atoms.

Representative E groups include:

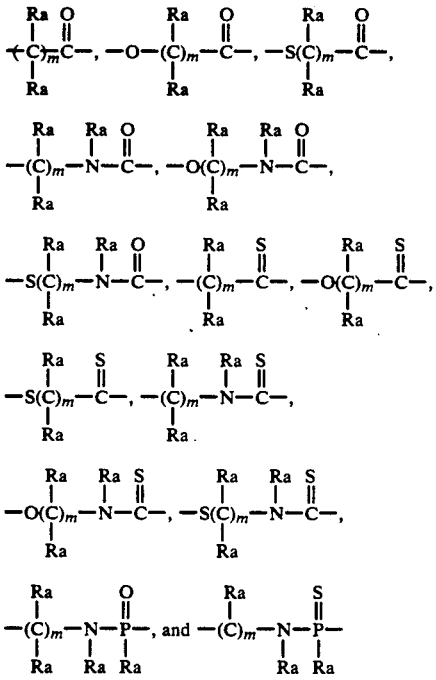

where Ra and m are as defined above.

E is preferably an electrophilic group selected from the group consisting of

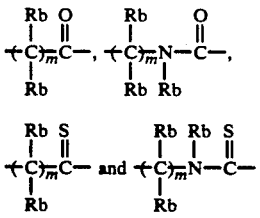

wherein each Rb is independently hydrogen, alkyl, such as alkyl containing 1 to 20 carbon atoms, preferably alkyl containing 1 to 4 carbon atoms, or aryl, such as aryl containing 6 to 20 carbon atoms, preferably aryl containing 6 to 10 carbon atoms; and m is 0 to 4, such that the ring formed upon reaction of the nucleophilic center in Nu with the electrophilic center in E contains 5- or 6-members.

The linking group represented by X can be an acyclic group such as alkylene, for example methylene, ethylene or propylene, or a cyclic group such as an aromatic group, such as phenylene or naphthylene, or a heterocyclic group, such as furan, thiophene, pyridine, quinoline or benzoxazine. Preferably X is alkylene or arylene. The groups Nu and E are attached to X to provide, upon release of Nu from COUP, favorable spatial relationship for nucleophilic attack of the nucleophilic center in Nu on the electrophilic center in E. When X is a cyclic group, Nu and E can be attached to the same or adjacent rings. Aromatic groups in which Nu and E are attached to adjacent ring positions are particularly preferred X groups.

X can be unsubstituted or substituted. The substituents can be those that will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkylsulfonamido, and alkylsulfonyl, solubilizing groups, ballast groups and the like, or they can be substituents that are separately useful in the photographic element such as a stabilizer, an antifoggant, a dye (such as a filter dye, a solubilized masking dye) and the like. For example, solubilizing groups will increase the rate of diffusion; ballast groups will decrease the rate of diffusion; electron withdrawing groups will decrease the rate of displacement of the INH group.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

When the timing group T is of the type described in above-referenced U.S. Pat. No. 4,409,323, the timing group will be described herein as a "quinone-methide timing group". Examples of useful couplers as described comprising a quinone-methide timing group include:

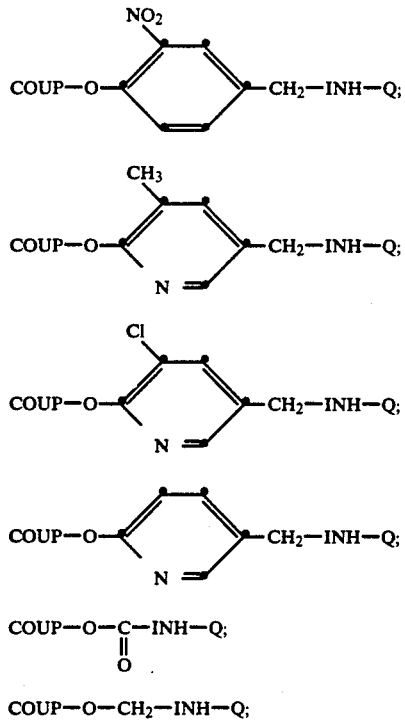

-continued

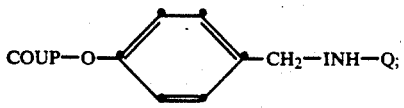

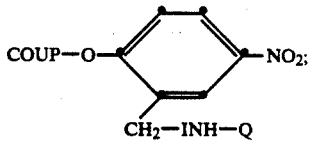

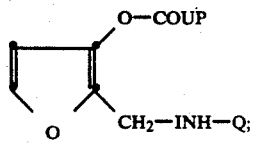

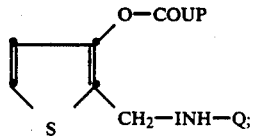

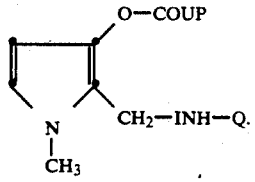

Especially preferred are those timing groups having the structure:

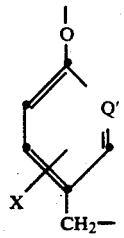

wherein

X is hydrogen and one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido and sulfonamido.

Q' is —N= or

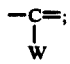

and

W is a group characterized by a $\sigma_m$ value greater than 0.0 ($\sigma_m$ is determined as described in Hansch and Leo, Journal of Medicinal Chemistry, 16, 1207, 1973). Typical W groups are $—NO_2$, $—NHSO_2CH_3$, $—NHSO_2C_{16}H_{33}$, $—NHCOCH_3$, $—NHCOC_{11}H_{23}$, —Cl, —Br, $—OCH_3$, $—OCH_2CH_2OCH_3$, etc.

Other useful timing groups are described in U.S. Pat. Nos. 4,737,451; 4,546,073; 4,564,587; 4,618,571; 4,698,297 and European Patent Published Patent Applications 167,168A; 255,085A and 362,870A.

There follows a listing of patents and publications that describe representative useful $COUP_1$ groups. In these structures, Y represents —T—INH—$CH_2$—Q as described. In the case of dye-forming couplers that are useful with a coupler (A), the Y group represents hydrogen or a coupling-off group known in the photographic art.

I. COUP's

A. Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine Literatureübersicht," published in Agfa Mitteilungen, Band III, pp. 156–175 (1961).

Preferably such couplers are phenols and naphthols that form cyan dyes on reaction with oxidized color developing agent and have the —Nu—X—E—INH coupling-off group attached at the coupling position, that is the carbon atom in the 4-position. Structures of such coupler moieties include:

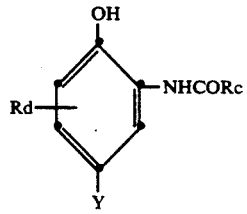

IA-1

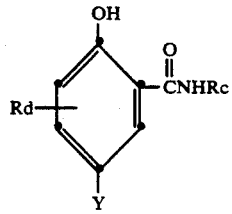

IA-2

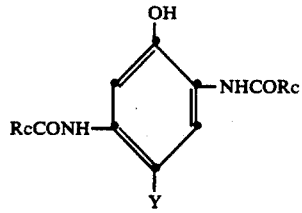

IA-3

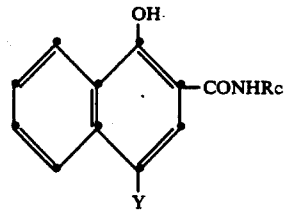

IA-4 where Rc represents a ballast group, and Rd represents one or more halogen such as chloro or fluoro, lower alkyl containing 1 to 4 carbon atoms, such as methyl, ethyl, or butyl; or alkoxy containing 1 to 4 carbon atoms, such as methoxy, ethoxy, or butoxy groups.

B. Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Farbkuppler-eine Literatureübersicht," published in Agfa Mitteilungen, Band III, pp. 126–156 (1961).

Preferably, such couplers are pyrazolones, pyrazolotriazoles, or pyrazolobenzimidazoles that form magenta dyes upon reaction with oxidized color developing agents and have the Y attached to the coupling position. Structures of preferred such coupler moieties are:

IB-1

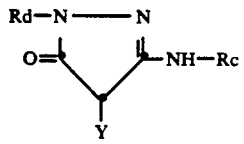

IB-2

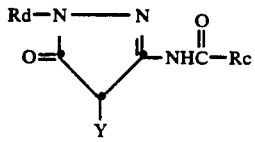

IB-3

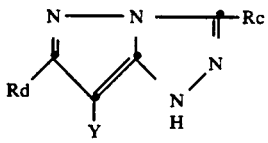

IB-4

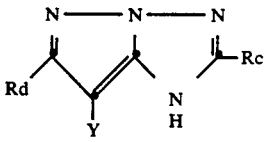

where Rc and Rd are chosen independently to be a ballast group, unsubstituted or substituted alkyl, unsubstituted or substituted phenyl.

C. Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine Literatureü bersicht," published in Agfa Mitteilungen, Band III, pp. 112–126 (1961).

Preferably such yellow-dye forming couplers are acylacetamides, such as benzoylacetanilides and have the Y group attached to the coupling position, that is the active methylene carbon atom.

Structures of preferred such coupler moieties are:

IC-1

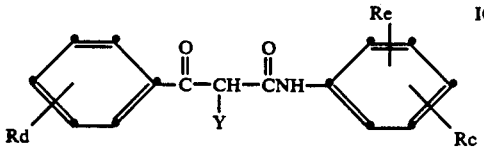

IC-2

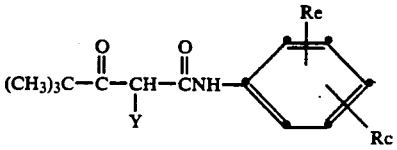

where Rc is as defined above and Rd and Re are hydrogen or one or more halogen, alkyl containing 1 to 4 carbon atoms, such as methyl and ethyl, or ballast groups, such as alkoxy of 16 to 20 carbon atoms.

D. Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Preferably such couplers are cyclic carbonyl containing compounds that form colorless products on reaction with oxidized color developing agent and have the Y group attached to the carbon atom in the α-position with respect to the carbonyl group.

Structures of preferred such coupler moieties are:

ID-1

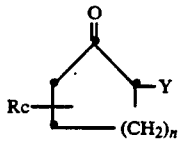

ID-2

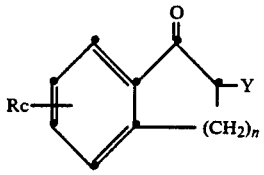

ID-3

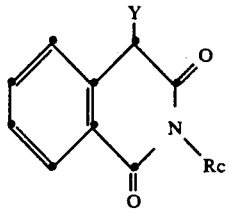

ID-4

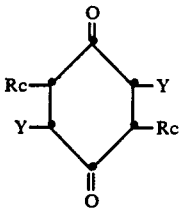

where Rc is as defined above and n is 1 or 2.

E. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764.

Preferably such couplers are resorcinols or m-aminophenols that form black or neutral products on reaction with oxidized color developing agent and have the Y group para to a hydroxy group.

Structures of preferred such coupler moieties are:

IE-1

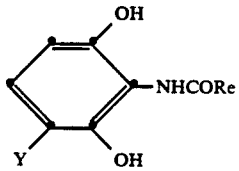

-continued

IE-2

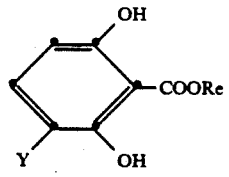

IE-3

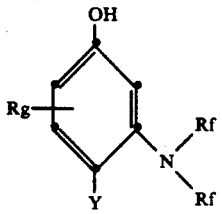

where Re is alkyl of 3 to 20 carbon atoms, phenyl or phenyl substituted with hydroxy, halo, amino, alkyl of 1 to 20 carbon atoms or alkoxy of 1 to 20 carbon atoms; each Rf is independently hydrogen, alkyl of 1 to 20 carbon atoms, alkenyl of 1 to 20 carbon atoms, or aryl of 6 to 20 carbon atoms; and Rg is one or more halogen, alkyl of 1 to 20 carbon atoms, alkoxy of 1 to 20 carbon atoms or other monovalent organic groups.

Examples of timing groups that enable an intramolecular nucleophilic displacement reaction are as follows:

A. Acyclic groups:

IIA-1

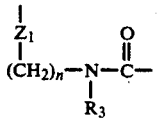

where n is 1–4, preferably 2 or 3, $Z_1$ is

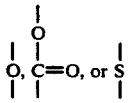

and $R_3$ is hydrogen, alkyl, such as alkyl of 1 to 20 carbon atoms, preferably alkyl of 1 to 4 carbon atoms, or aryl, such as aryl of 6 to 20 carbon atoms, preferably aryl of 6 to 10 carbon atoms.

B. Aromatic groups:

IIB-1

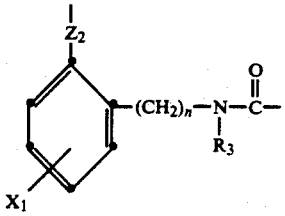

-continued

IIB-2

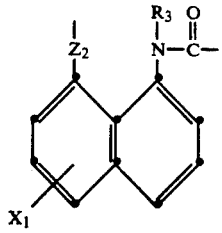

where n is 0 or 1; $Z_2$ is

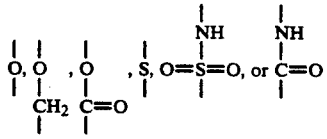

$R_3$ is hydrogen, alkyl, such as alkyl containing 1 to 30 carbon atoms, or aryl, such as phenyl and naphthyl; and $X_1$ is hydrogen or one or more substituent groups independently selected from cyano, fluoro, chloro, bromo, iodo, nitro, alkyl, such as alkyl of 1 to 20 carbon atoms, a dye, —$OR_4$, —$COOR_4$, —$CONHR_4$, —$NHCOR_4$, $NHSO_2R_4$, —$SO_2NHR_4$ of $SO_2R_4$, where $R_4$ is hydrogen, alkyl, such as alkyl of 1 to 20 carbon atoms, preferably alkyl of 1 to 4 carbon atoms, or aryl, such as aryl of 6 to 20 carbon atoms, preferably aryl of 6 to 10 carbon atoms.

C. Heterocyclic groups:

IIC-1

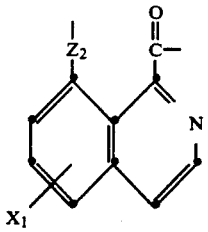

IIC-2

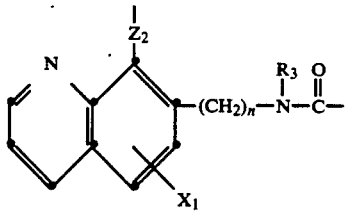

IIC-3

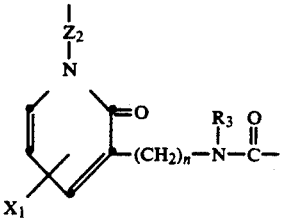

where n is 0 or 1, $Z_2$, $X_1$ and $R_3$ are as defined above.

D. Bis groups:

IID-1

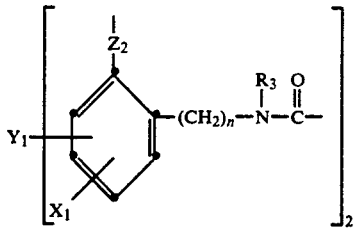

where $Y_1$ is a linking group, such as

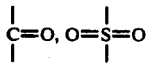

or —$NHSO_2CH_2SO_2NH$—; n is 0 or 1 and $X_1$, $Z_2$ and $R_3$ are as defined above.

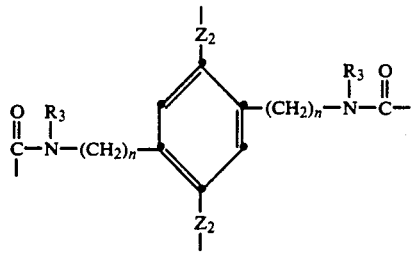

where n is 0 or 1 and $Z_2$, and $R_3$ are as defined above.

Such timing groups are described in, for example, U.S. Pat. No. 4,248,962.

Examples of useful development inhibitor groups represented by the INH part of INH—Q are the following groups: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. Preferred development inhibitor groups (INH) are heterocyclic groups derived from tetrazoles, mercaptotetrazoles and benzotriazoles.

Typical examples of useful inhibitor groups (INH) are as follows. G=S, Se or Te.

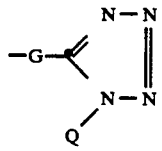

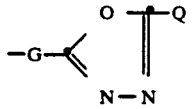

-continued

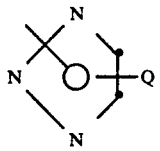

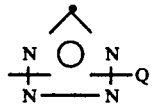

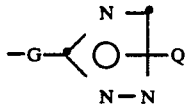

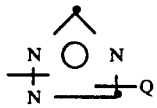

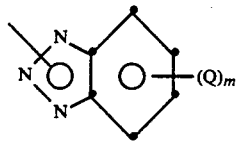

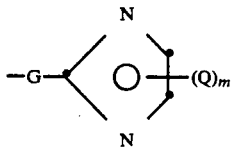

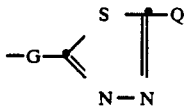

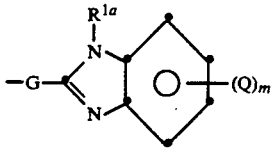

wherein $R^{1a}$ is hydrogen or an unsubstituted or substituted hydrocarbon group, such as methyl, ethyl, propyl, n-butyl, phenyl, or like Q.

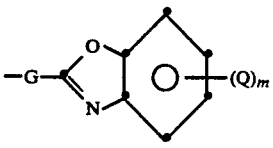

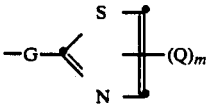

-continued

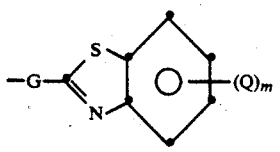

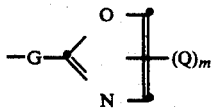

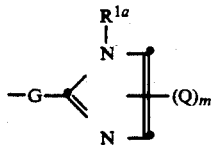

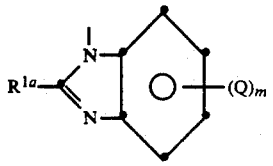

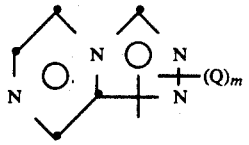

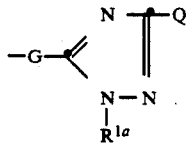

wherein $R^{1a}$ is hydrogen or an unsubstituted or substituted hydrocarbon group, such as methyl, ethyl, propyl, n-butyl, phenyl, or like Q.

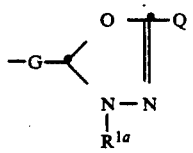

and

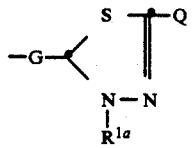

wherein $R^{1a}$ is hydrogen or an unsubstituted or substituted hydrocarbon group, such as methyl, ethyl, propyl, n-butyl, phenyl, or like Q.

The inhibitor moiety can also be substituted with other groups that do not adversely affect the desired properties of INH.

The Q moiety may be unchanged as the result of exposure to photographic processing solution. However, Q may change in structure and effect in the manner disclosed in U.K. Patent No. 2,099,167, European Patent Application 167,168, Japanese Kokai 205150/83 or U.S. Pat. No. 4,782,012 as the result of photographic processing.

Q, represents a monovalent or divalent group, which can be alkyl, alkylene, aryl, arylene, alkoxy, aryloxy, alkylthio, arylthio, alkylamino, arylamino, carbalkoxy or heterocyclic. Q comprises from 1 to 4 thioether moieties in each of which the divalent sulfur atom is directly bonded to a saturated carbon atom but is not directly bonded to an INH heterocyclic ring. These groups can be substituted with one or more halogen, nitro, amino, cyano, amido, carbamoyl, sulfonyl, sulfonamido or sulfamoyl substituents. In addition to thioether groups, Q may contain non-thioether sulfur atoms directly bonded to isolated groups C=O, C=S, C=N, or to C=N— which is not incorporated in a heterocyclic ring.

In typical Q groups the thioether sulfur atom can be bonded to $-(CH_2)_l-$, where l is 1 to 12,

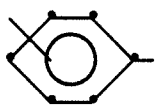

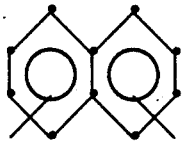

$-CH_3$; $-CH_2CH_3$; $-C_3H_7$; $-C_4H_9$; $-C_4H_9-t$; $-C_5H_{11}$;

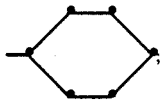

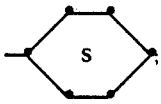

and

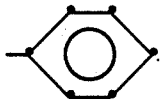

The chemistry characterization and preparation of thioether groups, otherwise known as sulfide groups, is related in Chapter 6 of "The Organic Chemistry of Sulfur", S. Oae Ed., Plenum Press, New York, 1977.

Typical examples of development inhibitor moieties represented by —INH—Q include the following:

| Compound |
|---|
| I-1 |

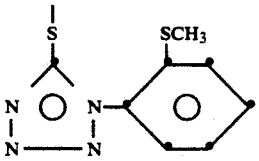

-continued
Compound
I-2
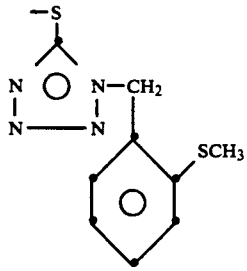
I-3
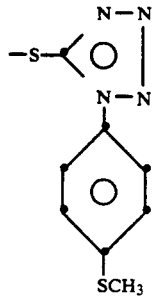
I-4
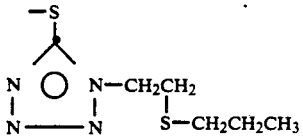
I-5
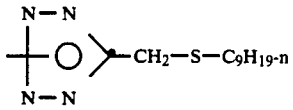
I-6
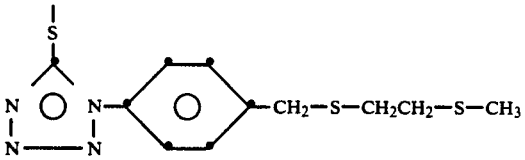
I-7
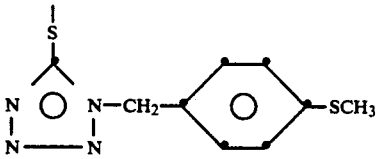
I-8
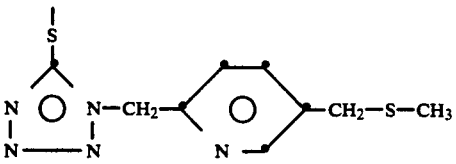
I-9
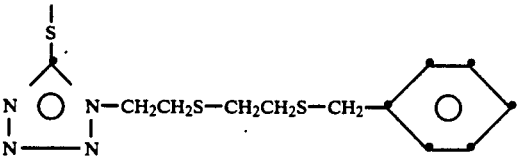
-continued
Compound
I-10
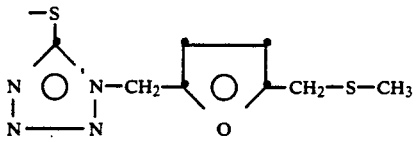
I-11
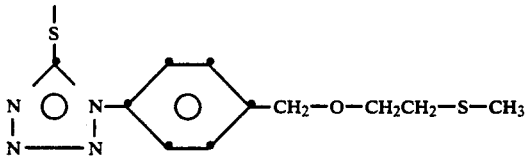
I-12
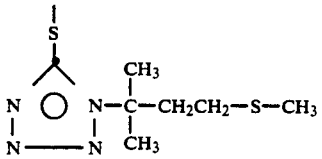
I-13
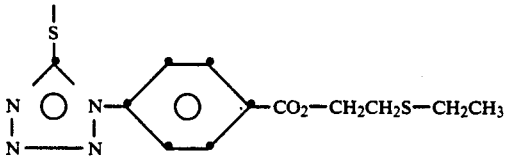
I-14
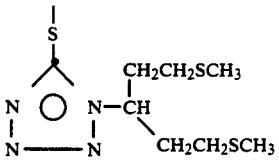
I-15
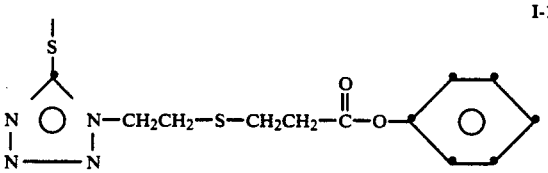
I-16
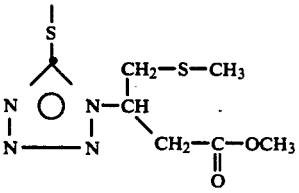
I-17
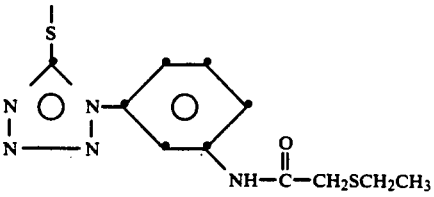

-continued
| Compound | |
|---|---|
| I-18 | 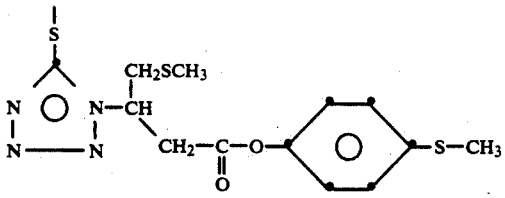 |
| I-19 | 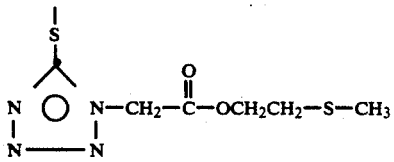 |
| I-20 | 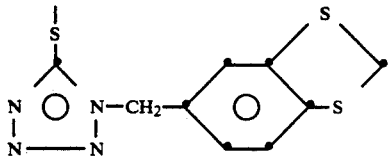 |
| I-21 | 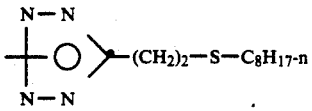 |
| I-22 | 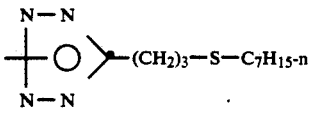 |
| I-23 | 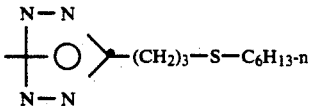 |
| I-24 | 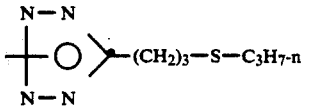 |
| I-25 | 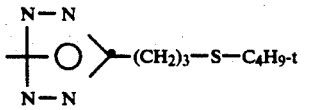 |
| I-26 | 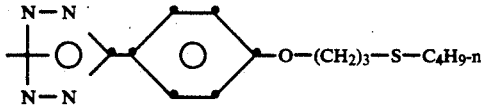 |
| I-27 | 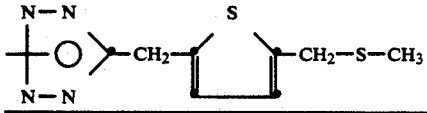 |
In the following examples of development inhibitor moieties of this invention Y and Z are:
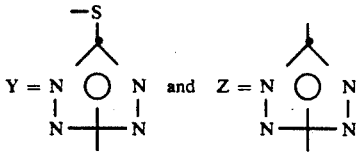
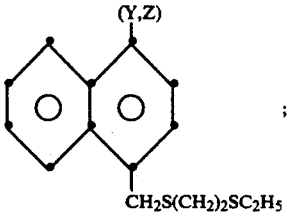
I-28, I-29
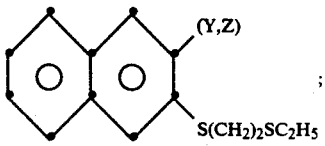
I-30, I-31
(Y,Z)—$CH_2CO_2(CH_2)_3$—$SCH_3$;
I-32, I-33
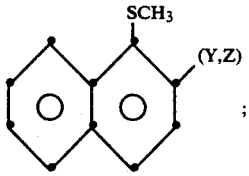
I-34, I-35
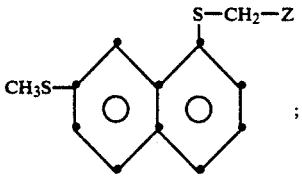
I-36
Z—N[$(CH_2)_2$S—$C_4H_9$-n)]$_2$;
I-37
Z—CH(S—$(CH_2)_2SCH_3$)—$CH_2$—S—$(CH_2)_2$—$SCH_3$;
I-38
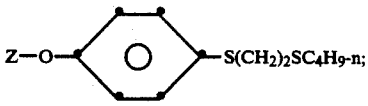
I-39
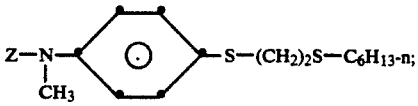
I-40
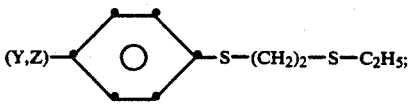
I-41, I-42
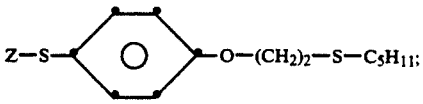
I-43

-continued
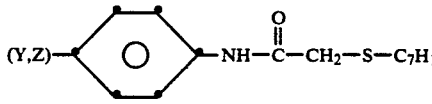
I-44, I-45
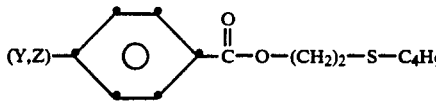
I-46, I-47
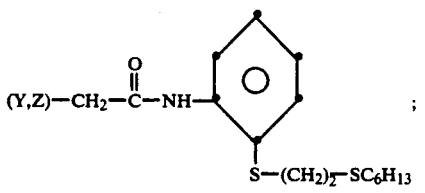
I-48, I-49
$(Y,Z)-(CH_2)_6S-C_4H_9$; I-50, I-51
$Z-CH_2-S(CH_2)_2S-(CH_2)_2S-C_4H_9$; I-52
$Z-CH[S-(CH_2)_2-S-C_2H_5]_2$; I-53
$Z-CH(S-C_3H_7\text{-}n)-CH_2-S-C_4H_9\text{-}n$; I-54
$(Y,Z)-C(CH_3)_2-CH_2-S-(CH_2)_2S-C_2H_5$; I-55, I-56
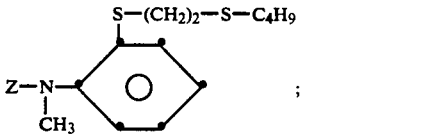
I-57
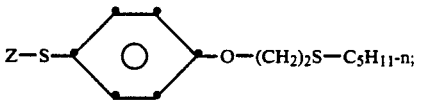
I-58
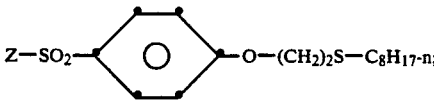
I-59
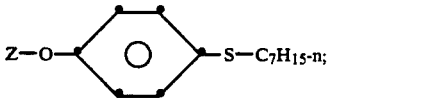
I-60
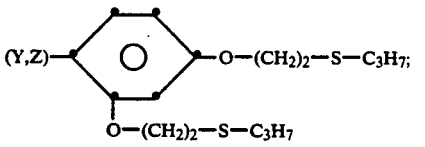
I-61, I-62
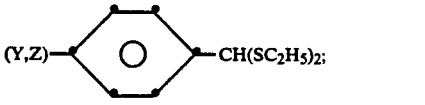
I-63, I-64
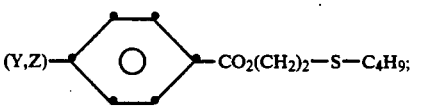
I-65, I-66
-continued
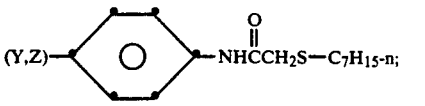
I-67, I-68
$Z-SO_2-(CH_2)_2S-C_{12}H_{25}\text{-}n$; I-69
$Z-SO_2N[(CH_2)_2S-C_4H_9]_2$; I-70
$(Y,Z)-C(CH_3)_2-C(=O)-N[(CH_2)_2SC_2H_5]_2$; I-71, I-72
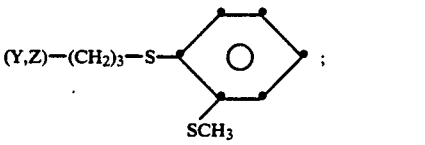
I-73, I-74
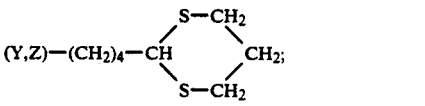
I-75, I-76
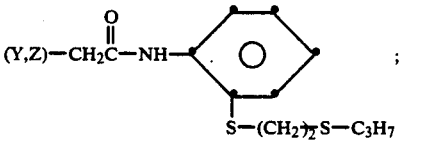
I-77, I-78
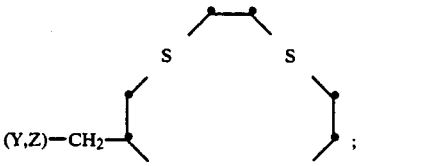
I-79, I-80
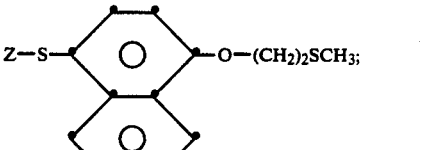
I-81
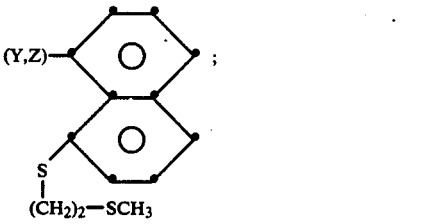
I-82, I-83
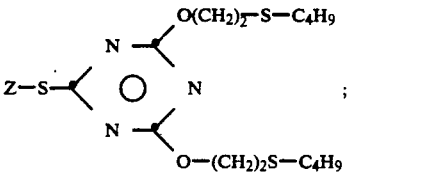
I-84

-continued
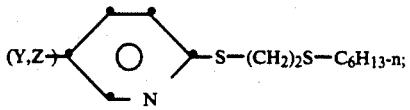
I-85, I-86
(Y,Z)—$CH_2CH_2SCH_3$; I-87, I-88
(Y,Z)—$C(CH_3)_2$—$CH_2SCH_3$; I-89, I-90
(Y,Z)—$CH_2CO_2$—$CH_2CH_2SCH_3$; I-91, I-92
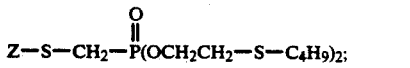
I-93
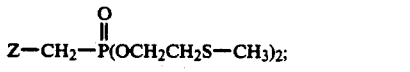
I-94
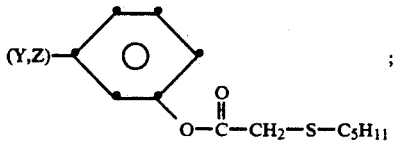
I-95 I-96
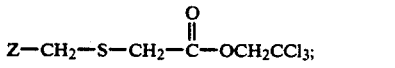
I-97
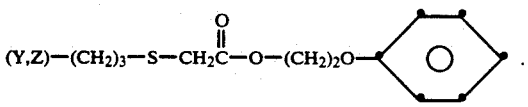
I-98, I-99
Additional examples of development inhibitor moieties of this invention include:
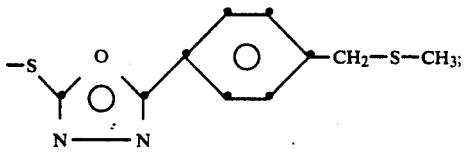
I-100
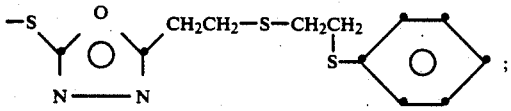
I-101
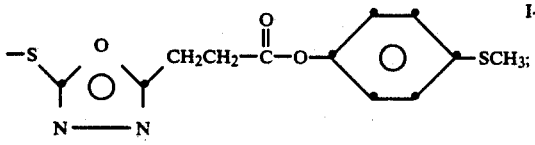
I-102
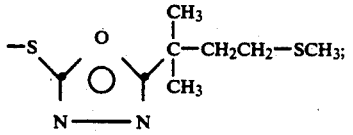
I-103
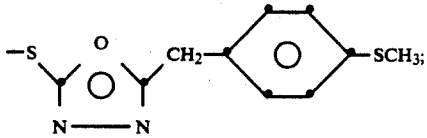
I-104
-continued
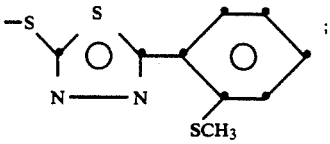
I-105
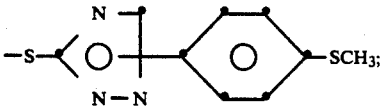
I-106
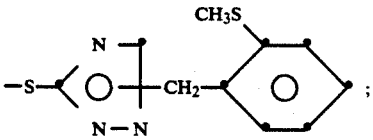
I-107
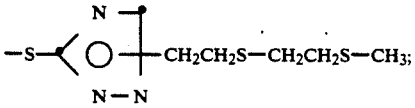
I-108
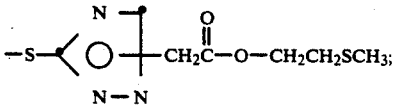
I-109
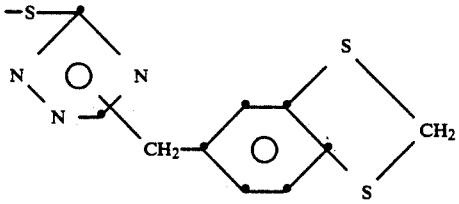
I-110
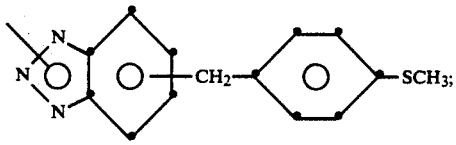
I-111
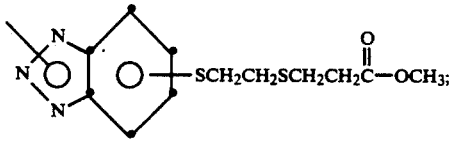
I-112
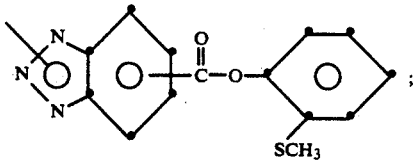
I-113
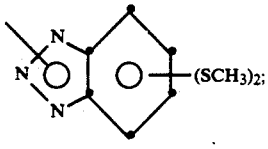
I-114

-continued
I-115
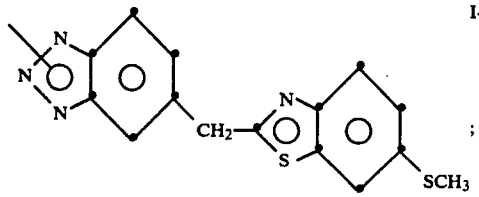
I-116
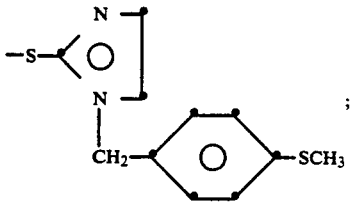
I-117
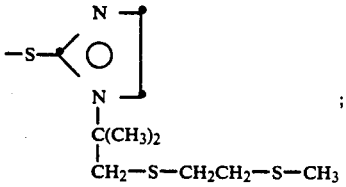
I-118
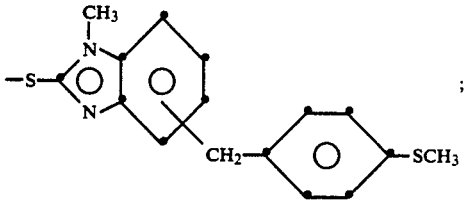
I-119
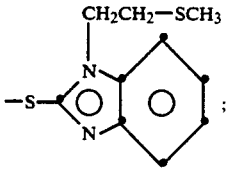
I-120
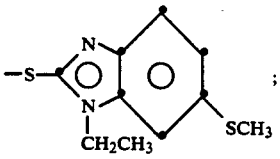
I-121
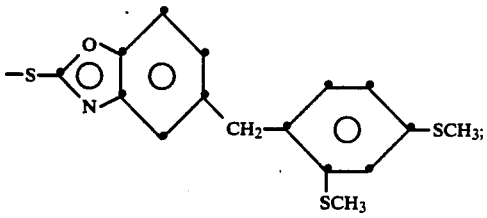
I-122
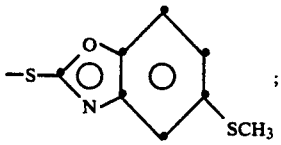
-continued
I-123
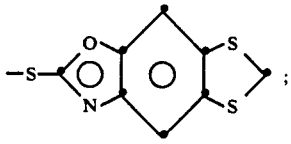
I-124
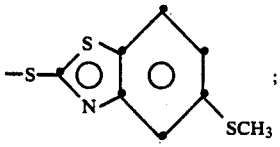
I-125
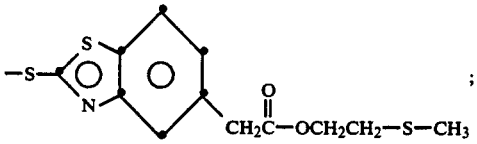
I-126
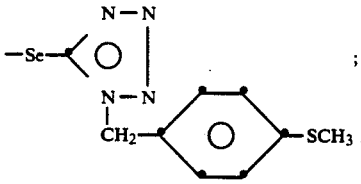
I-127
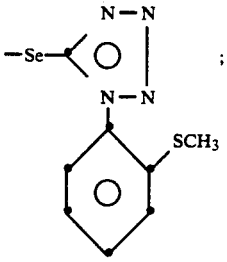
I-128
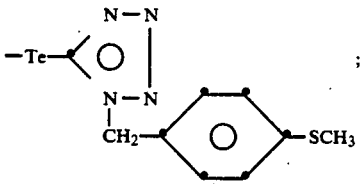
I-129
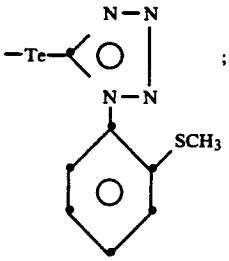
I-130
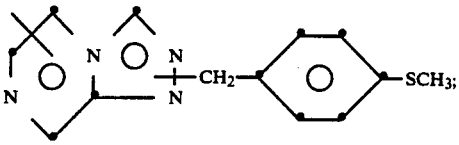

-continued

I-131

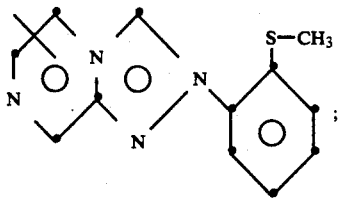

I-132

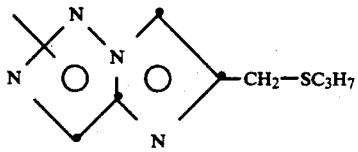

I-133

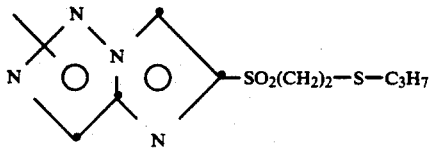

I-134 $Z—(CH_2)_3S(CH_2)_2SC_2H_5$;

I-135 $Z—(CH_2)_3S(CH_2)_2S—C_4H_{9}$-n;

I-136

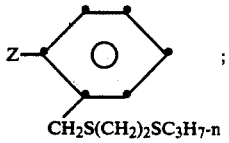

I-137

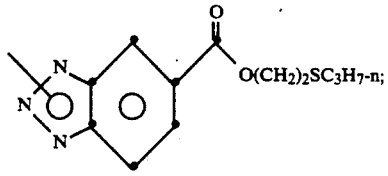

I-138

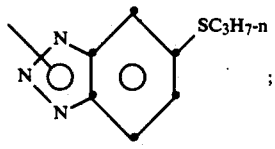

I-139

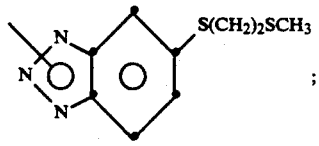

I-140

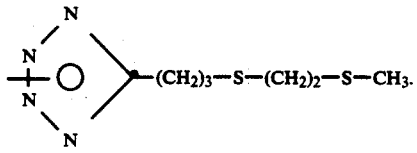

I-141

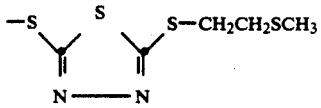

-continued

I-142

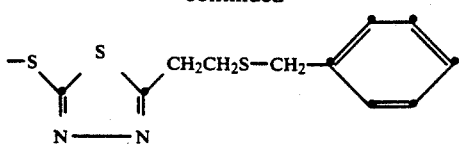

I-143

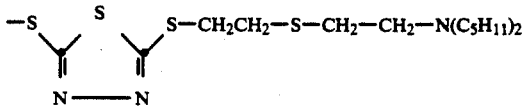

I-144

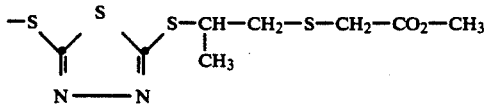

I-145

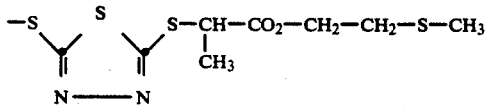

The development inhibitor moieties of the type described above can be prepared by methods already known in the art. One method, useful in the preparation of development inhibitor moiety I-1 is described in Synthesis Example 2 below.

For example, procedures useful in preparing 5-substituted tetrazoles from alkyl or aryl nitriles are described in E. Lieber and T. Enkoji, *J. Org. Chem.* Soc., 80, 3908–3911 (1958), and P. R. Berstein and E. P. Vacek, *Synthesis,* 1133–1134 (1987). Synthesis Examples 2 through 5 illustrate the preparation of four typical development inhibitor moieties.

The timing group T and INH are selected and prepared to adjust to the activity of the adjoining coupler moiety, and the other groups of the coupler in order to optimize release of the INH for its intended purpose. Accordingly, useful INH groups have differing structural types that enable timing groups having a range of activities. Various properties, such as pKa, are also usefully considered in optimizing the selection of optimum groups for a particular purpose. An example of such a selection could involve, for instance, a benzotriazole moiety as an inhibitor. Such a benzotriazole moiety can be released too quickly for some intended purposes from a timing group that involves an intramolecular nucleophilic displacement mechanism; however, the benzotriazole moiety can be modified as appropriate by substituent groups that change the rate of release.

As to the coupler (B), the particular $R_1$ group linking the sulfur atom and the water solubilizing group $R_2$ can be varied to control such parameters as water solubility, diffusivity, silver affinity, silver ion complex solubility, silver development effects and other sensitometric effects. For example, $R_1$ can have more than one water solubilizing group, such as two carboxy groups. Since these parameters can be controlled by modification of $R_1$, they need not be emphasized in selecting a particular coupler moiety and the particular water solubilizing group, but provide freedom in selecting such moieties and groups for a particular photographic element and process.

In processing, the $—S—R_1—R_2$ fragment is released at an appropriate time as a unit. That is, $—S—R_1—R_2$ is released as a unit. The rate and total time of diffusion of the —S—$R_1$—$R_2$ fragment in the photographic element must be such as to enable, when used in combination with coupler (A), improvements in acutance and/or gamma-normalized granularity in the appropriate layers of the photographic element during processing. The timing group, when present, also releases —S—$R_1$—$R_2$ as a unit. Selection of $R_1$ and $R_2$ can also influence the rate and total time of release of the —S—$R_1$—$R_2$ moiety from the remainder of the compound, preferably the remainder of the coupler. It is preferable that the —S—$R_1$—$R_2$ moiety not adversely affect the processing steps and the photographic element.

Preferred photographic couplers B of the invention are represented by the formula:

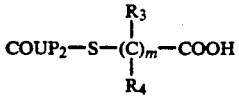

wherein $COUP_2$ is as defined above;

m is 1 to 8;

$R_3$ and $R_4$ are individually hydrogen or alkyl containing 1 to 4 carbon atoms; and wherein the total number of carbon atoms in

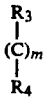

is 1 to 8. Alkyl includes straight or branched chain alkyl, such as methyl, ethyl, n-propyl, i-propyl, n-butyl, and t-butyl.

The $COUP_2$ coupler moiety of formula (II) can be any moiety as described above with respect to $COUP_1$, except of course, that for $COUP_2$, Y would represent —S—$R_1$—$R_2$. The —S—$R_1$—$R_2$ moiety is attached at the coupling position of the coupler moiety that enables the —S—$R_1$—$R_2$ moiety to be displaced upon reaction of the coupler with oxidized color developing agent.

In —S—$R_1$—$R_2$ releasing couplers, the —S—$R_1$—$R_2$ moiety can be bonded to the remainder of the organic compound through a timing group (TIME). TIME in the described structures is a group that enables the timed release of —S—$R_1$—$R_2$ from COUP. The timing mechanism can be any timing mechanism that is useful for releasing photographically useful groups from coupler moieties. For example, the timing mechanism can be as described in, for example, U.S. Pat. No. 4,248,962 or 4,409,323, or German OLS 3,319,428.

Release of the —S—$R_1$—$R_2$ moiety can involve a single reaction or it can involve sequential reactions. For example, two or more sequential reactions may be required within a TIME group to effect release of the —S—$R_1$—$R_2$ moiety. As another example, the TIME group can have two —S—$R_1$—$R_2$ moieties bonded to different locations on the TIME group so that upon release of the TIME group from the coupler moiety, two reactions can occur sequentially enabling sequential release of the two —S—$R_1$—$R_2$ moieties. Another example is a reaction in which the TIME group may release a second coupler moiety that contains another timing group to which a photographically useful group is attached and from which it is released after the second coupler moiety reacts with oxidized color developing agent.

The TIME group can contain moieties and substituents that will permit control of one or more of the rates of reaction of COUP with oxidized color developing agent, the rate of diffusion of —TIME—S—$R_1$—$R_2$ once it is released from COUP and the rate of release of —S—$R_1$—$R_2$. The TIME group can contain added substituents, such as added photographically useful groups, that can remain attached to the timing group and be released independently. The TIME groups can contain a ballast group.

The water-solubilizing groups useful as $R_2$ are groups well-known in the art that tend to increase or enhance the water solubility of organic compounds. $R_2$ can optionally be a precursor to a water solubilizing group. For example, $R_2$ can be an ester group, which upon hydrolysis forms a water solubilizing carboxylic acid group.

The following $R_2$ groups are examples of useful water solubilizing groups and their precursors:

—COOH
—$COOCH_3$
—$COOC_2H_5$
—$NHSO_2CH_3$
—$SO_3H$
—OH

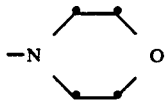

—$SO_2NHCH_3$

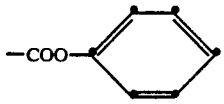

—$SO_2NH_2$
—$NR_5R_6$ wherein

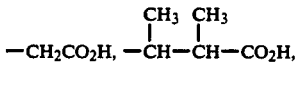

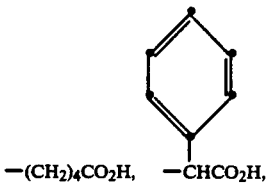

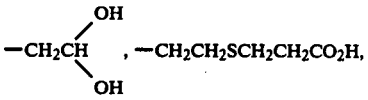

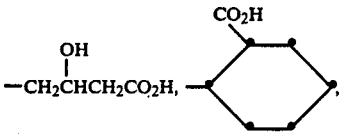

-continued

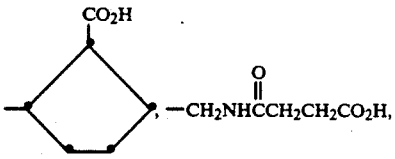

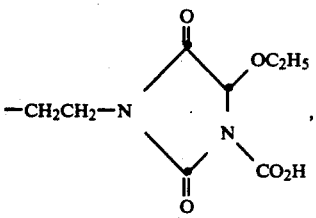

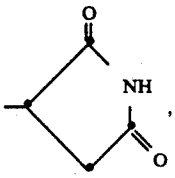

, and $CH_2CH_2SO_3H$

TIME groups that are useful enable release of the $—S—R_1—R_2$ moiety at the appropriate time during processing, that is at the time that enables, when used in combination with coupler (A), improvements in acutance and/or gamma-normalized granularity in the appropriate layers of the photographic element during processing. Examples of such TIME groups include: A. Acyclic TIME groups:

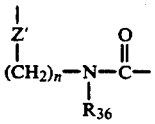

wherein n is 1 to 4;

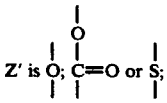

$R_5$ is H or alkyl of 1 to 4 carbons, $R_6$ is alkyl of 1 to 4 carbons and wherein at least one of $R_5$ and $R_6$ is alkyl, and the total carbon atoms in $R_5$ and $R_6$ is no more than 8.

The following are examples of useful $R_1$ groups:

$—CH_2—$ $—CH_2CH_2—$ $—CH_2CH_2CH_2—$

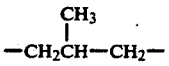

-continued $—CH_2CH_2CH_2CH_2—$

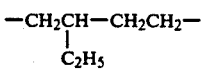

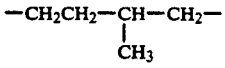

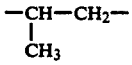

$—CH_2CH_2OCH_2CH_2—$

Examples of $—R_1—R_2$ moieties include $—CH_2—CH_2—CO_2H$, $—CH_2—CH_2—O—CH_2—CH_2—OH$,

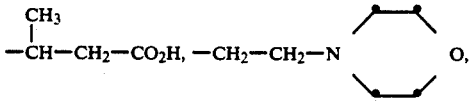

$—CH_2CH_2N(CH_3)_2$ $R_{36}$ is hydrogen, alkyl, such as alkyl containing 1 to 20 carbon atoms; or aryl, such as aryl containing 6 to 20 carbon atoms, preferably unsubstituted phenyl or substituted phenyl. B. Aromatic TIME groups:

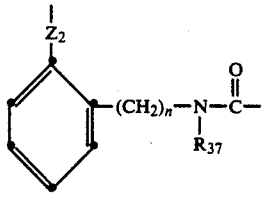

wherein n is 0 or 1;

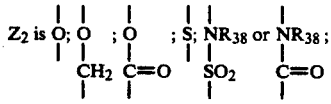

$R_{37}$ is hydrogen, alkyl, such as alkyl containing 1 to 20 carbon atoms; or aryl, such as aryl containing 6 to 20 carbon atoms, for example, phenyl;

$R_{38}$ is hydrogen, alkyl, such as alkyl containing 1 to 6 carbon atoms; or aryl, such as aryl containing 6 to 12 carbon atoms;

X is hydrogen; cyano; fluoro; chloro; bromo; iodo; nitro; alkyl, such as alkyl containing 1 to 20 carbon atoms; preferably methyl, ethyl, propyl or butyl; or aryl, such as aryl containing 6 to 20 carbon atoms, preferably unsubstituted phenyl or substituted phenyl.

Examples of specific couplers useful as coupler (B) include the following:

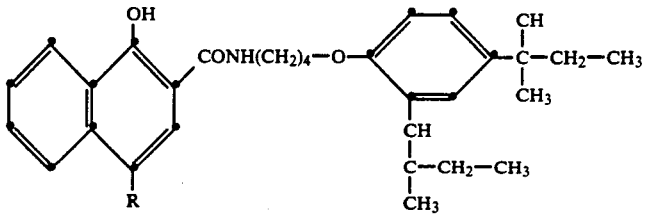
R = —S—$CH_2CH_2CO_2H$ B-1
B-2
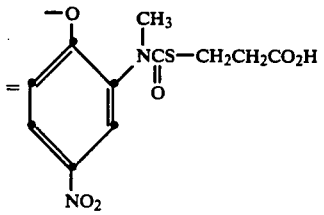
B-3
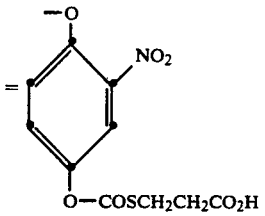
= —S—$CH(CH_3)CH_2CO_2H$ B-4
= —S—$CH_2CH_2OCH_2CH_2OH$ B-5
B-6
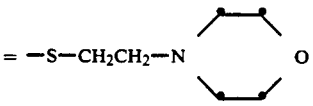
B-7
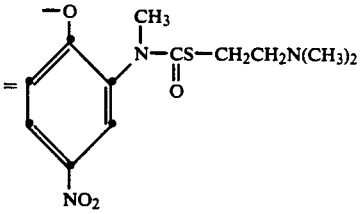
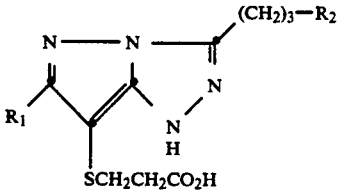
$R_1$ = —$CH_3$; B-8
$R_2$ = 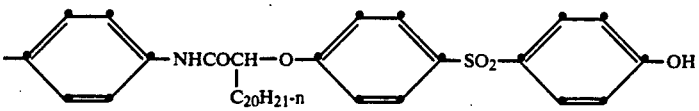

-continued
B-9
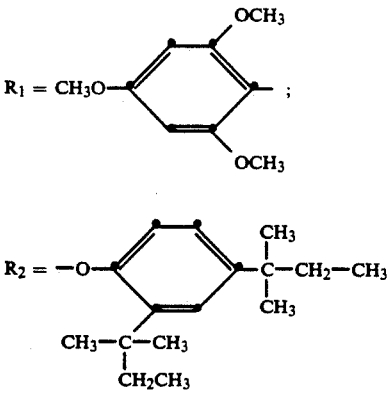
B-10
B-11
B-12
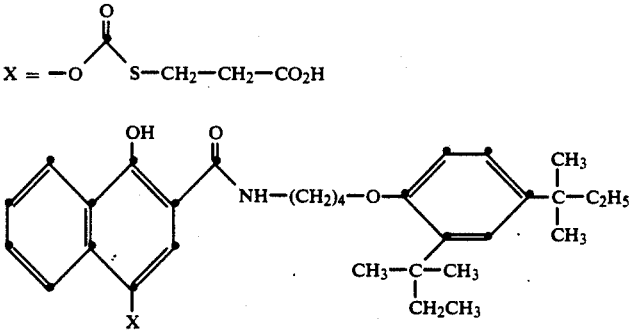
B-13
B-14
B-15
B-16
B-17

-continued
B-18
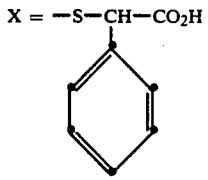
B-19
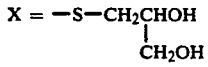
B-20
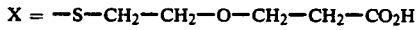
B-21
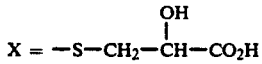
B-22
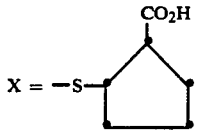
B-23
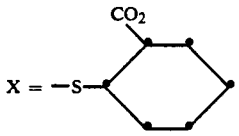
B-24
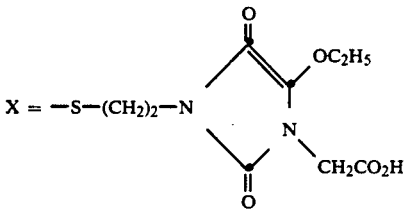
B-25
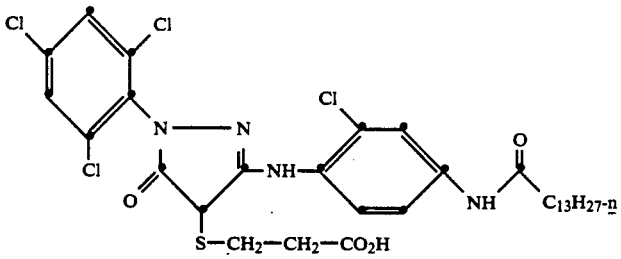
B-26
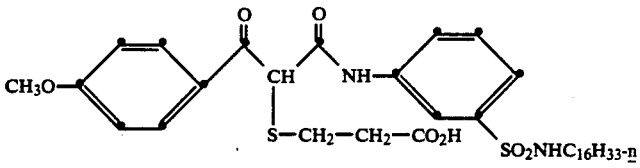
B-27
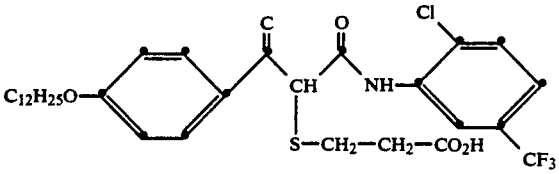

-continued
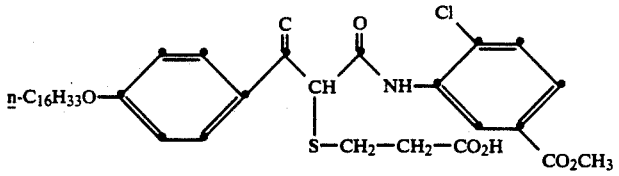
B-28
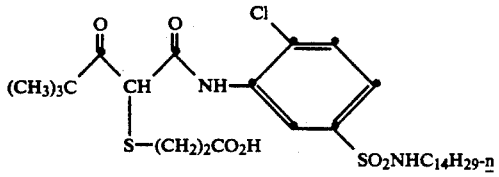
B-29
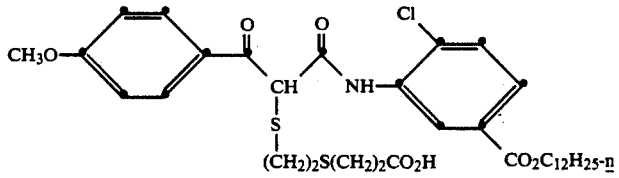
B-30
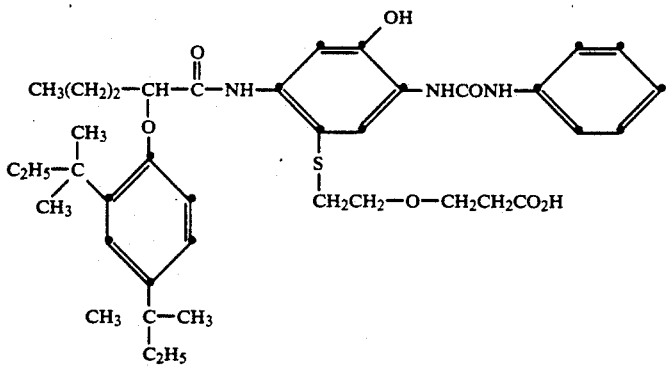
B-31
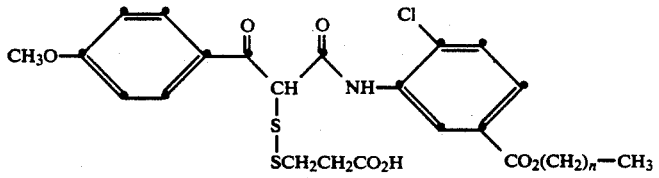
B-32
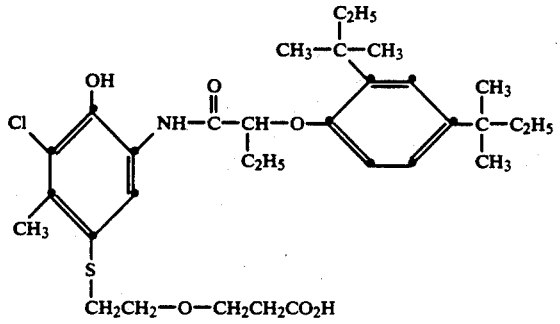
B-33

-continued

B-34

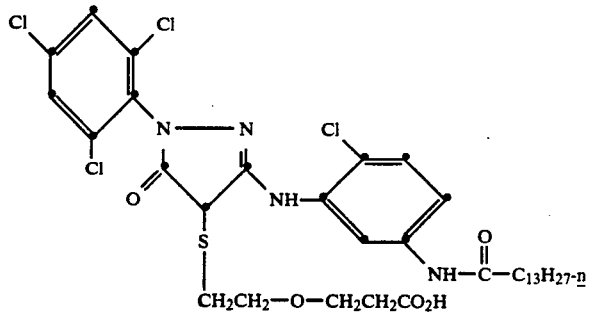

B-35

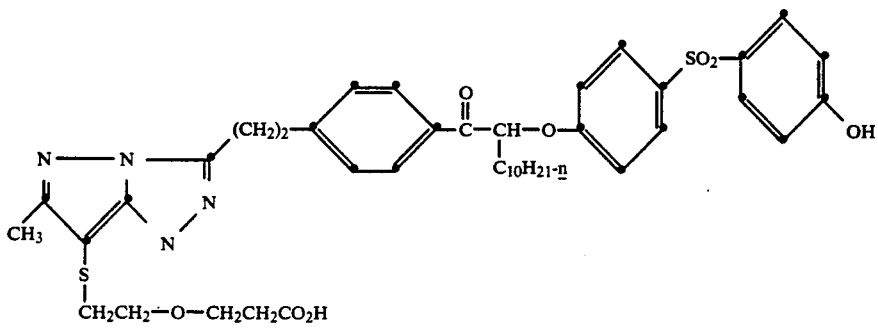

B-36

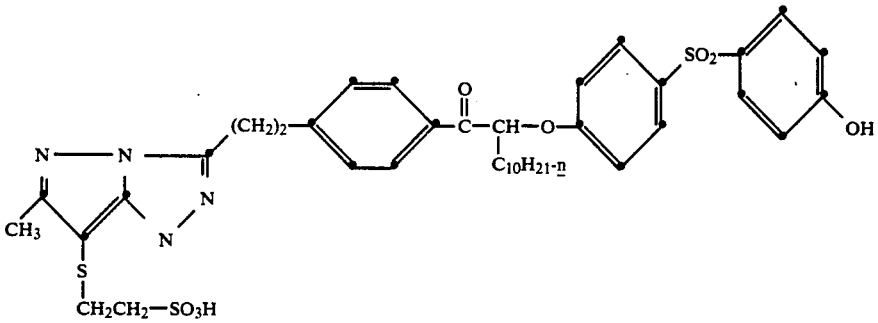

B-37

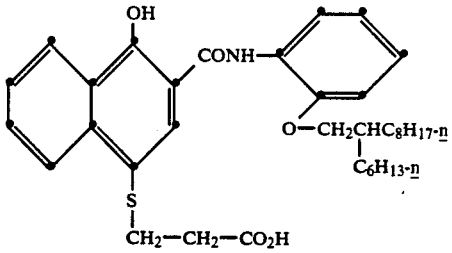

Couplers as described herein can be prepared by methods known in the organic compound synthesis art. A typical synthesis involves first attaching the timing group (if any) to the appropriate coupler moiety, or a derivative of the coupler moiety. The product is then reacted with an appropriate derivative of the inhibitor to form the desired coupler. Known reactions are employed to perform these steps. The following synthesis examples illustrate the way in which these steps can be performed using specific reactants and reactions.

SYNTHESIS EXAMPLE 1

This relates to the synthesis of the (B) coupler B-1:

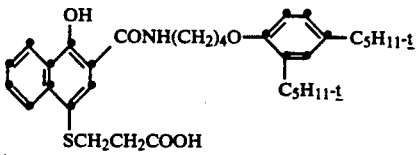

To a solution of 5 g (9.9 mmol) of the coupler moiety:

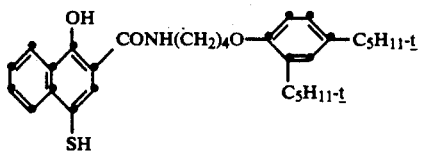

in 75 mL of tetrahydrofuran, stirred under nitrogen, is added 1.4 g (9.9 mmol) of tetramethylguanidine and then 1.1 mL (9.9 mmol) of ethyl acrylate. After 30 minutes 50 mL of methanol and 10 mL of 1.25N sodium hydroxide solution are added and the resulting composition stirred for 15 minutes. The mixture is then drowned in ice-cold dilute hydrochloric acid. The desired product is extracted and purified. For example, the desired product is extracted with diethyl ether to obtain, after crystallization, the desired coupler, which is a colorless solid having a melting point of 139° C. to 141° C. The product is also identified by elemental and spectral analysis.

Additional synthesis examples of (B) couplers can be found in European Patent Application 193,389 and in U.S. Pat. No. 4,842,994.

SYNTHESIS EXAMPLE 2

Preparation of Development Inhibitor Moiety I-1

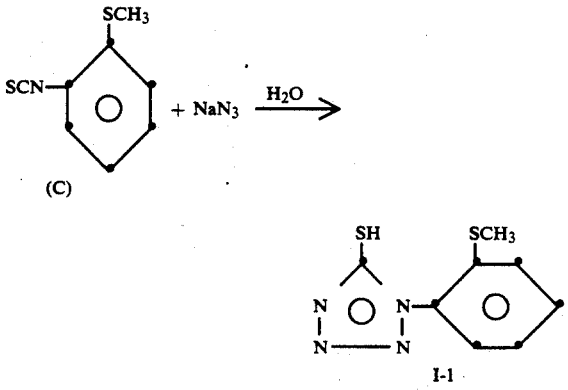

A mixture comprising 20.0 g (0.110 mmol) of C, 24.3 g (0.220 mol) of $NaN_3$ and 200 ml of water was heated under reflux for 6 hours, cooled, washed with diethyl ether and then acidified with conc (37%) HCl to pH 1. The mixture was extracted with diethyl ether and the ether extract was washed with water and saturated NaCl solution. The resulting liquid was dried over $MgSO_4$ and concentrated to yield 20.7 g (84%) of a white solid Compound I-1, mp 127.5°-128° C.

SYNTHESIS EXAMPLE 3

Preparation of Development Inhibitor Moiety I-134

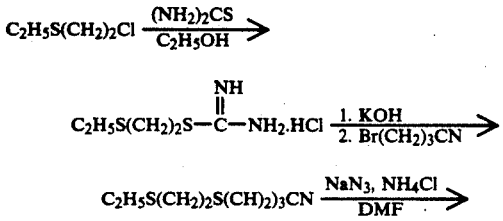

-continued

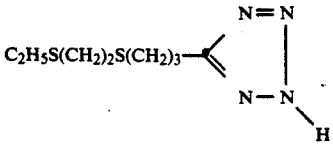

I-134

A solution of 12.2 g (0.161 mol) thiourea and 20.0 g (0.161 mol) 2-chloroethyl ethyl sulfide in 75 ml ethanol was refluxed for 1.5 hours. The solution was evaporated and the resulting oil triturated with ether to obtain 32.7 g S-alkylthiouronium salt. Potassium hydroxide (20.2 g, 0.306 mol) was added to 30.0 g (0.15 mol) S-alkylthiouronium salt in 150 ml ethanol. The slurry was refluxed for 2 hours. The slurry was cooled to room temperature and 4-bromobutyronitrile (21.5 g, 0.145 mol) added all at once, and the slurry was stirred for 0.5 hours. The slurry was filtered and the salts washed with ethanol. The filtrate was evaporated and the resulting oil dissolved in 250 ml ethyl acetate. The solution was washed with 15 ml 4N NHCl and filtered to remove some insoluble material. The filtrate was washed with 10 ml 6N HCl and then with 25 ml brine; it was then dried over $MgSO_4$, filtered, and evaporated to give 28 g 4-(2-ethylthioethylthio)-butyronitrile as a pale yellow oil. A slurry of the nitrile (25.0 g, 0.132 mol), $NaN_3$ (9.4 g, 0.145 mol), $NH_4Cl$ (7.7 g, 0.145 mol), and aniline hydrochloride (1.7 g, 13 mmol) in 100 ml dimethylformamide (DMF) was stirred and heated at 100° C. under nitrogen for 42 hours. The slurry was evaporated to remove the DMF, and 75 ml water added to the residue. The resulting brown oil was extracted with 400 ml ethyl acetate. The solution was washed with 20 ml water and 25 ml brine. The light orange solution was dried over $MgSO_4$, treated with 7.5 g charcoal, and filtered. Evaporation of the pale yellow filtrate gave 34.5 g yellow oil. The oil was chromatographed through 2 liters silica gel using 90:5:5 dichloromethane:tetrahydrofuran:methanol. Trituration of the resulting oil with diethyl ether:ligroin gave 16.3 g colorless solid. Recrystallization from ether gave 14.9 g (48.5%) of Compound I-134, mp 64°-66° C.

| Analytical Results | Calc. | Found |
|---|---|---|
| C | 41.4 | 41.6 |
| H | 6.9 | 6.9 |
| N | 24.1 | 24.6 |
| S | 27.6 | 27.6 |

SYNTHESIS EXAMPLE 4

Preparation of Development Inhibitor Moiety I-26

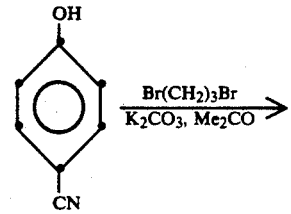

-continued

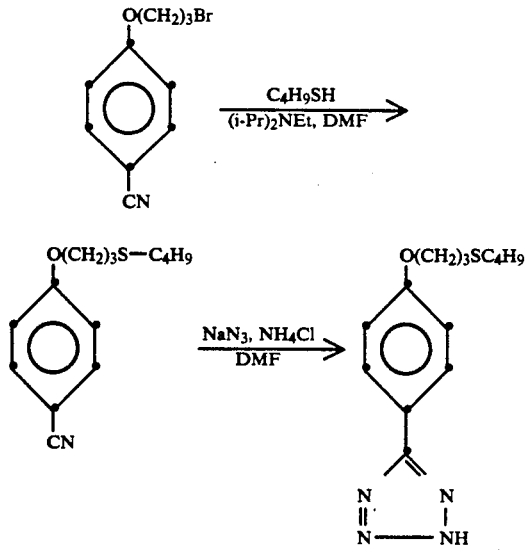

(I-26)

A stirred slurry of 4-hydroxybenzonitrile (50.0 g, 0.42 mol), 1,3-dibromopropane (678 g, 3.36 mol), potassium carbonate (87 g, 0.63 mol), and 18 crown-6 (2.5 g) in 1 l acetone was refluxed for 4 hours; 600 ml acetone was distilled off, and the residue poured into 2 liter water. The aqueous layer was extracted with 2×250 ml dichloromethane. The organic layers were combined and then washed with 750 ml water, dried over $MgSO_4$, filtered, and evaporated to remove the solvent. The excess 1,3-dibromopropane was removed on the rotary evaporator at 100° C. to recover 518 g. The residue (115 g) was dissolved in 250 ml 1:1 ligroin: ligroin:dichloromethane and the solution filtered to obtain 4.5 g 1,3-(4'-cyanophenoxy)propane, mp 166°-167° C. The filtrate was evaporated. The resulting oil chromatographed through 3 liters silica gel using 55:45 ligroin:dichloromethane to give 89.3 g (89%) 4'-(3-bromopropoxy)benzonitrile. A solution of the nitrile (24 g, 0.10 mol), butanethiol (10.8 g, 0.12 mol), and N,N-diisopropylethylamine (16 g, 0.125 mol) in 75 ml DMF was heated on the steam bath for 3 hours. The solution was poured into 600 ml ice/water, and the resulting oil extracted with 2×200 ml diethyl ether. The ether solution was extracted with 500 ml 2.5% NaOH, 100 ml 3N HCl, and brine. The solution was dried over $MgSO_4$, filtered, and evaporated to give 25 g light orange oil. The oil was chromatographed through 3 liters silica gel using 9:1 dichloromethane:ethyl acetate to give 16.9 g (68%) 4'-(3-butylthiopropoxy)benzonitrile, a light yellow oil. A slurry of the nitrile (16.0 g, 64.2 mmol), $NaN_3$ (4.6 g, 70.6 mmol), $NH_4Cl$ (3.75 g, 70.6 mmol), and aniline hydrochloride (0.8 g, 7 mmol) in 75 ml DMF was stirred and heated at 105° C. for 18 hours. The DMF was removed on a rotary evaporator, and 75 ml water and 5 ml HCl added to the residue. The solid was filtered and washed with water to obtain, on drying, 16.4 g light tan solid. Recrystallization from acetonitrile gave 14.5 g off-white solid; further recrystallization from methanol gave 12.5 g (66.5%) Compound I-26, mp 156°-157° C.

| Analytical Results | Calc. | Found |
|---|---|---|
| C | 57.5 | 57.4 |
| H | 6.9 | 6.7 |
| N | 19.2 | 19.3 |
| S | 11.0 | 10.7 |

SYNTHESIS EXAMPLE 5

Preparation of Development Inhibitor Moiety I-139

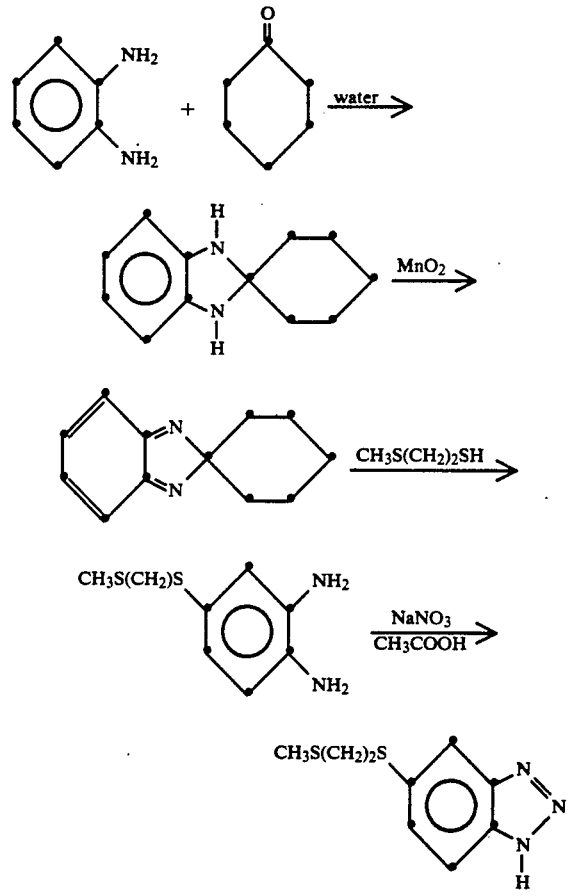

(I-139)

In a procedure similar to that described by H. Suschitszky in *Croatica Chemica Acta*, 59, 57-77 (1986), o-phenylenediamine (108 g, 1.0 mol) was dissolved in 1 liter hot water on a steam bath. With vigorous stirring and heating, cyclohexanone (98 g, 1.0 mol) was added in a rapid stream. After 5 minutes a brown gum formed; after 15 minutes a solid resulted. Stirring was continued for a total of 35 minutes. The slurry was cooled in an ice bath and then filtered to yield 112 g (59.5%) 1,3-dihydrobenzimidazole-2-spirocyclohexane. To a stirred solution of this compound (50 g, 0.266 mol) in 1 liter dichloromethane chloride was added, in several portions, 100 g $MnO_2$. The resulting slurry was stirred vigorously for 30 minutes and filtered. The solids were washed with dichloromethane and the filtrate evaporated to obtain an oil. The oil was dissolved in 200 ml, ligroin, and the solution cooled to −10° C. The resulting solid was filtered to yield 46 g (93%) 2H-benzimidazole-2-spirocyclohexane. A solution of 2-chloroethyl methyl sulfide (19.8 g, 0.20 mol) and thiourea (15.2 g, 0.20 mol)

in 50 ml absolute alcohol was refluxed for 6 hours. To this was added a solution of KOH (22.4 g, 0.40 mol) in 100 ml methanol, and the resulting slurry refluxed for 45 minutes. After cooling to 30°, 37.2 g (0.20 mol) of freshly prepared 2H-benzimidazole-2-spirocyclohexane was added in portions. The mixture was stirred at room temperature for 10 minutes and then at reflux for 2 minutes. After cooling, the mixture was evaporated to a thick slurry; 100 ml dichloromethane was added and the mixture evaporated. This was repeated and the residue treated with 100 ml water and 200 ml dichloromethane. The organic layer was separated, washed with water, dried over $MgSO_4$, filtered and evaporated. The residue was chromatographed through silica gel using an increasingly polar mixture of dichloromethane and acetonitrile. Product fractions were combined and evaporated to give 7.0 g 5'-(2-methylthioethylthio)-1',2'-phenylenediamine. A stirred solution of the phenylenediamine (5.0 g, 0.027 mol) in 50 ml acetic acid was treated with sodium nitrite (2.6 g, 0.037 mol), in 5 ml water, over 30 seconds at room temperature. The mixture was stirred for 15 minutes and then evaporated. The residue was treated with 50 ml water and 50 ml dichloromethane. The organic layer was dried over $MgSO_4$, filtered, and evaporated. Solid was chromatographed through silica gel using an increasingly polar mixture of dichloromethane chloride and acetone. The isolated product was recrystallized from ethyl acetate to yield 3.2 g (62%) 6'-(2-methyl-thioethylthio)benzotriazole, I-139.

Compounds which contain releasable development inhibitor moieties suitable for use in accordance with this invention can be prepared by first synthesizing the inhibitor fragment and then attaching it to the carrier or to a linking or timing group by well-known methods.

Synthesis Examples 6 through 9, described below, are typical preparations of development inhibitor releasing (DIR) compounds useful in this invention:

SYNTHESIS EXAMPLE 6

Preparation of Compound No. D-1

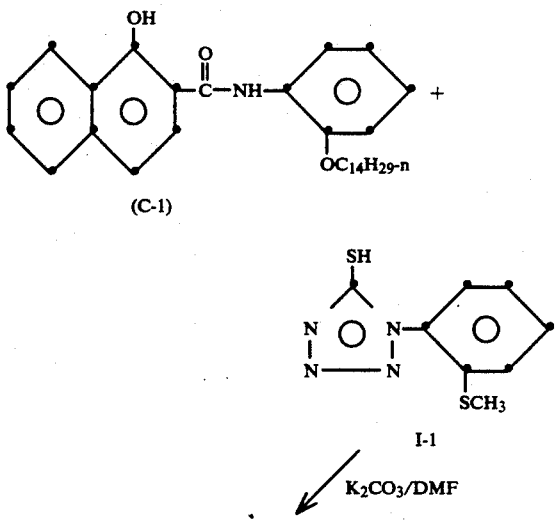

-continued

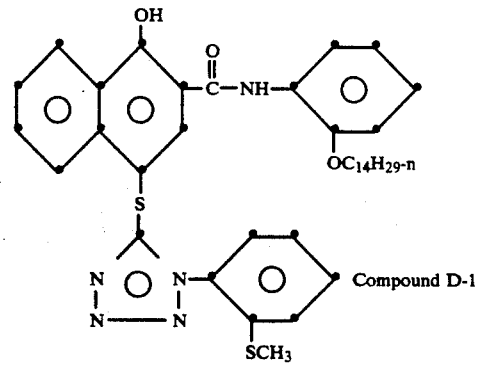

A combination of 26.8 g of C=1 (44.6 mmol, MW 601), 10.0 g of I-1 (44.6 mmol, MW 224), 6.2 g of $K_2CO_3$ (anhydrous, 44.6 mmol) and 250 ml of dry N,N-dimethylformamide (DMF) in 500 ml 3-neck round bottom flask with mechanical stirrer and condenser attached was heated on a steam bath for 6 hours. The reaction mixture was then cooled overnight to room temperature. Nitrogen gas was flowed down the condenser to pressurize the system after which the mixture was poured into 500 ml water. Acidification was accomplished with conc. (37%) HCl to pH 1. The solution yielded a sticky, dark blue material which was dissolved in 300 ml of dichloromethane. This solution was transferred to a separatory funnel and extracted with 300 ml of additional dichloromethane. The extractions were combined and washed with 300 ml $H_2O$ and 150 ml of saturated NaCl solution. The resulting product was dried with $MgSO_4$ and concentrated on a rotary evaporator. Recrystallization was twice effected from a 50/50 hexane/ethylacetate solution. The yield of Compound D-1 was 8.8 g (28%) melting at 116.5°–117° C.

| Analytical Results | Calc. | Found |
|---|---|---|
| C | 67.1 | 67.1 |
| H | 6.8 | 7.0 |
| N | 10.0 | 9.9 |
| S | 9.2 | 9.2 |

SYNTHESIS EXAMPLE 7

Preparation of Compound D-2

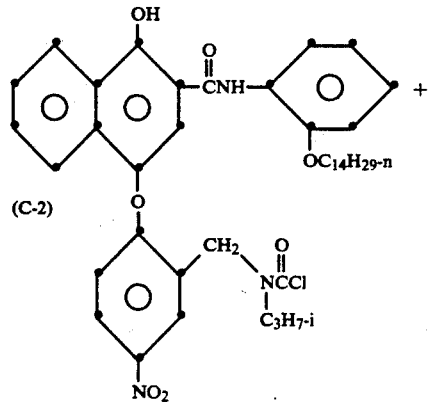

-continued

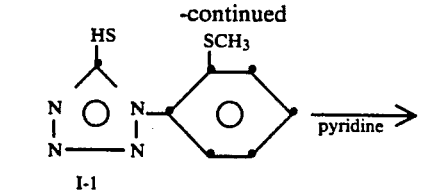

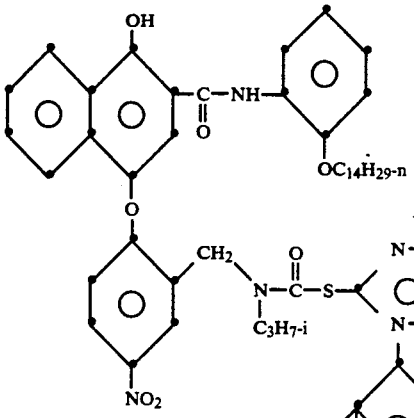

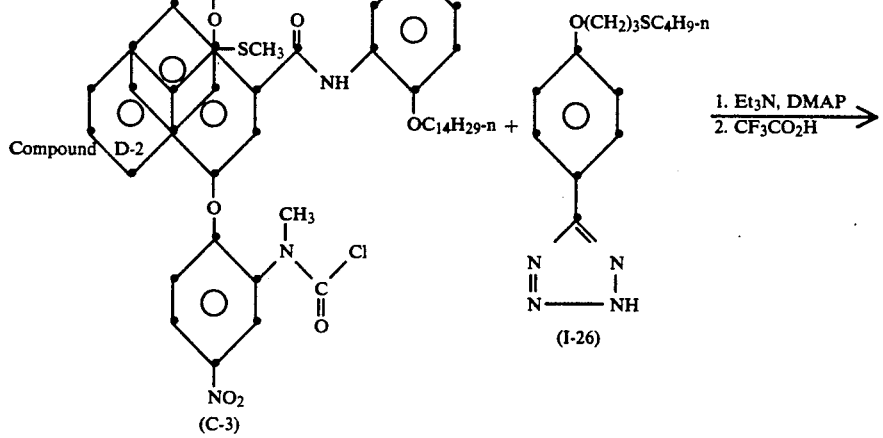

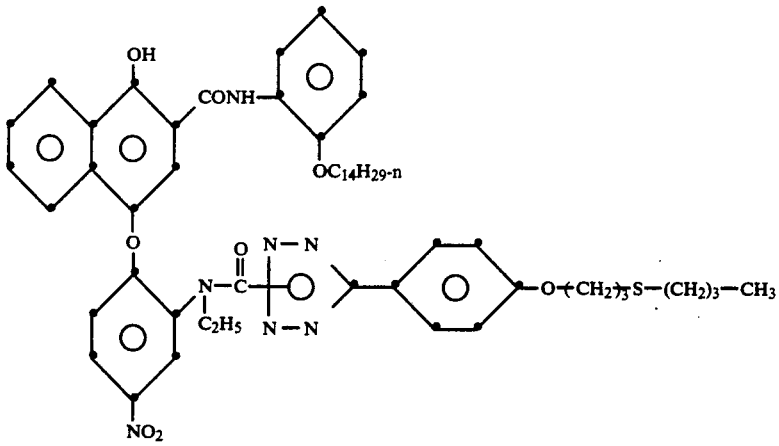

Compound D-3

A solution of 16.6 g C-2 (0.022 mole) and 5 g I-1 in pyridine was stirred overnight at room temperature and then poured into ice/HCl. The precipitate was collected by filtration and recrystallized from isopropyl alcohol. Resulting crystals were recovered by filtration. The crystals turned to a gum overnight and were then triturated several times in isopropyl alcohol, recovered and dried to yield 14 g of Compound D-2 having a melting point of 113°-115° C.

| Analytical Results | Calc. | Found |
|---|---|---|
| N | 10.5 | 10.5 |
| C | 64.3 | 64.1 |
| H | 6.3 | 6.4 |
| S | 6.8 | 7.1 |

SYNTHESIS EXAMPLE 8

Preparation of Compound D-3

A solution of I-26 (3.80 g, 13 mmol) and triethylamine (2.63 g, 26 mmol) in 30 ml dichloromethane was added dropwise over 10 minutes to a solution of Compound C-3 (9.91 g, 13 mmol) and 4-(N,N-dimethylamino)pyridine (DMAP) (1.59 g, 13 mmol) in 70 ml dichloromethane at 5° C. The solution was stirred at room temperature for 15 minutes, cooled to 5° C. and treated with 15 ml trifluoroacetic acid in one portion. The solution was stirred at room temperature for 10 minutes and then concentrated to an oil. The oil was treated with water and the product extracted with ethyl acetate. The ethyl acetate solution was dried over $MgSO_4$, filtered, and evaporated. The residue was chromatographed through 500 g silica gel using dichloromethane to give 4.98 g (40%) Compound D-3, mp 109° C.

| Analytical Results | Calc. | Found |
|---|---|---|
| C | 66.30 | 66.20 |
| H | 6.82 | 6.74 |
| N | 10.21 | 10.15 |
| S | 5.34 | 3.21 |

SYNTHESIS EXAMPLE 9

Preparation of Compound D-102

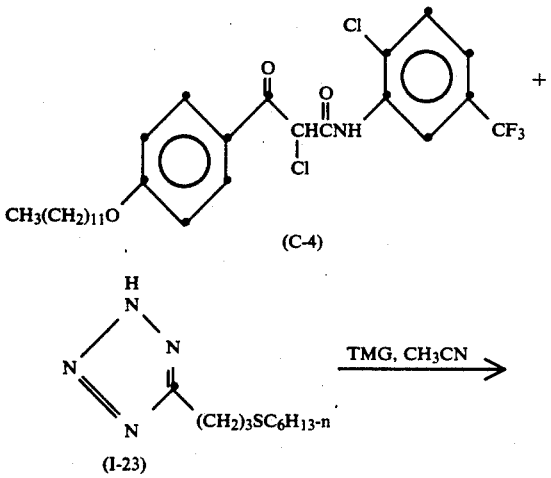

-continued

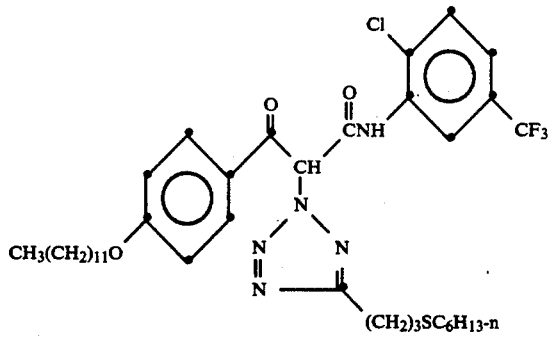

Compound D-102

A solution of C-4 (11.2 g, 20 mmol), Compound I-23 (4.56 g, 20 mmol), and tetramethylguanidine (TMG) (4.60 g, 40 mmol) in 100 ml acetonitrile was stirred at 55° C. under nitrogen for 1 hour. The solution was cooled to room temperature, diluted with diethyl ether, and washed with 5% NCl and then brine. The ether solution was dried over $MgSO_4$, filtered, and evaporated. The resulting oil was chromatographed through 300 g silica gel with 19:1 ligroin:ethyl acetate to elute the 1-substituted isomer of D-102 and then 4:1 ligroin-:ethyl acetate to obtain Compound D-102.

Recrystallization from 60 ml methanol gave 5.85 g (39%) Compound D-102, mp 52°-54° C.

| Analytical Results | Calc. | Found |
|---|---|---|
| C | 60.66 | 60.27 |
| H | 7.10 | 7.02 |
| N | 9.31 | 9.03 |
| S | 4.26 | 4.28 |

Still other development inhibitor compounds which can be synthesized in accordance with this invention are shown below:

D-4

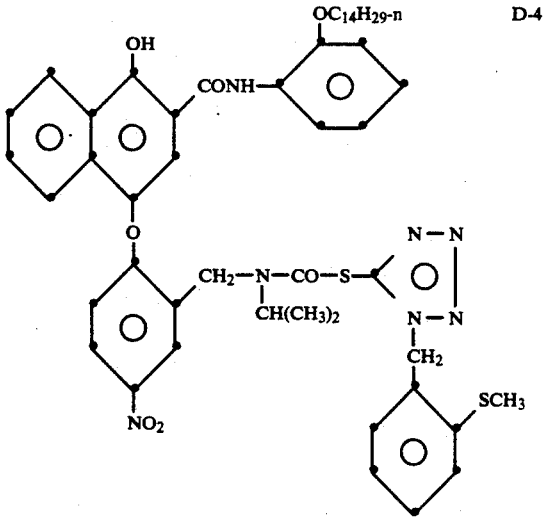

D-5

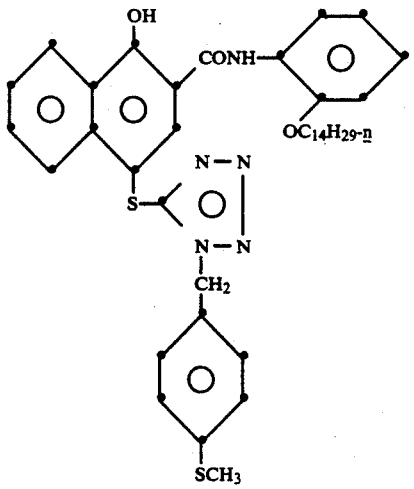

-continued
D-6
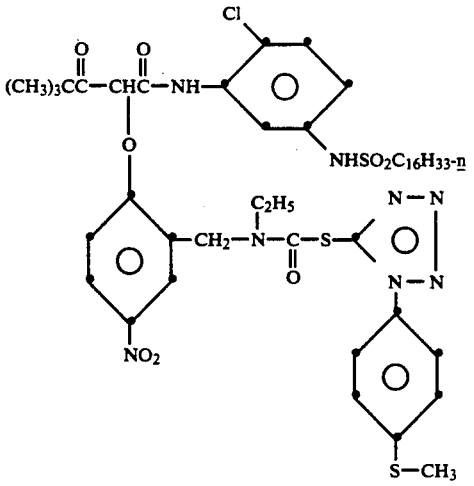
D-7
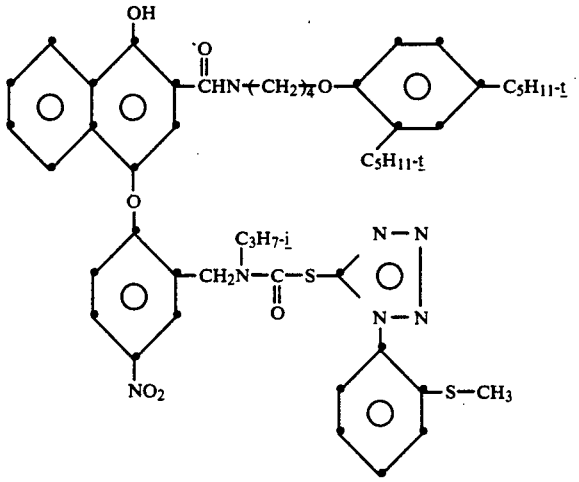
D-8
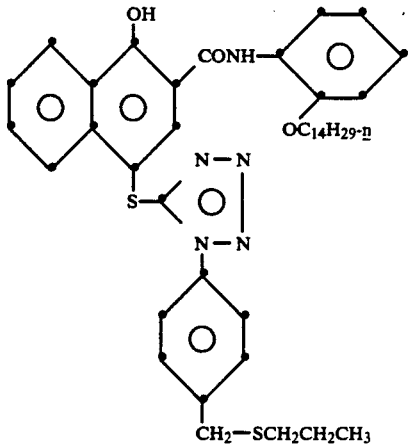

-continued
D-9
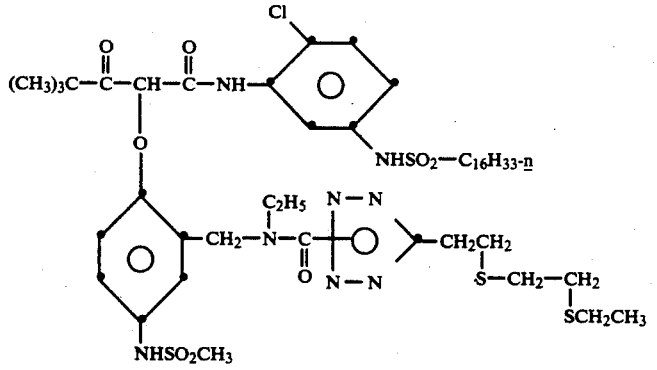
D-10
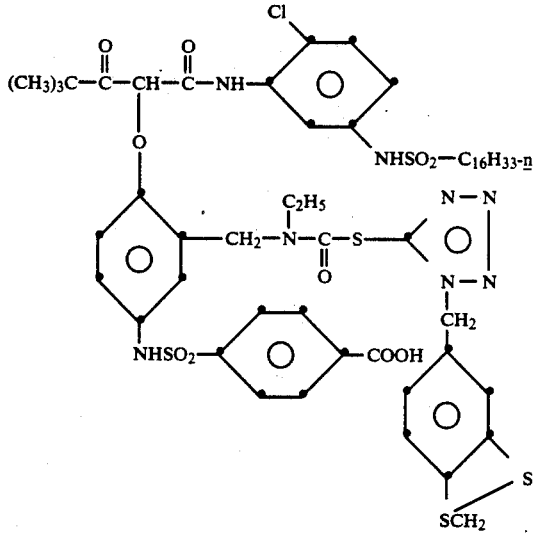
D-11
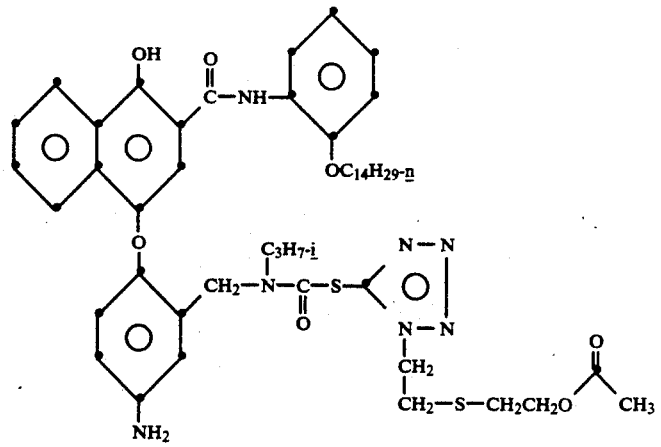

-continued
D-12
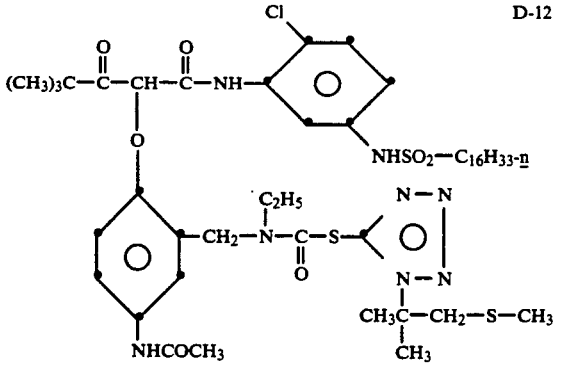
D-13
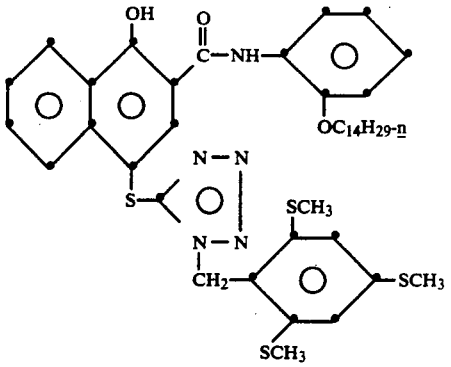
D-14
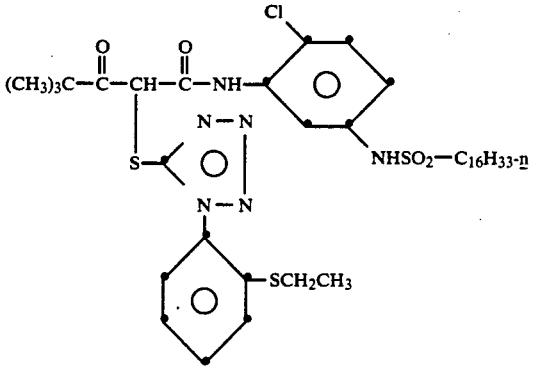
D-15
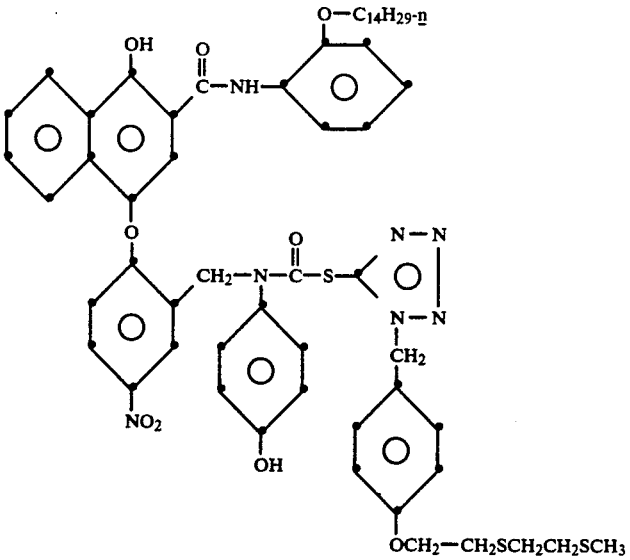

-continued
D-16
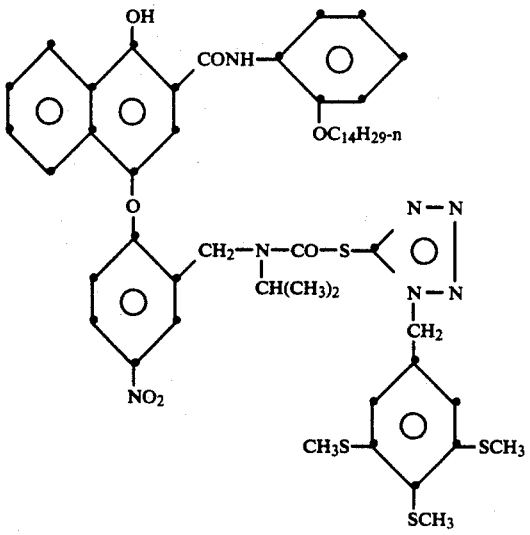
D-17
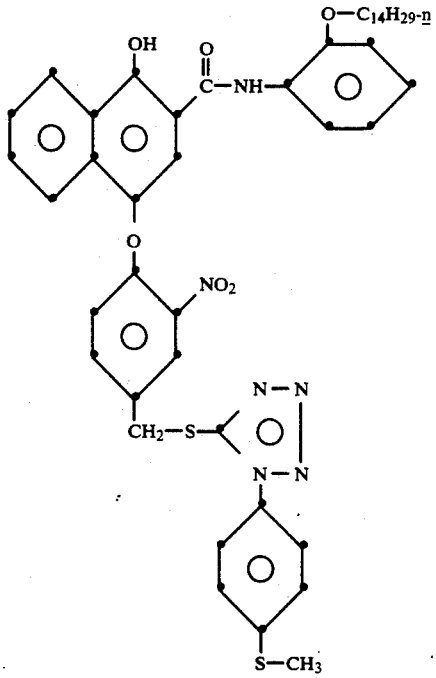
D-18
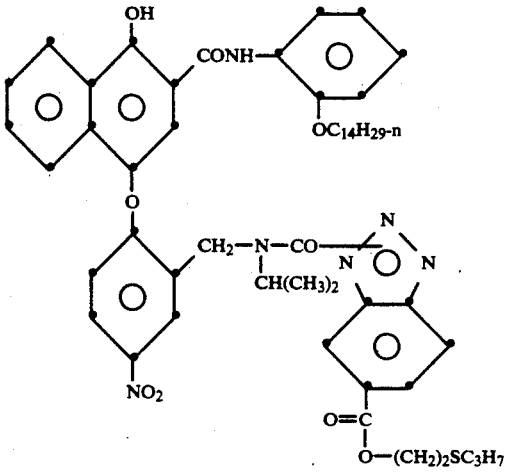
D-19
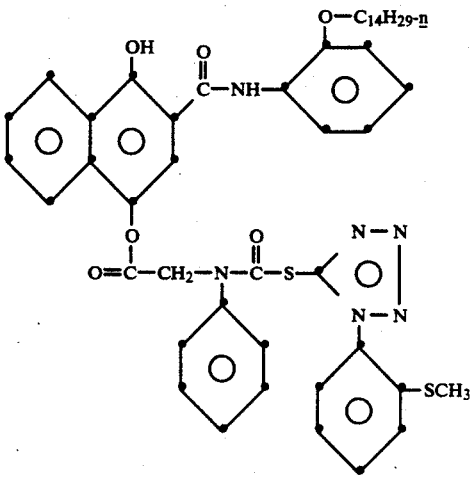

-continued
D-20
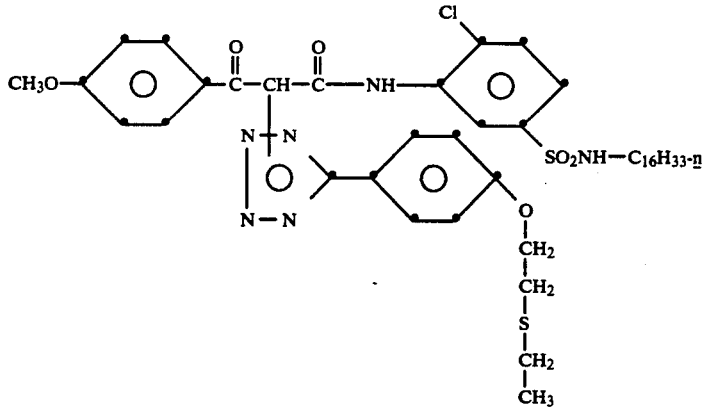
D-21
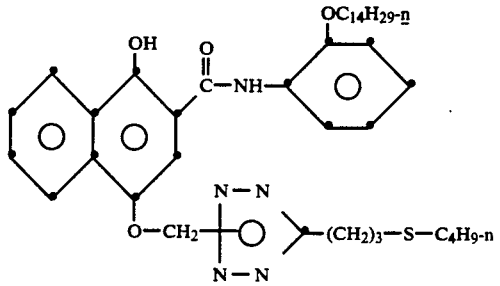
D-22
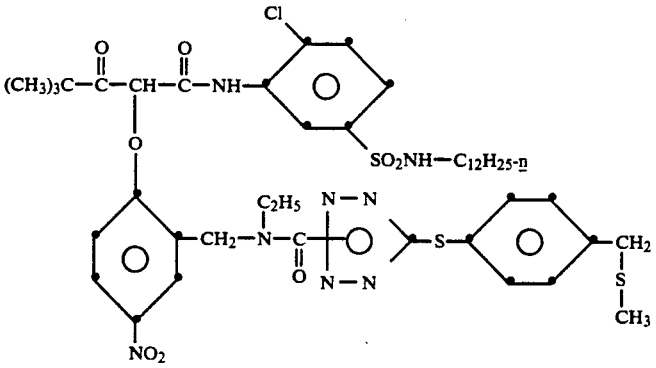
D-23
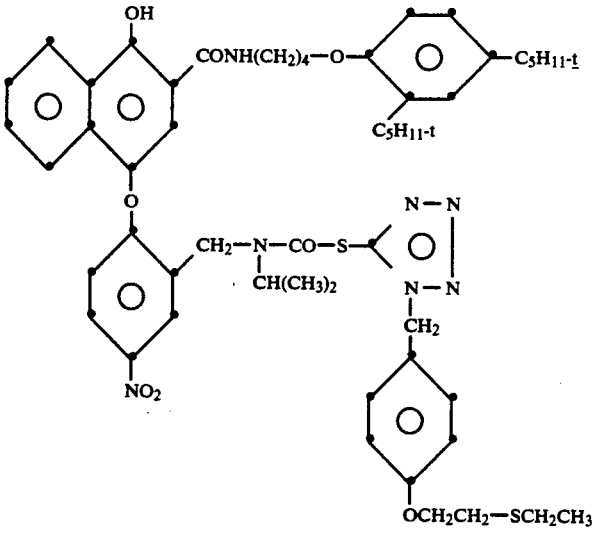

-continued
D-24
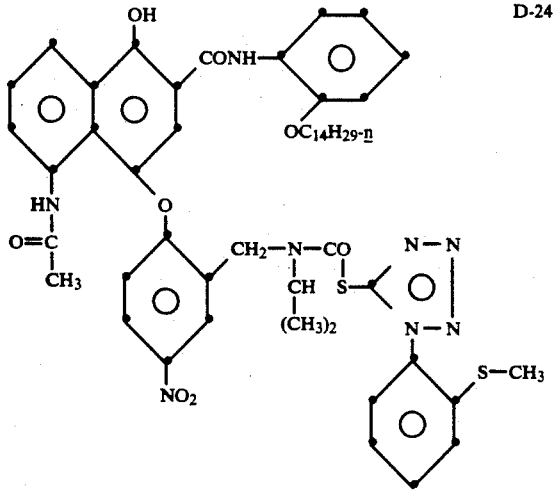
D-25
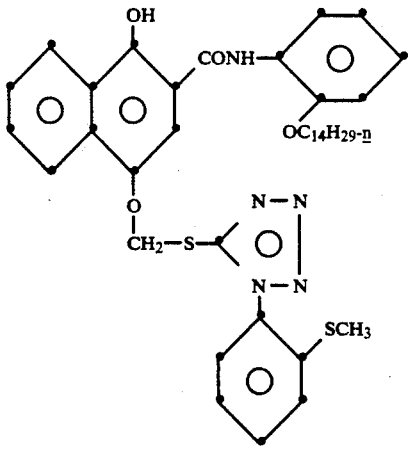
D-26
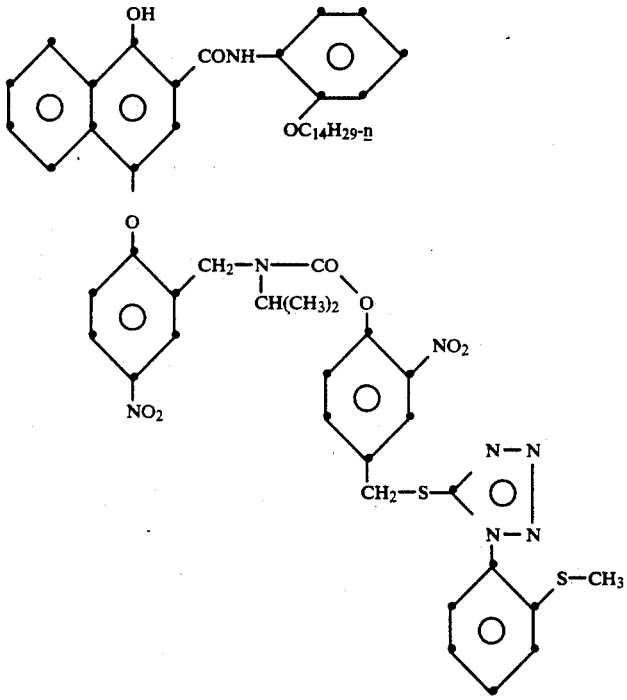
D-27
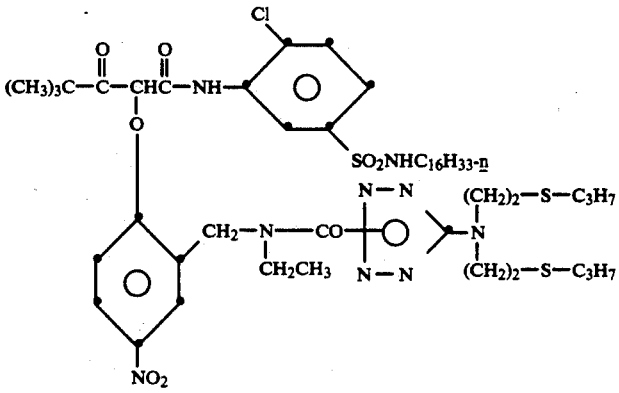

-continued
D-28
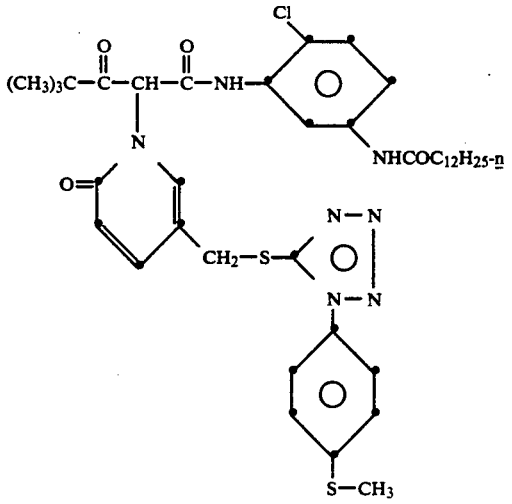
D-29
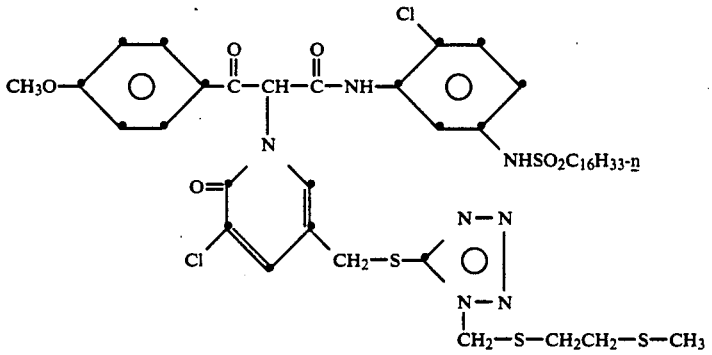
D-30
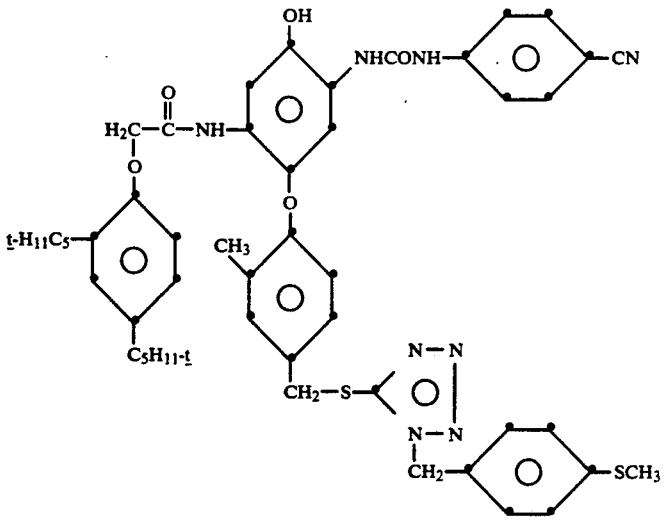

-continued
D-31
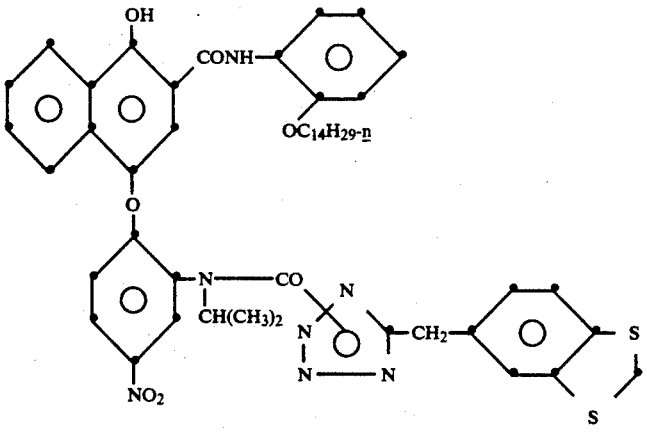
D-32
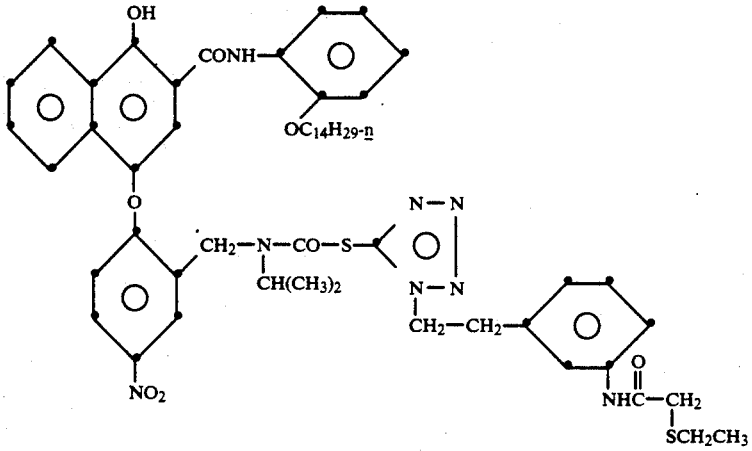
D-33
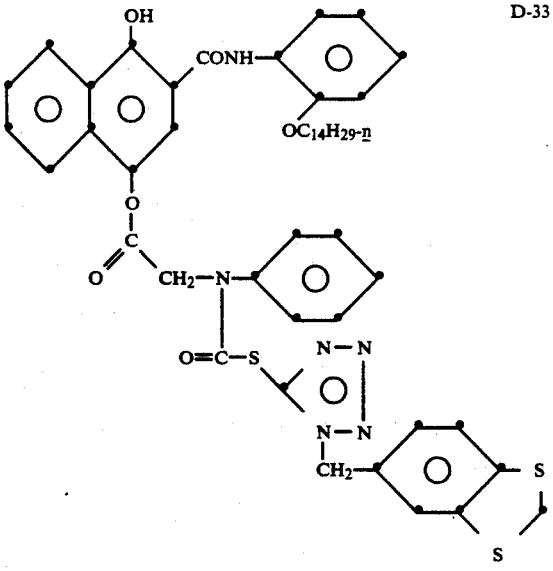
D-34
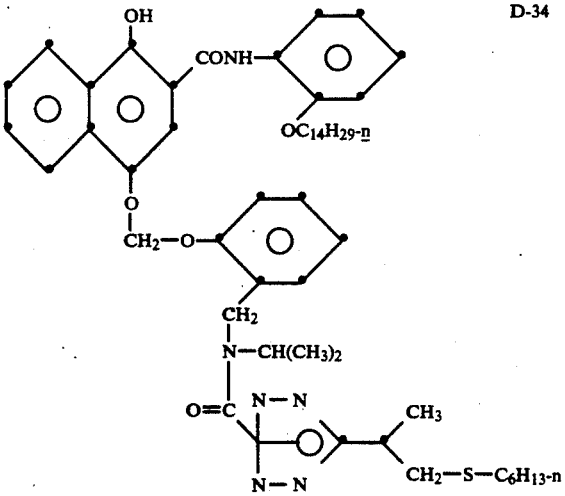

-continued
D-35
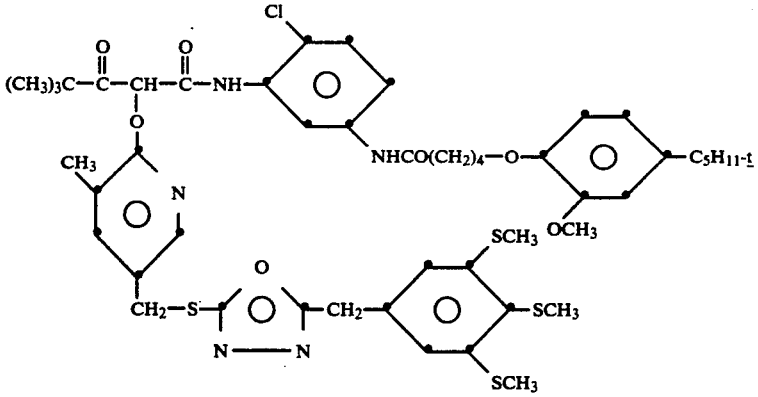
D-36
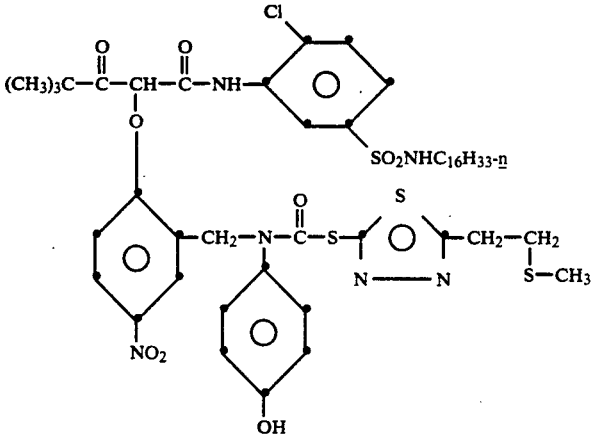
D-37
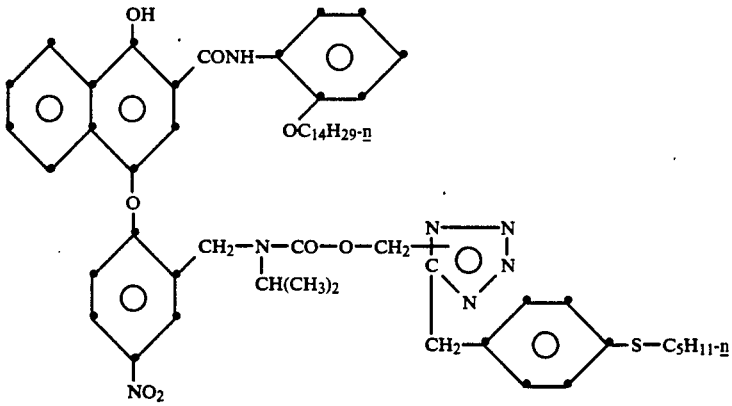
D-38
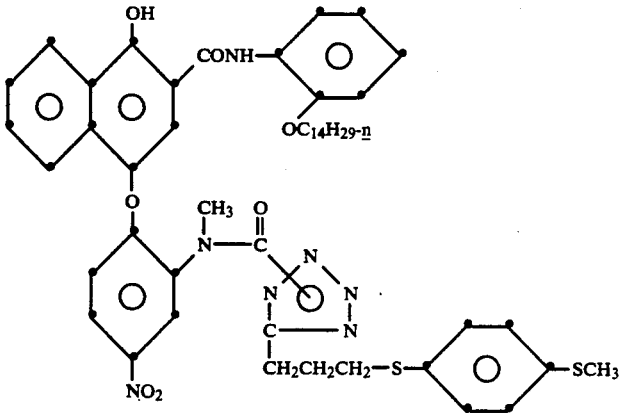

-continued
D-39
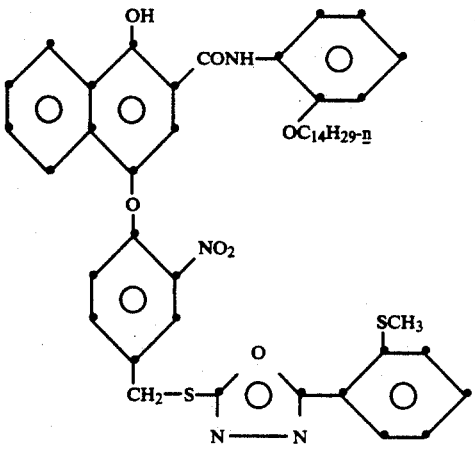
D-40
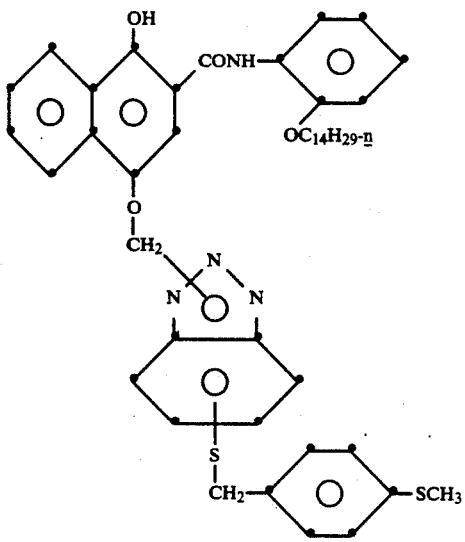
D-41
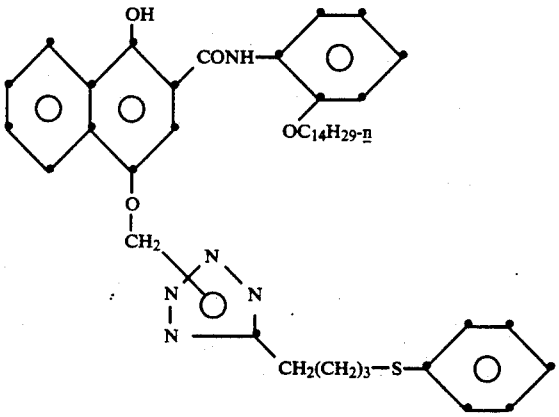
D-42
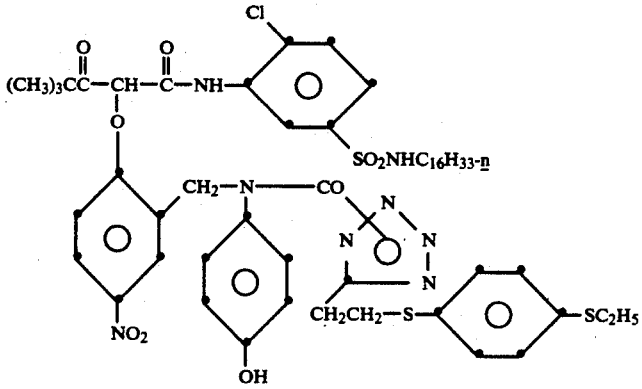

-continued
D-43
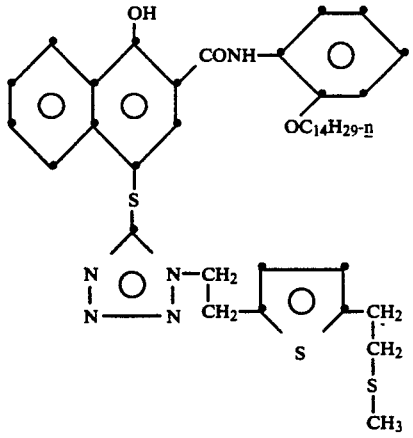
D-44
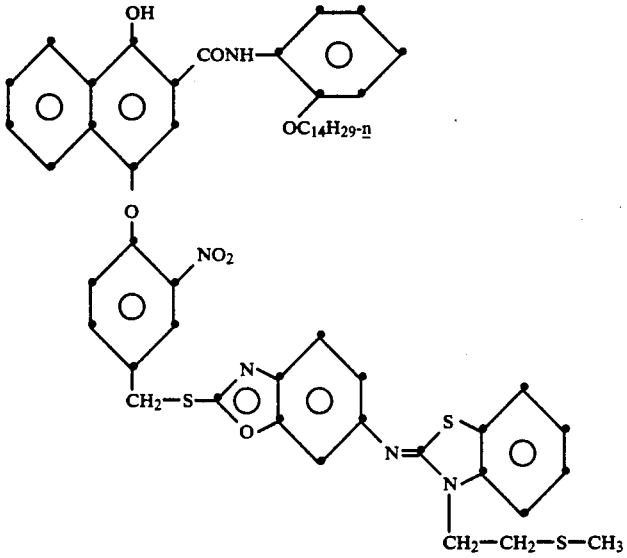
D-45
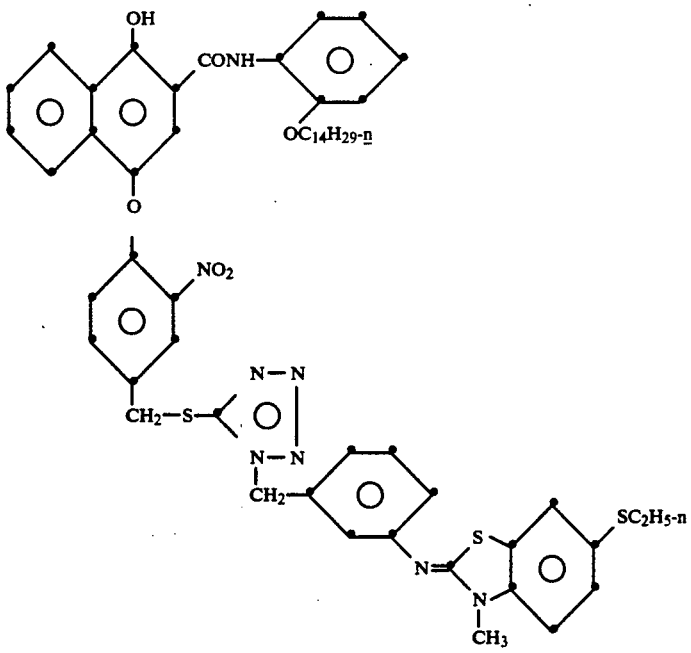

-continued
D-46
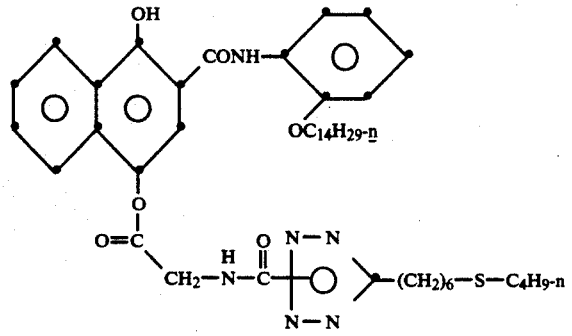
D-47
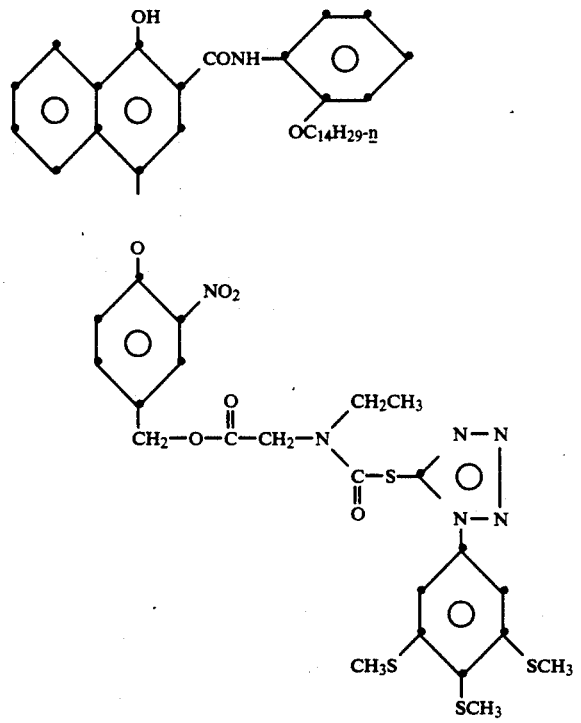
D-48
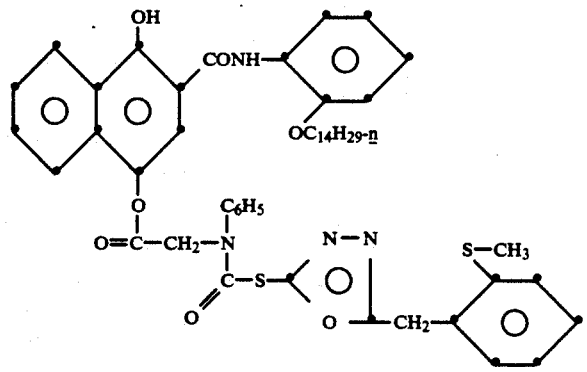

-continued
D-49
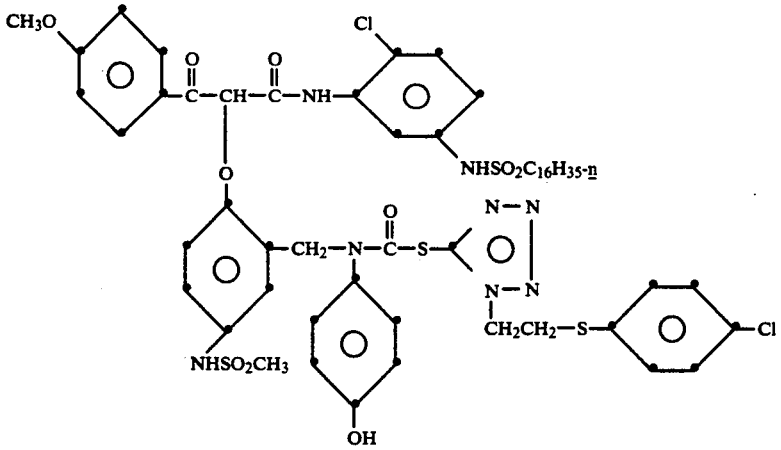
D-50
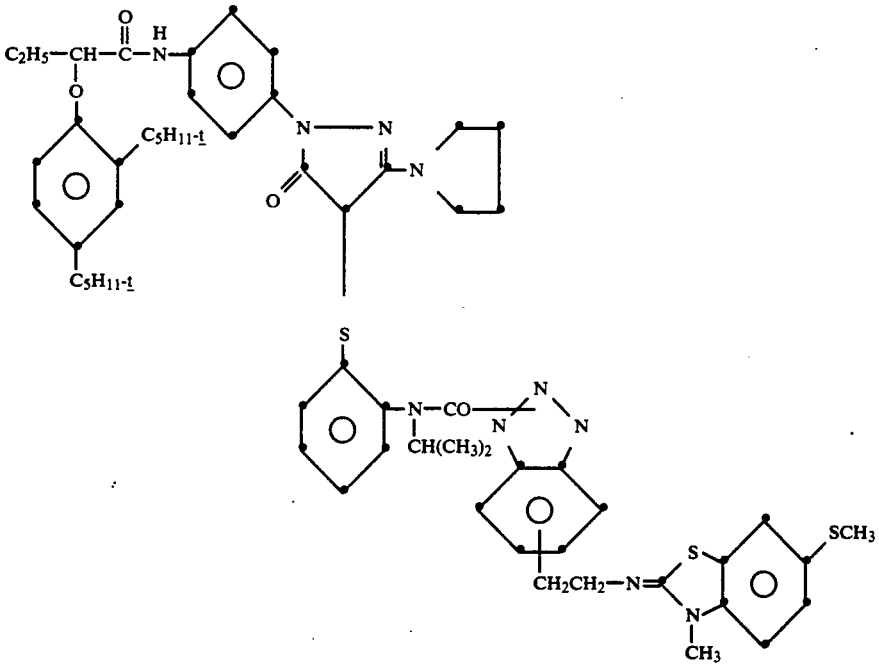
D-51
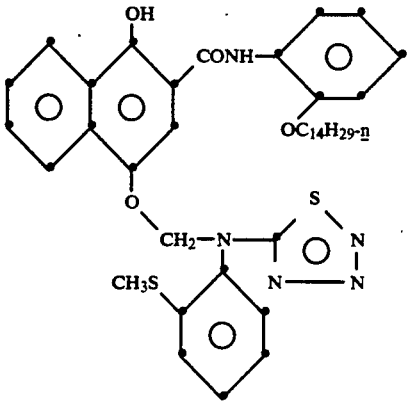

-continued
D-52
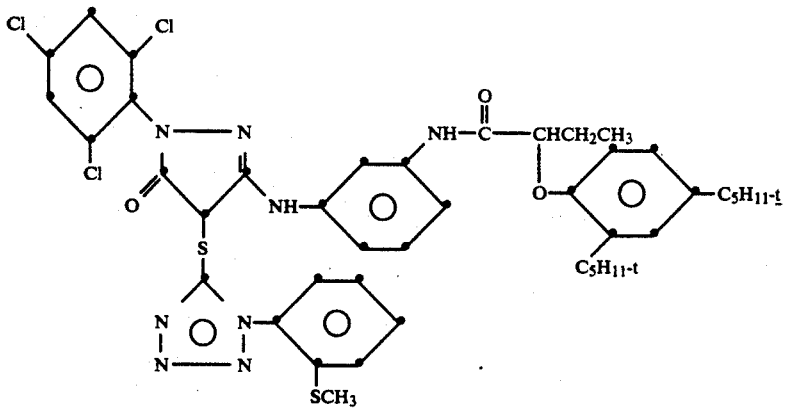
D-53
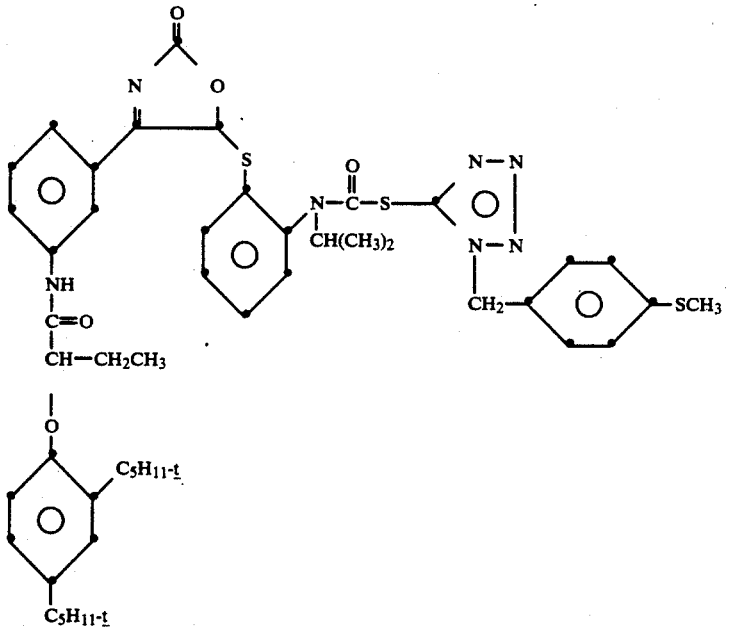
D-54
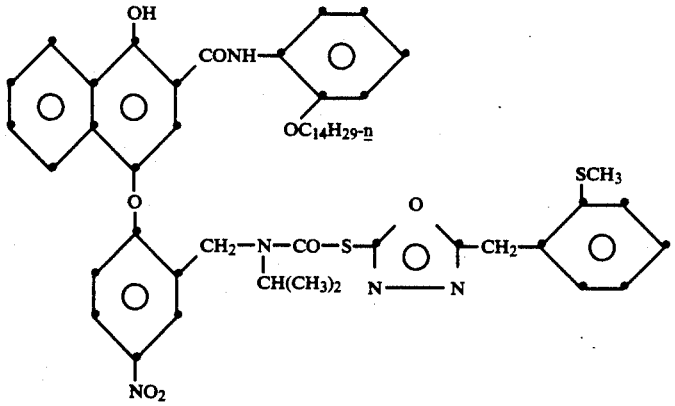
D-55
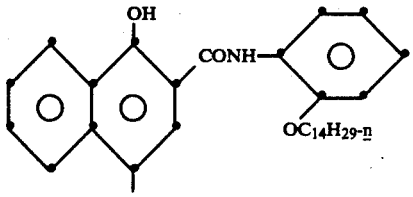

-continued
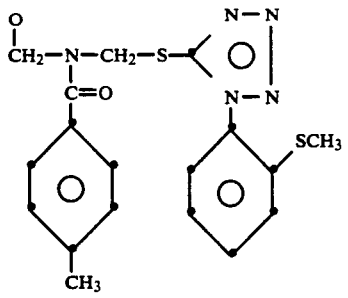
D-56
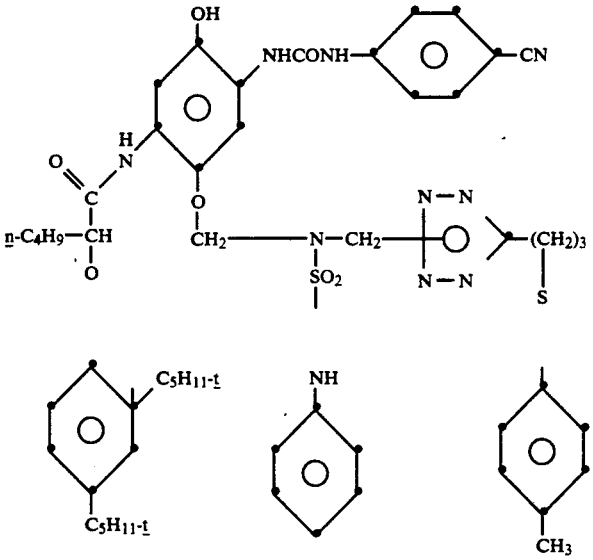
D-57
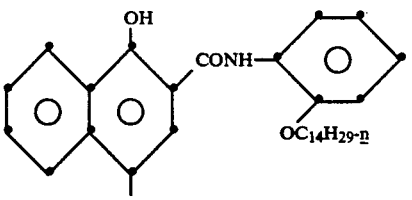
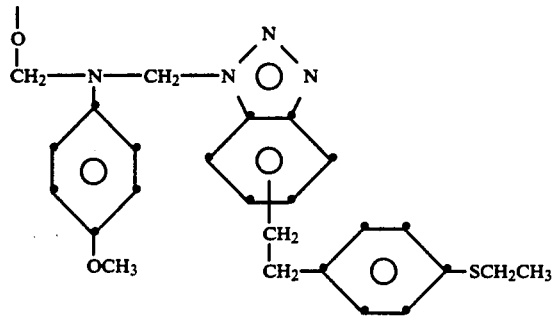

-continued
D-58
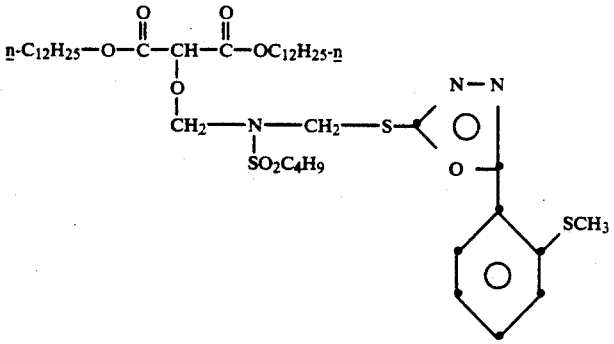
D-59
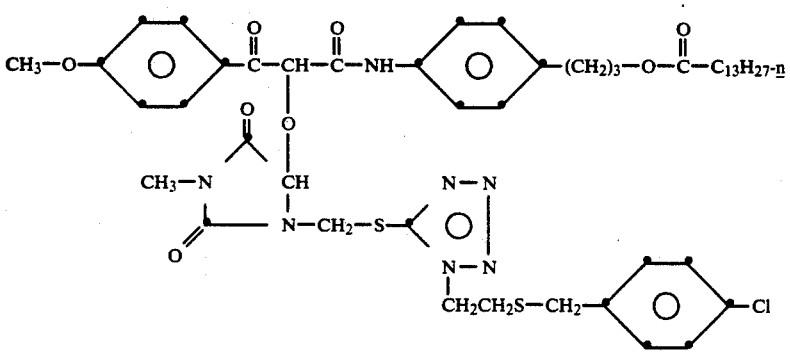
D-60
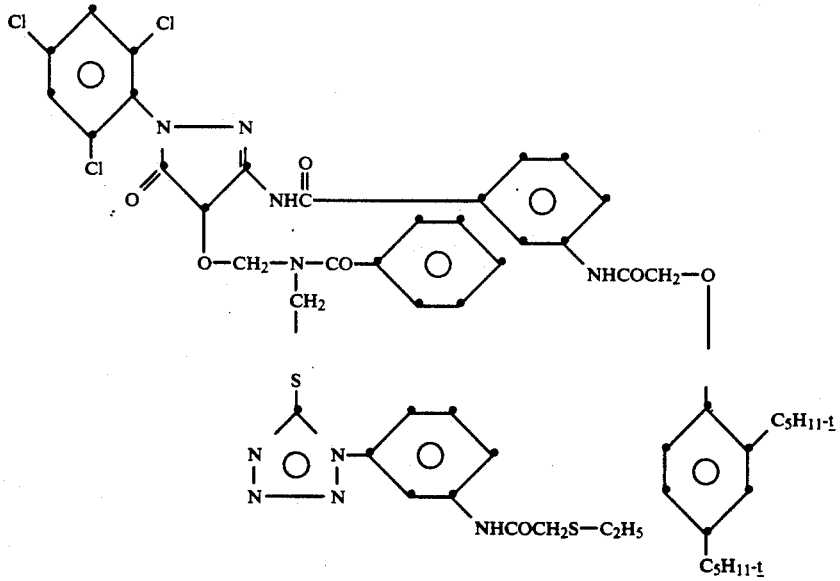
D-61
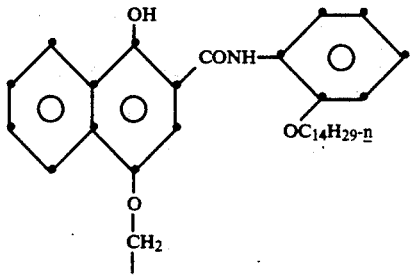

-continued
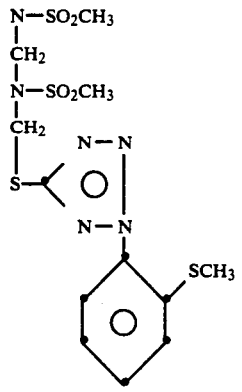
D-62
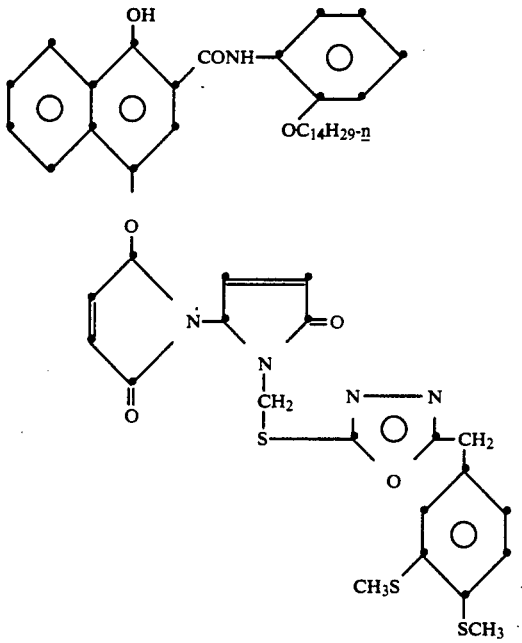
D-63
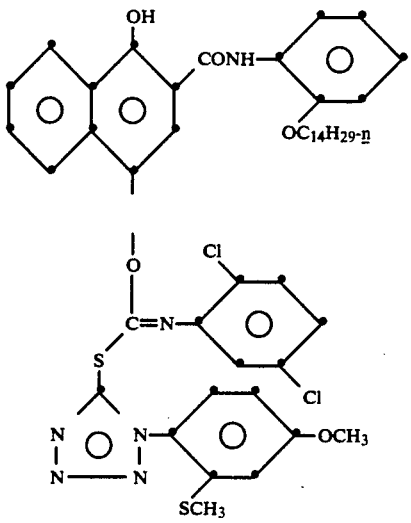

-continued
D-64
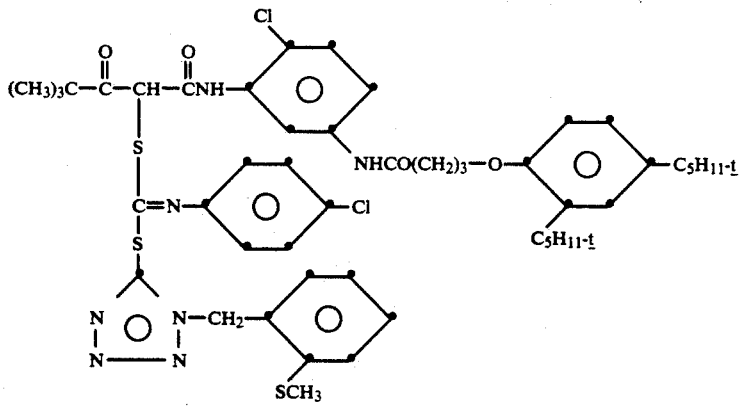
D-65
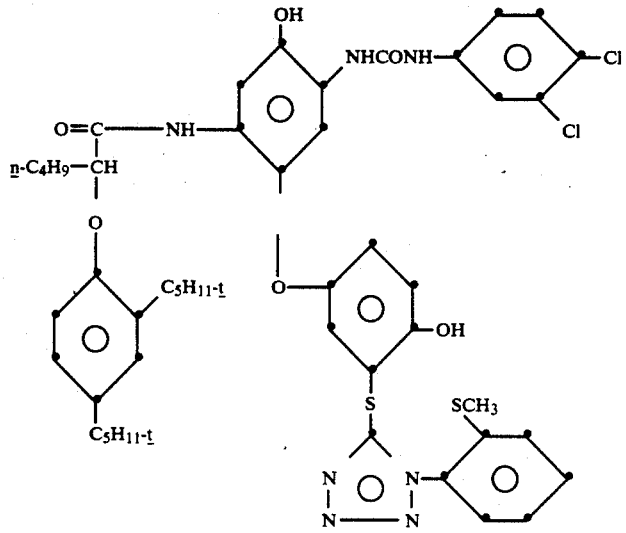
D-66
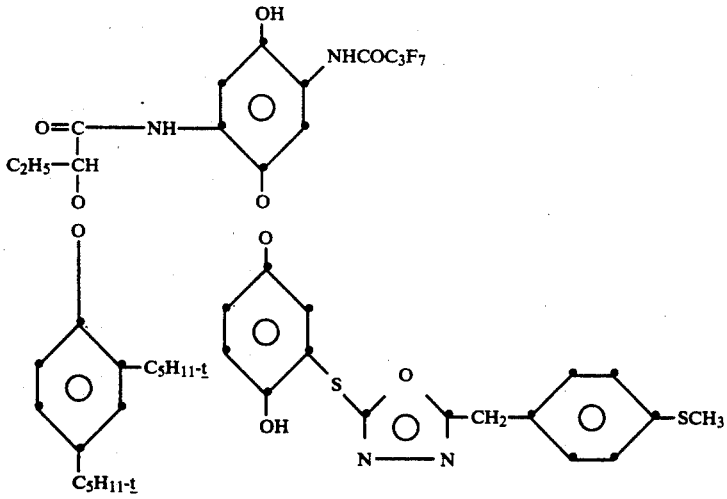
D-67
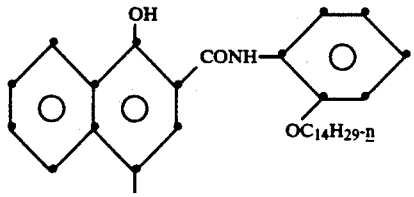

-continued
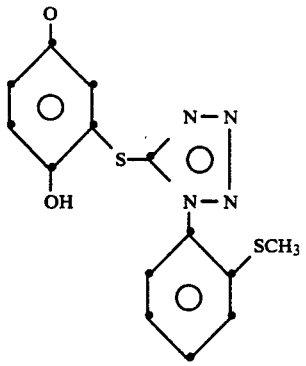
D-68
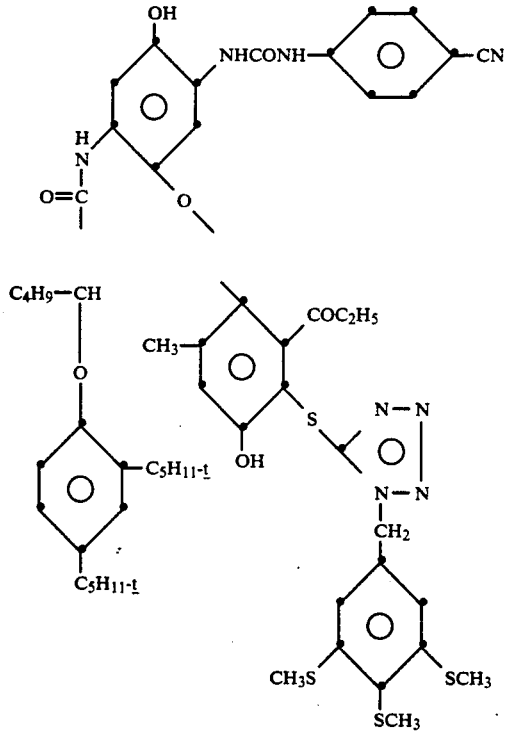
D-69
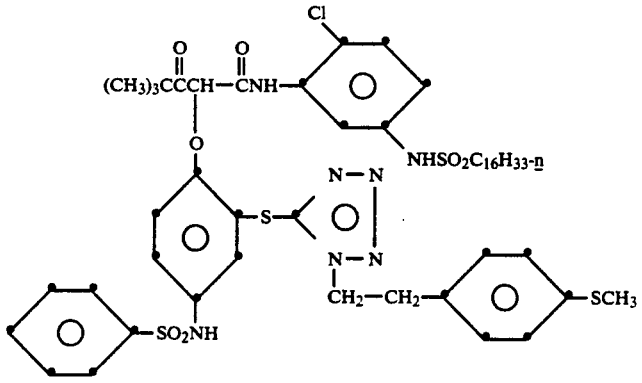

-continued
D-70
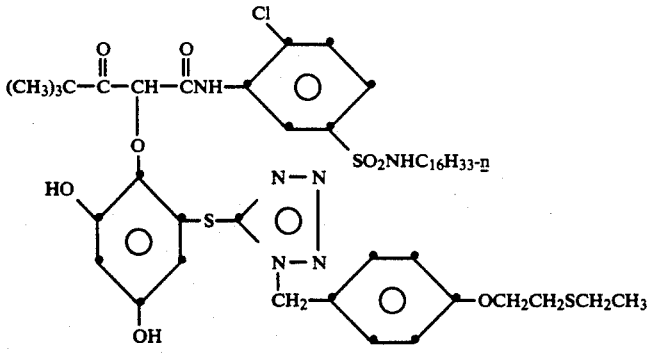
D-71
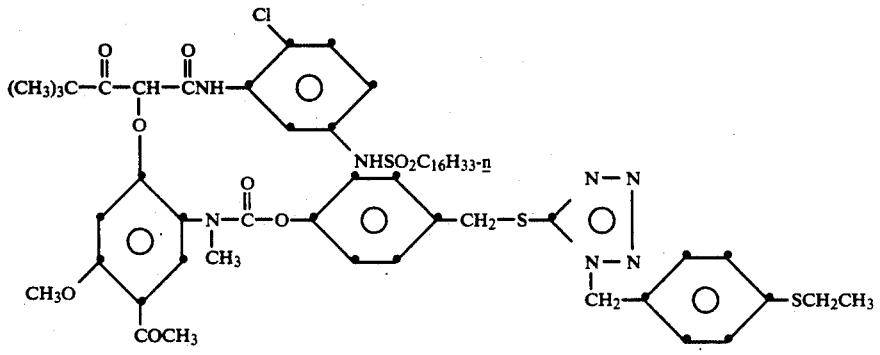
D-72
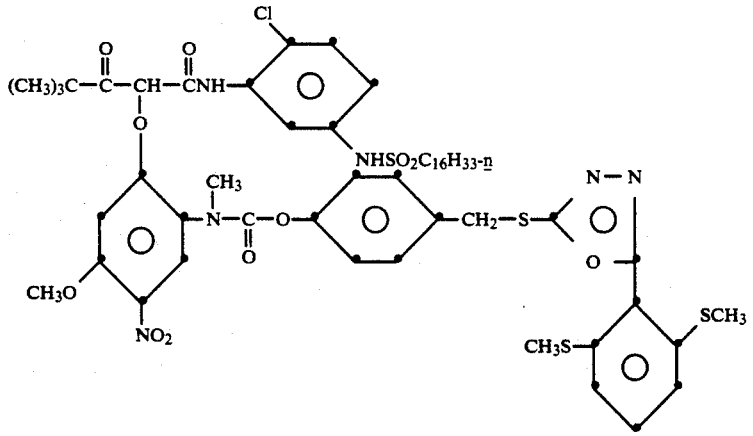
D-73
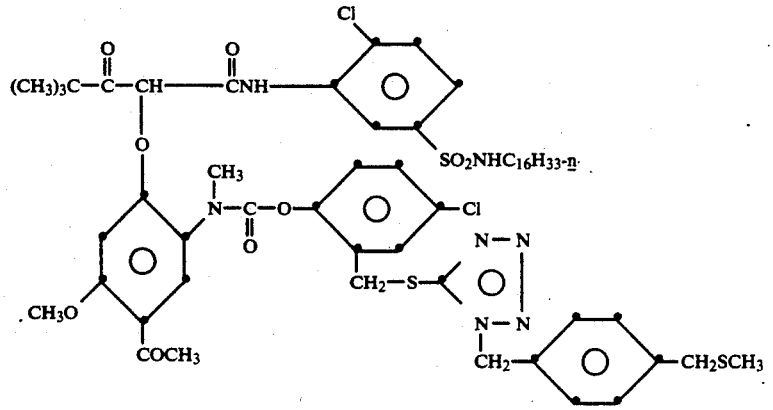

-continued
D-74
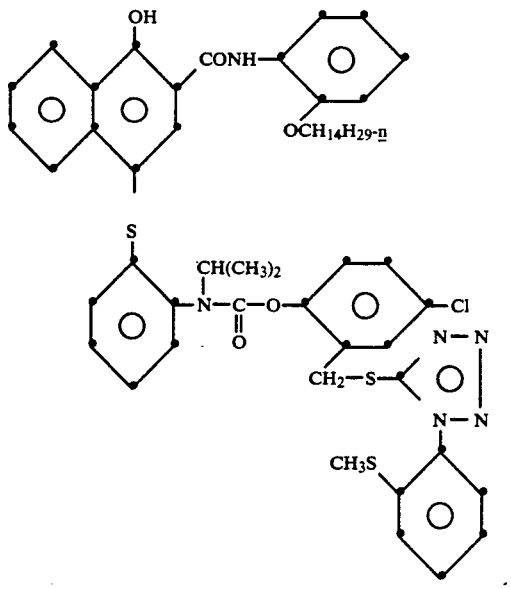
D-75
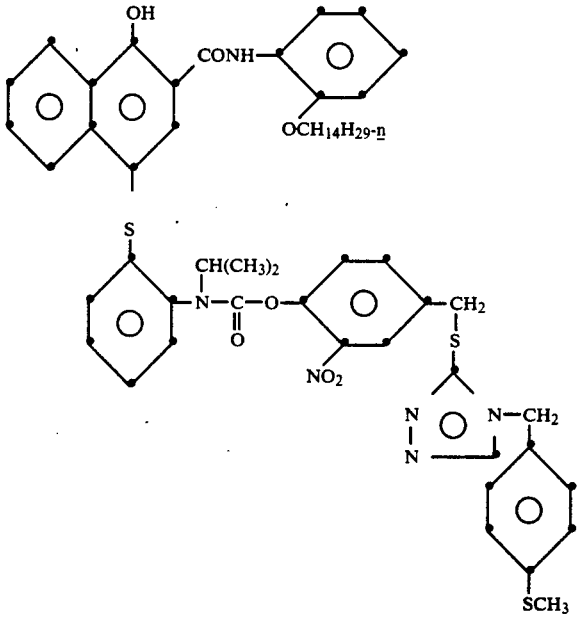
D-76
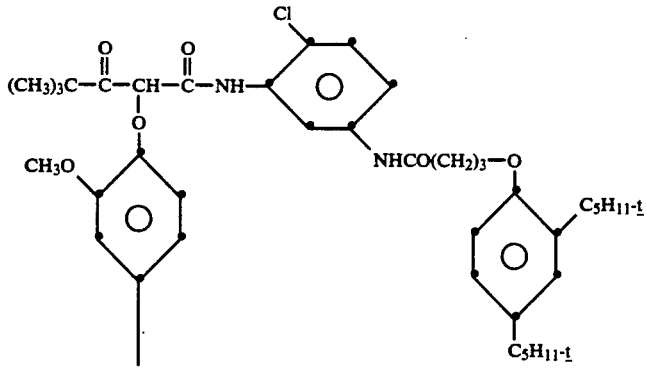

-continued
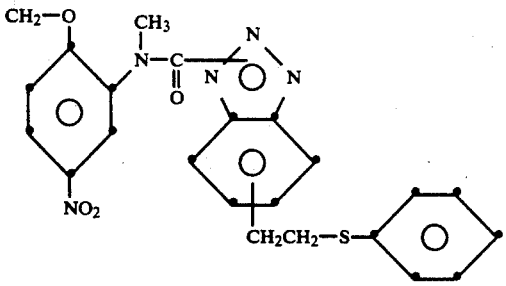
D-77
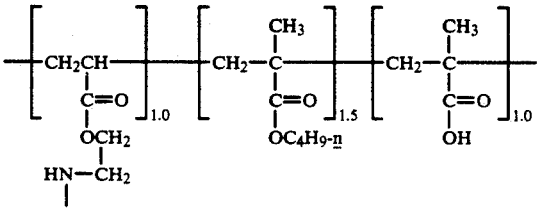
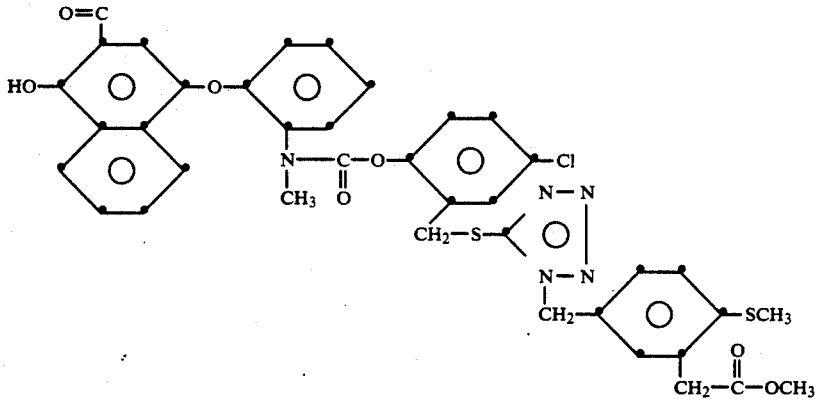
D-78
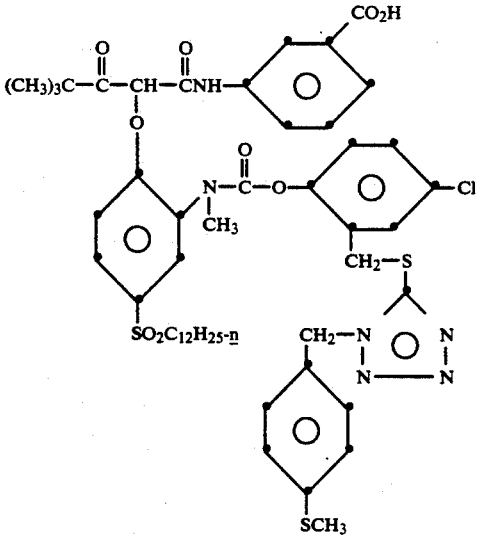

-continued
D-79
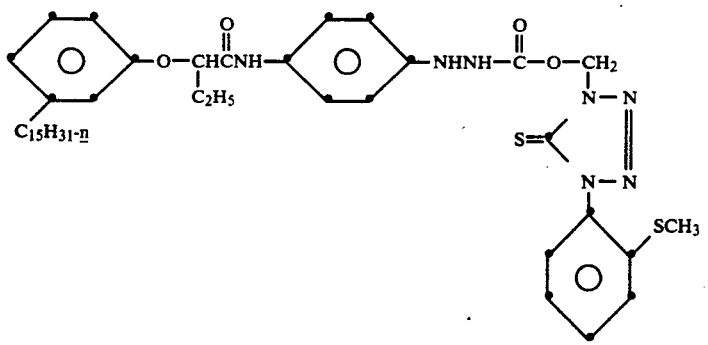
D-80
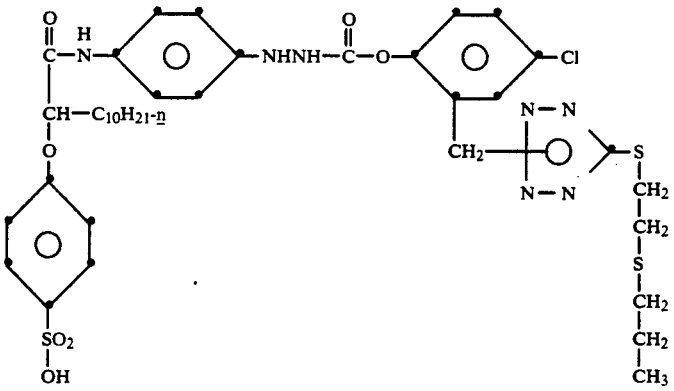
D-81
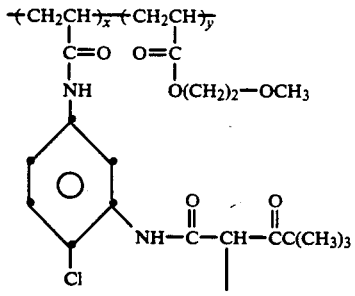
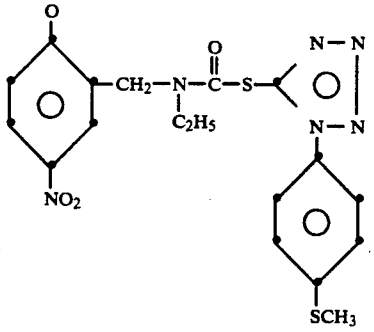

-continued
D-82
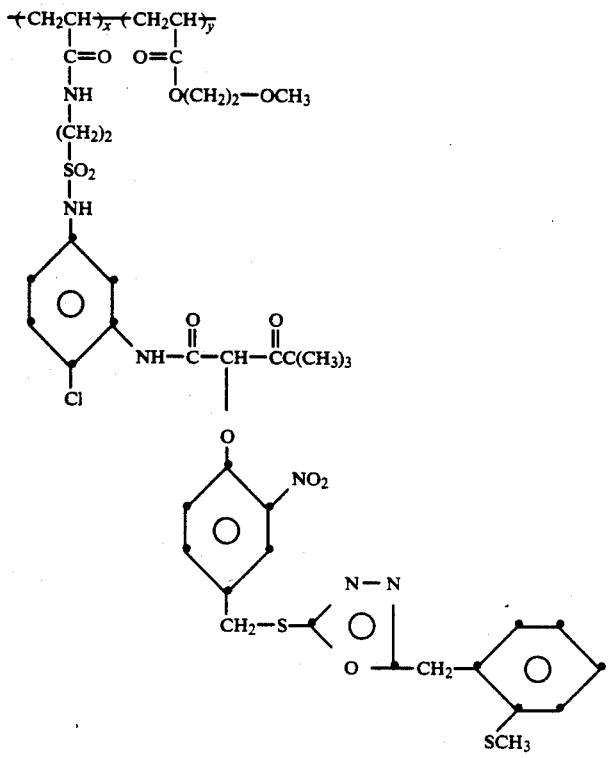
D-83
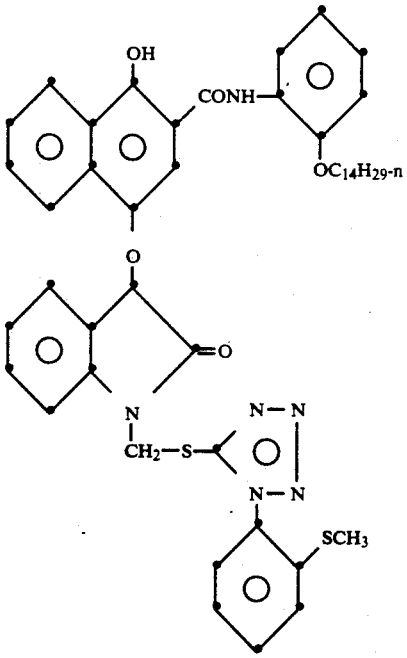
D-84
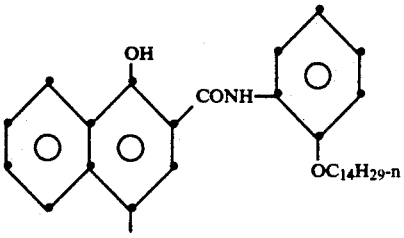

-continued
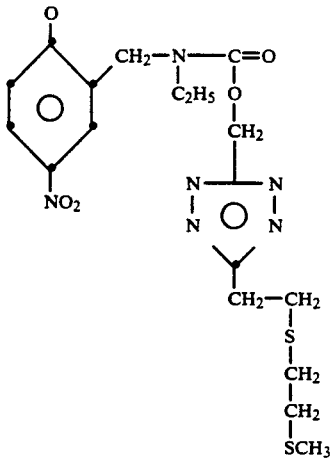
D-85
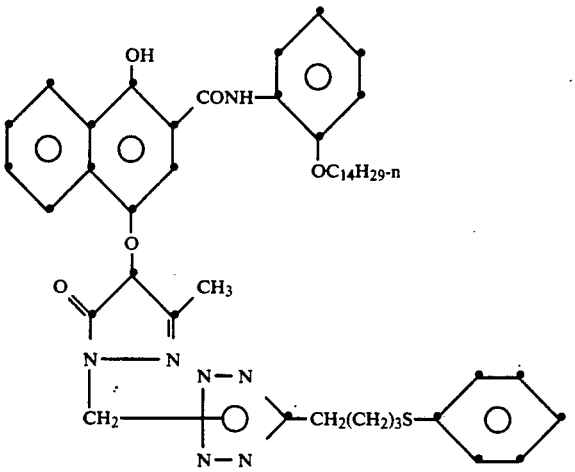
D-86
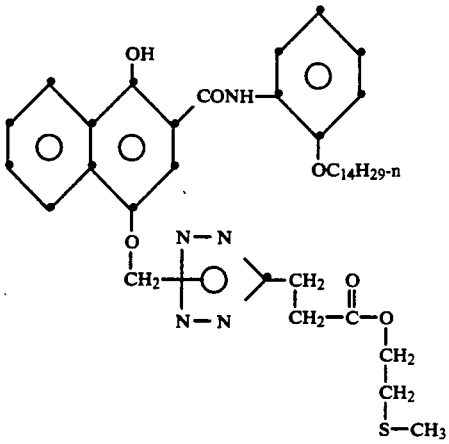
D-87
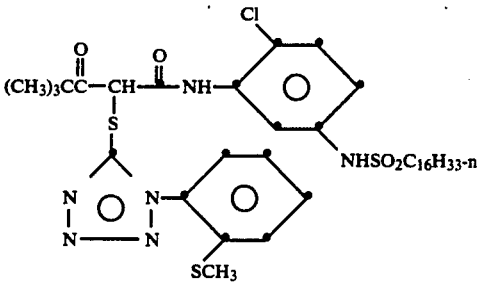

-continued
D-88
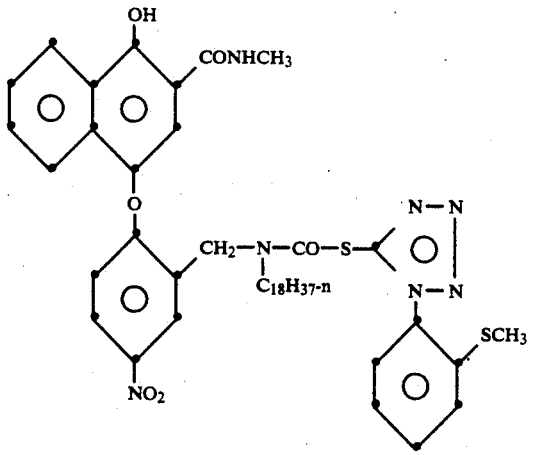
D-89
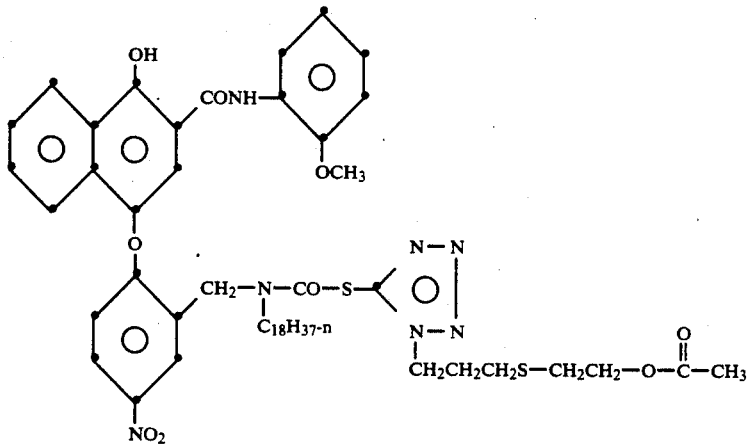
D-90
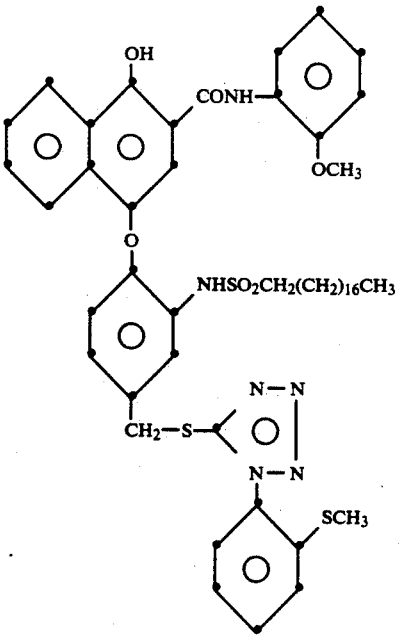

-continued
D-91
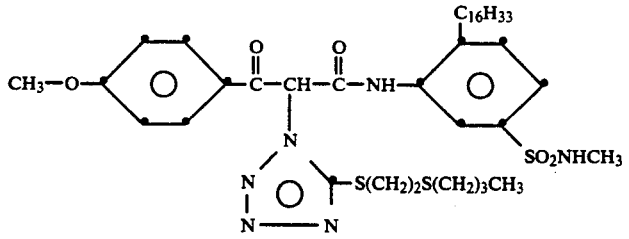
D-92
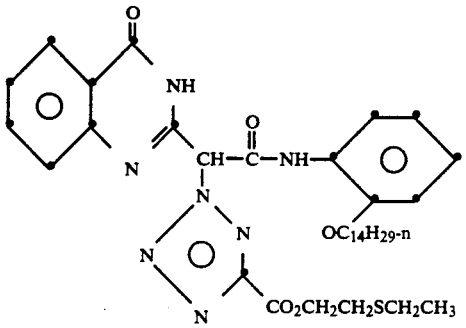
D-93
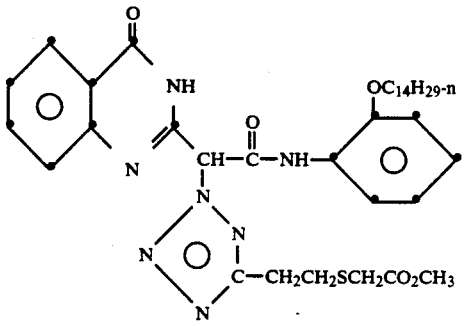
D-94
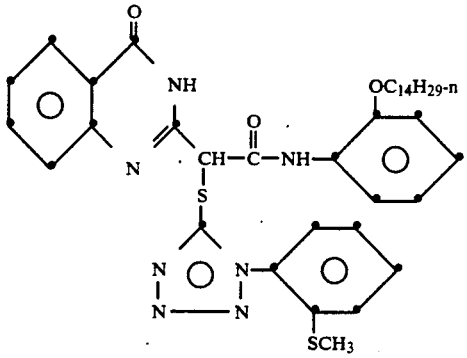
D-95
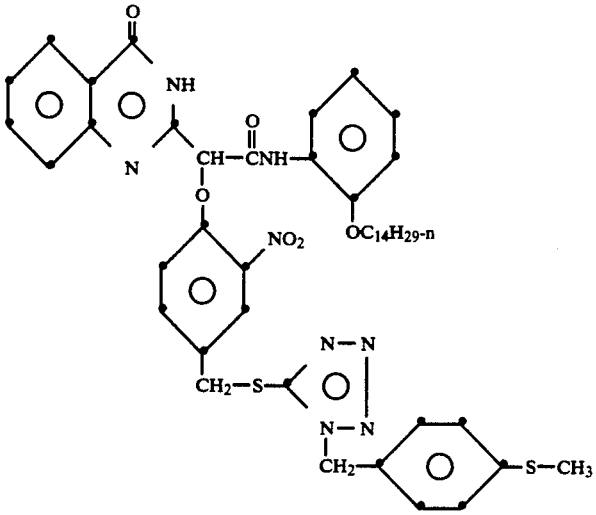

-continued
D-96
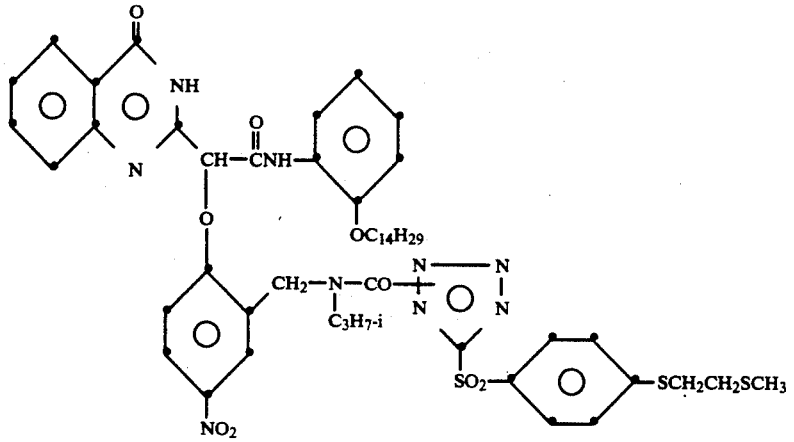
D-97
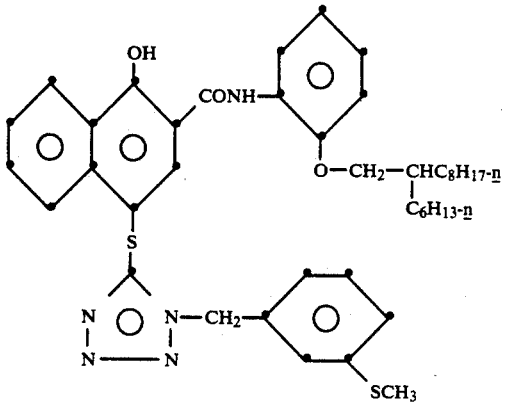
D-98
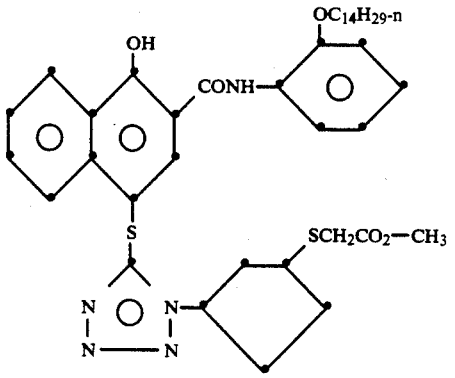
D-99
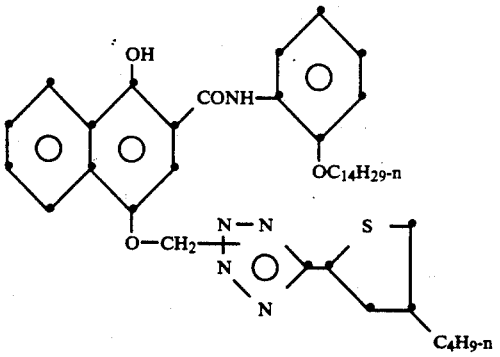
D-100
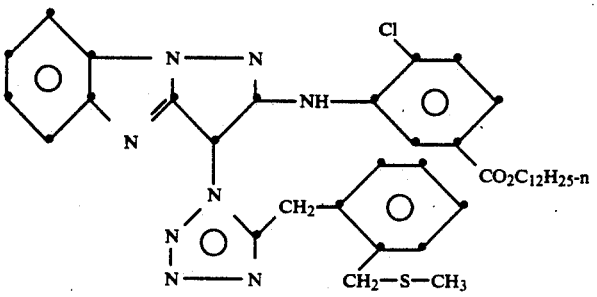

-continued
D-101
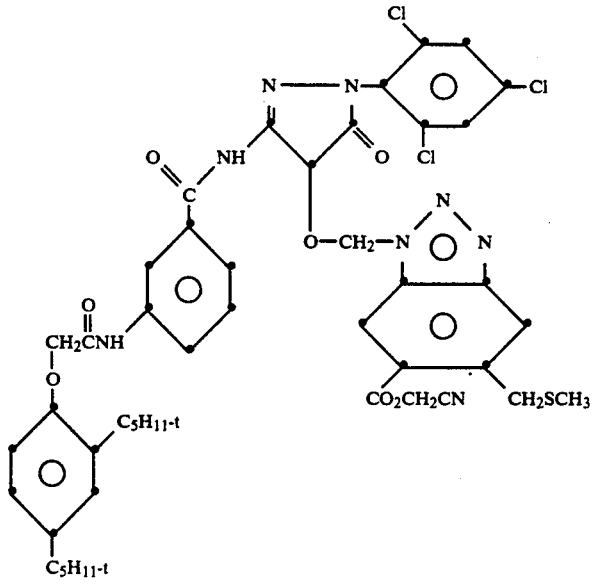
D-102
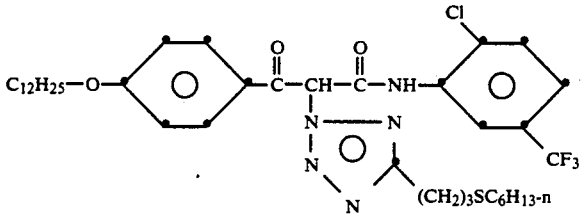
D-103
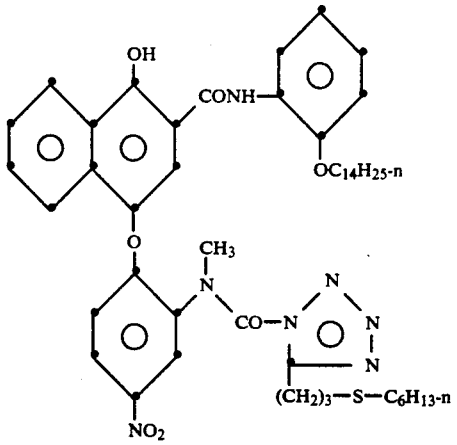
D-104
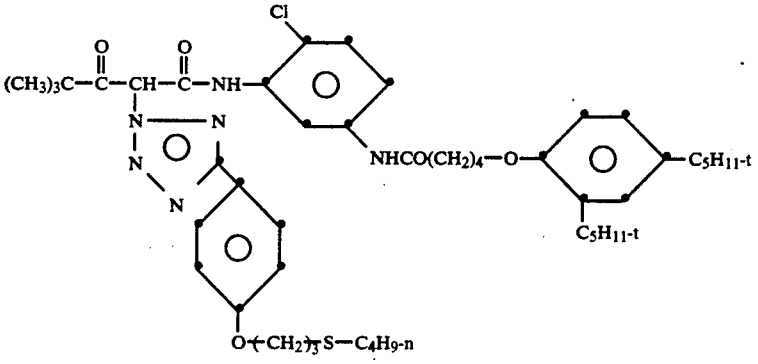

-continued
D-105
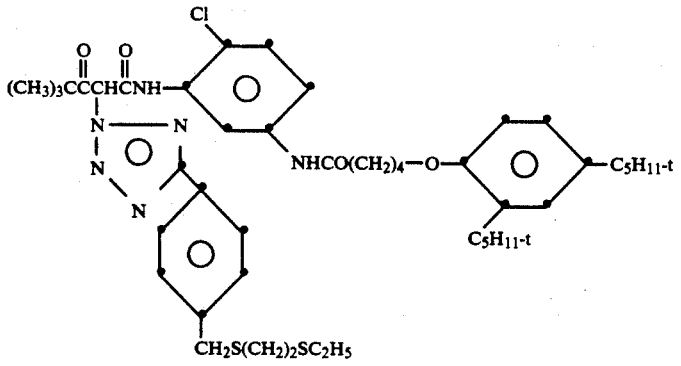
D-106
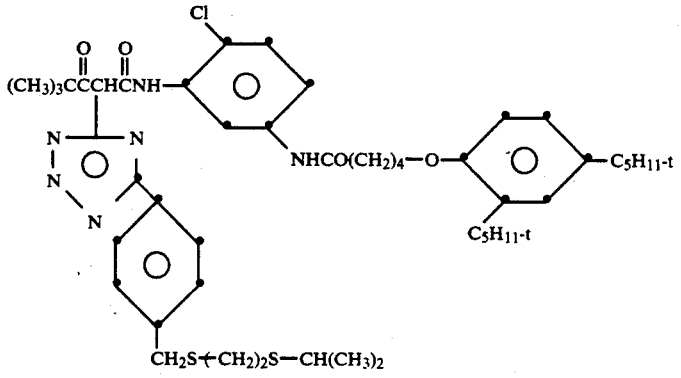
D-107
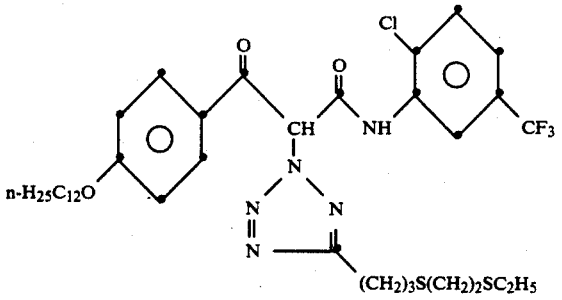
D-108
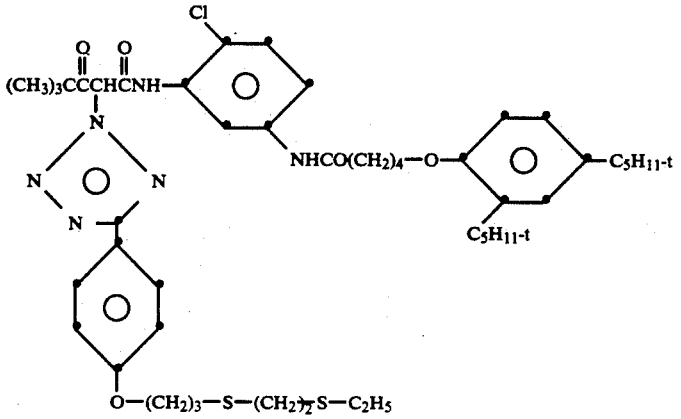

-continued

D-109

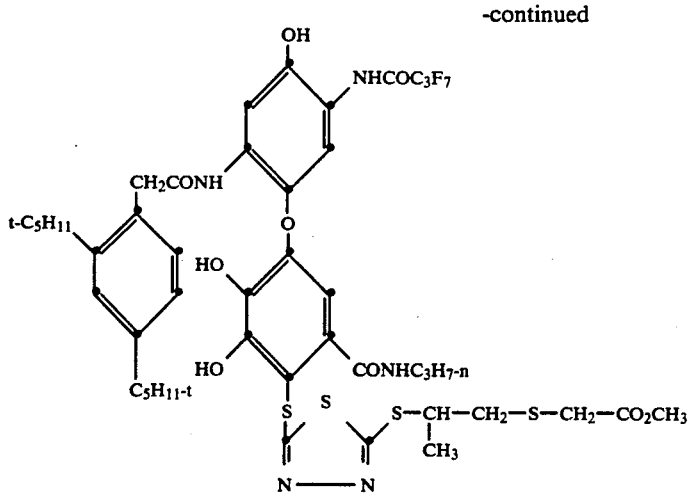

D-110

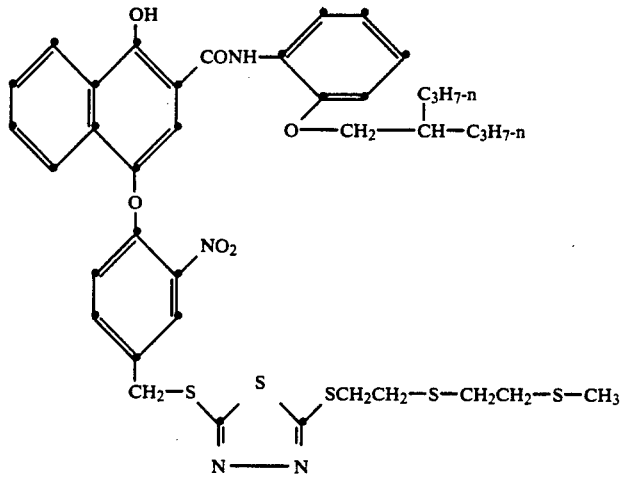

D-111

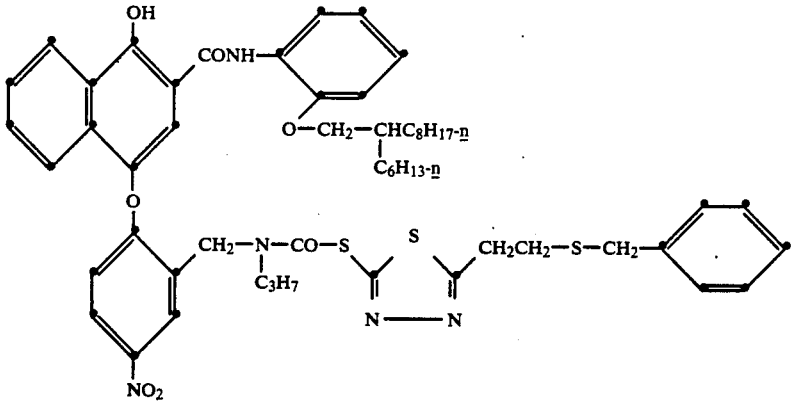

The photographic elements of this invention can be either single or multicolor elements. In a multicolor element, the yellow dye image-forming coupler and a DIR Compound are usually associated with a blue-sensitive emulsion, although they could be associated with an unsensitized emulsion or an emulsion sensitized to a different region of the spectrum. Likewise, the magenta dye image-forming coupler and a DIR compound are associated with a green-sensitive emulsion and the cyan dye image-forming image coupler and a DIR compound are associated with a red-sensitive emulsion. The DIR compounds useful in this invention can be incorporated in the same photosensitive emulsion layer on which they act or in a related layer.

It is understood that DIR compounds need not be associated with all color forming photographic layers. It is also understood that the DIR compounds useful in this invention can be employed along with other DIR compounds in the same photographic material.

In an alternative format, the emulsion sensitive to each of the three primary regions of the spectrum can be disposed as a single segmented layer, e.g. as by the use of microvessels as described in Whitmore U.S. Pat. No. 4,362,806.

Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. The element typically will have a total thickness (excluding the support) of from 5 to 30 microns.

In the following discussion of suitable materials for use in the elements of this invention, reference will be made to *Research Disclosure*, December 1978, Item 17643, published by Kenneth Mason Publications, Ltd., Dudley Annex, 12a North Street, Emsworth, Hampshire PO10 7DQ, ENGLAND, the disclosures of which are incorporated herein by reference. This publication will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,414,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1,027,146; JA 54/48,521; U.S. Pat. Nos. 4,379,837; 4,444,877; 4,665,012; 4,686,178; 4,565,778; 4,728,602; 4,668,614 and 4,636,461; and in EP 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in *Research Disclosure* Item 17643, Section IX and the publications cited therein.

In addition to the couplers described herein the elements of this invention can include additional couplers as described in *Research Disclosure* Section VII, paragraphs D, E, F and G and the publications cited therein. These additional couplers can be incorporated as described in *Research Disclosure* Section VII, paragraph C and the publications cited therein. The coupler combinations of this invention can be used with colored masking couplers as described in U.S. Pat. No. 4,883,746.

The photographic elements of this invention can contain brighteners (*Research Disclosure* Section V), antifoggants and stabilizers (*Research Disclosure* Section VI), antistain agents and image dye stabilizers (*Research Disclosure* Section VII, paragraphs I and J), light absorbing and scattering materials (*Research Disclosure* Section VIII), hardeners (*Research Disclosure* X), coating aids (*Research Disclosure* Section XI), plasticizers and lubricants (*Research Disclosure* Section XII), antistatic agents (*Research Disclosure* Section XIII), matting agents (*Research Disclosure* Sections XII and XVI) and development modifiers (*Research Disclosure* Section XXI).

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluenesulfonic acid.

With negative-working silver halide, the processing step described above provides a negative image. The described elements are preferably processed in the known C-41 color process as described in, for example, the British Journal of Photography Annual of 1988, pages 196–198. To provide a positive (or reversal) image, the color development step can be preceded by development with a non-chromogenic developing agent to develop exposed silver halide, but not form dye, and then uniformly fogging the element to render unexposed silver hlaide developable. Alternatively, a direct positive emulsion can be employed to obtain a positive image.

Development is followed by the conventional steps of bleaching, fixing, or bleach-fixing, to remove silver or silver halide, washing, and drying.

The following examples further illustrate the invention.

EXAMPLES

Photographic Sample 101

A color photographic recording material for color negative development was prepared by applying the following layers in the given sequence to a transparent cellulose acetate support. The quantities of silver halide are given in mg of silver per $m^2$. The quantities of all other materials are given in mg per $m^2$. All silver halide emulsions were stabilized with 3 grams of 4-hydroxy-6-methyl-1,3,3a,7-tetraazaindene per mole of silver.

Layer 1 (Antihalation Layer)

Black colloidal sol containing 236 mg of silver and 2440 mg of gelatin.

Layer 2 (Photographic Layer)

Red sensitized silver iodobromide emulsion (4.0 mol percent iodide, average grain diameter 2.25 microns, average grain thickness 0.09 microns) at 1075 mg; cyan dye-forming image coupler I-1 (dispersed in di-n-butylphthalate) at 430 mg; DIR compound DIR-1 (dispersed in N-n-butylacetanalide) at 32 mg and 1612 mg of gelatin.

Layer 3 (Overcoat)

Gelatin at 1612 mg with 1.8% by weight to total gelatin of hardener H-1.

Photographic Sample 102 was prepared like photographic sample 101 but with the addition of 36 mg of BA-1 to layer 2.

Photographic Sample 103 was prepared like photographic sample 101 but with the addition of 32 mg of B-1 to layer 2. This quantity of B-1 is equimolar to the 36 mg of BA-1 in sample 102.

Photographic Samples 104 through 106 were prepared like photographic samples 101 through 103 respectively but with the replacement of DIR-1 by 32 mg of DIR compound D-2.

Photographic Sample 201 was prepared like photographic sample 101 but layer 2 comprised in this case a red-sensitized silver iodobromide emulsion (3.9 mole percent iodide, average grain diameter 0.60 mirons, average grain thickness 0.09 microns) at 645 mg; cyan dye-forming image coupler I-2 at 570 mg; DIR compound DIR-2 at 24 mg and 1612 mg of gelatin.

Photographic Sample 202 was prepared like photographic sample 201 but with the addition of 32 mg of B-1 to layer 2.

Photographic Samples 203 and 204 were prepared like photographic samples 201 and 202 respectively but with the replacement of DIR-2 by 25 mg of DIR compound D-1.

Photographic Sample 301 was prepared like photographic sample 101 but layer 2 comprised in this case a green-sensitized silver iodobromide emulsion (3.9 mole percent iodide, average grain diameter 0.60 microns, average grain thickness 0.09 microns) at 645 mg; magenta dye-forming image coupler I-3 at 338 mg; DIR compound DIR-3 at 41 mg and 1612 mg of gelatin.

Photographic Sample 302 was prepared like photographic sample 301 but with the addition of 32 mg of B-1 to layer 2.

Photographic Sample 303 was prepared like photographic sample 301 but with the replacement of DIR-3 by DIR compound D-103 at 32 mg.

Photographic Sample 304 was prepared like photographic sample 303 but with the addition of 36 mg of BA-1 to layer 2.

Photographic Sample 305 was prepared like photographic sample 303 but with the addition of 32 mg of B-1 to layer 2.

Photographic Sample 401 was prepared like photographic sample 101 but layer 2 comprised in this case a green-sensitized silver iodobromide emulsion (4.0 mole percent iodide, 2.0 microns average grain diameter, and 0.08 microns average grain thickness) at 1075 mg; a mixture of magenta dye-forming image coupler I-3 at 169 mg and I-4 at 215 mg; DIR compound DIR-4 at 26 mg and 1612 mg of gelatin.

Photographic Sample 402 was prepared like photographic sample 401 but with the addition of 35 mg of B-32 to layer 2.

Photographic Samples 403 and 404 were prepared like photographic samples 401 and 402 respectively but with the replacement of DIR-4 by an equimolar quantity, 32 mg, D-2.

Photographic Sample 501 was prepared like photographic sample 101 but layer 2 comprised in this case a blue-sensitized silver iodobromide emulsion (3.0 mole percent iodide, 2.6 microns average grain diameter, and 0.12 microns average grain thickness) at 645 mg; yellow dye-forming image coupler I-5 at 446 mg; DIR compound DIR-3 at 41 mg and 1612 mg of gelatin.

Photographic Sample 502 was prepared like photographic sample 501 but with the addition of 32 mg of B-1 to layer 2.

Photographic Samples 503 and 504 were prepared like photographic samples 501 and 502 respectively but with the replacement of DIR-3 by 27 mg of D-102.

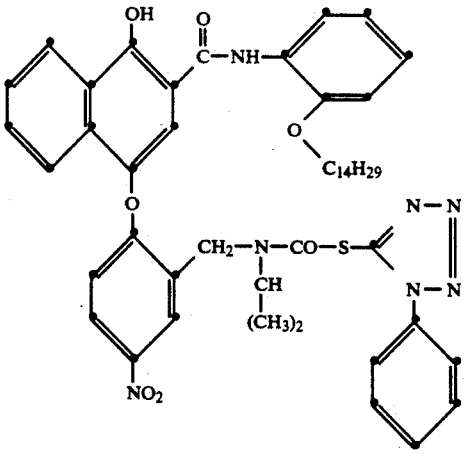
DIR-1
(Disclosed in U.S. Pat. No. 4,248,962 as Compound 4)
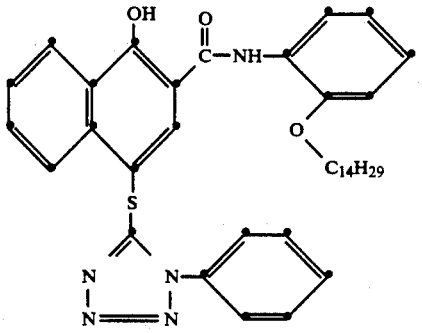
DIR-2
(Disclosed in U.S. Pat. No. 3,227,554 as Compound 16)
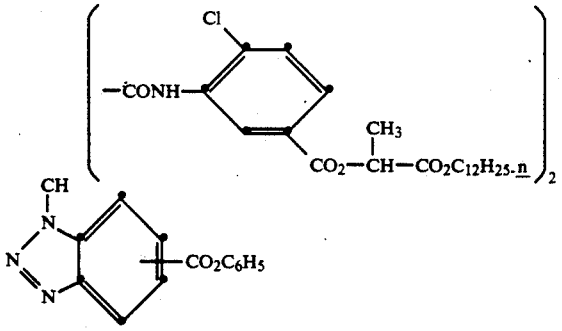
DIR-3
(Disclosed in U.K. Patent 2,099,167)
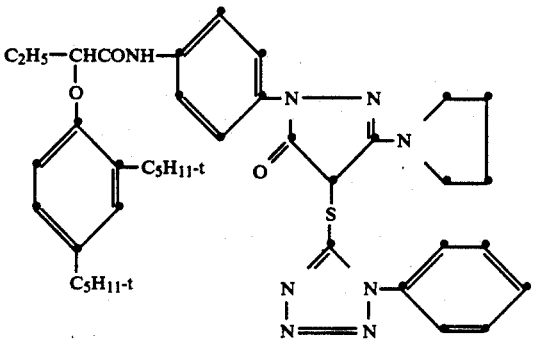
DIR-4

-continued
(Disclosed in EP 193,389A) BA-1
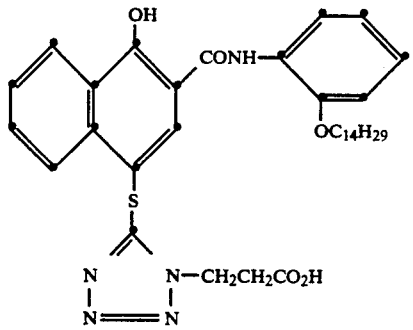
I-1
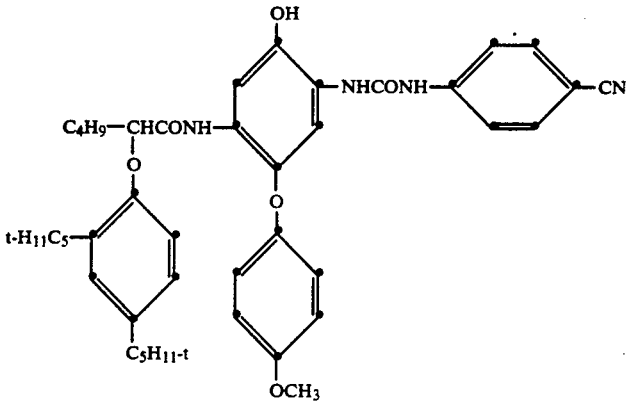
I-2
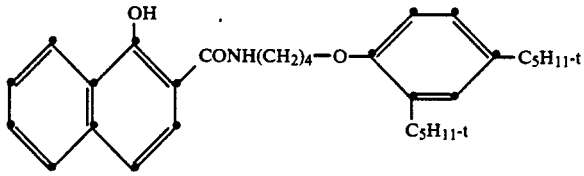
I-3
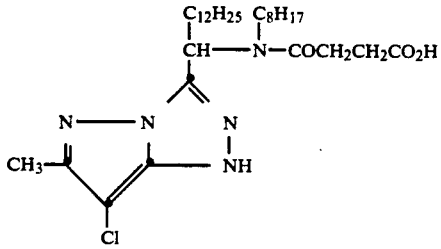
I-4
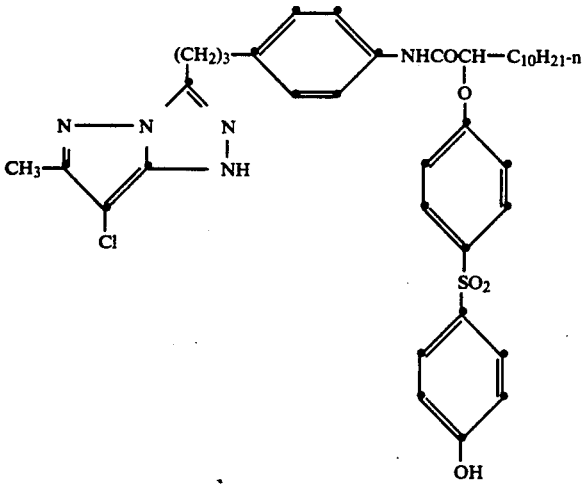

-continued

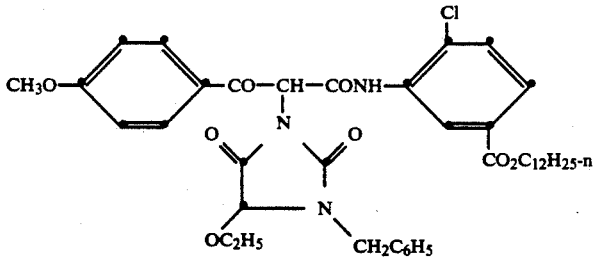

I-5

$CH_2{=}CH{-}SO_2{-}CH_2{-}SO_2{-}CH{=}CH_2$

H-1

The photographic samples were exposed to white light through a graduated density test object. These samples were then developed using a color negative process, the KODAK C-41 process, as described in *The British Journal of Photography Annual of* 1988, pages 196–198. (KODAK is a trademark of the Eastman Kodak Company, U.S.A.).

The image densities produced at the various exposure levels were measured and the gamma ($\gamma$) calculated for each sample. The exposure required to produce a density of 0.20 above Dmin was determined for each sample. This exposure level is the experimental speed-point for each sample. The inverse of this exposure level is directly related to the photographic sensitivity, i.e., speed of each sample (S). Granularity ($\sigma$) measurements were made for each sample according to the procedures described in the SPSE *Handbook of Photographic Science and Engineering*, edited by W. Thomas, Jr., 1973, pages 934–939. For each Sample, the granularity ($\sigma$) at the speed-point (S) was determined and normalized by the gamma ($\gamma$) at the speed-point to calculate the gamma-normalized granularity ($\sigma/\gamma$) at the speed-point (S). The gamma-normalized granularity ($\sigma/\gamma$) is generally taken as a measure of the "noise-to-signal" ratio of an image-forming process. This concept is described in some detail by A. Shepp and W. Kammerer in *Photographic Science and Engineering*, Vol. 14, pages 363–368 (1970). The smaller the gamma-normalized granularity ($\sigma/\gamma$) the less "noisy" is the image produced in a photographic process.

In Table I are listed the chemical components of each photographic sample; the relative sensitivity of each sample using a common emulsion expressed as a percent of the sensitivity of the control sample in each sample set; the gamma-normalized granularity ($\sigma/\gamma$) determined at this speed-point; the relative gamma-normalized granularity for each sample using a common emulsion expressed as a percent of the gamma-normalized granularity of the control sample in each sample set. The net increase or decrease in the photographic performance (P)- of each sample relative to its control sample was calculated by determining the difference between the relative sensitivity of each sample and the relative gamma-normalized granularity of the sample. Positive values of P indicate a net improvement in photographic performance while negative values of P indicate a net decrease in photographic performance. It is most desireable to identify compositions which enable an improvement in photographic performance. This improvement in photographic performance may be manifest when sensitivity (S) increases faster than does gamma-normalized granularity ($\sigma/\gamma$), or when gamma-normalized granularity ($\sigma/\gamma$) decreases faster than does sensitivity. The increase or decrease in photographic performance of each sample (P) is also listed in Table I.

TABLE I

| Coating | DIR Coupler | BARC Coupler | $\sigma/\gamma$ at Speedpoint × 1000 | Relative Sensitivity (S) | Relative $\sigma/\gamma$ | Relative Photographic Performance (P) |
|---|---|---|---|---|---|---|
| 101 Control | DIR-1 | None | 25.9 | 100.0 | 100.0 | 0 |
| 102 Prior Art | DIR-1 | BA-1 | 22.3 | 64.6 | 86.1 | −21.5 |
| 103 Prior Art | DIR-1 | B-1 | 22.1 | 81.3 | 85.3 | −4.0 |
| 104 Prior Art | D-2 | None | 22.1 | 83.2 | 85.3 | −2.1 |
| 105 | D-2 | BA-1 | 21.5 | 70.8 | 83.0 | −12.2 |
| 106 Inventive | D-2 | B-1 | 20.5 | 85.1 | 79.2 | +5.9 |
| 201 Control | DIR-2 | None | 9.6 | 100.0 | 100.0 | 0 |
| 202 Prior Art | DIR-2 | B-1 | 9.1 | 114.8 | 94.8 | +20.0 |
| 203 Prior Art | D-1 | None | 10.4 | 72.4 | 108.3 | −35.9 |
| 204 Inventive | D-1 | B-1 | 8.4 | 114.8 | 87.5 | +27.3 |
| 301 Control | DIR-3 | None | 15.6 | 100.0 | 100.0 | 0 |
| 302 Prior Art | DIR-3 | B-1 | 13.2 | 83.2 | 84.6 | −1.4 |
| 303 Prior Art | D-103 | None | 13.0 | 63.1 | 83.3 | −20.2 |
| 304 | D-103 | BA-1 | 12.3 | 70.8 | 78.9 | −8.1 |
| 305 Inventive | D-103 | B-1 | 11.8 | 79.4 | 75.6 | +3.8 |
| 401 Control | DIR-4 | None | 38.5 | 100.0 | 100.0 | 0 |
| 402 Prior Art | DIR-4 | B-32 | 39.9 | 112.2 | 103.6 | +8.6 |
| 403 Prior Art | D-2 | None | 30.5 | 87.1 | 79.2 | +7.9 |
| 404 Inventive | D-2 | B-32 | 30.6 | 89.1 | 79.5 | +9.6 |
| 501 Control | DIR-3 | None | 34.0 | 100.0 | 100.0 | 0 |
| 502 Prior Art | DIR-3 | B-32 | 36.2 | 100.0 | 106.5 | −6.5 |
| 503 Prior Art | D-102 | None | 34.6 | 107.2 | 101.8 | +5.4 |
| 505 Inventive | D-102 | B-32 | 36.8 | 120.2 | 108.2 | +12.0 |

As can be readily appreciated, within each sample set, i.e. each series of photographic examples comprising a common emulsion, the inventive combination, comprising a DIR coupler (A) and a BARC coupler (B) as previously defined, show the largest improvement in photographic performance relative to the control sample. Sample 101 is a control sample. Sample 103 is a prior art comparison which includes DIR compound DIR-1 and BARC compound B-1. It shows a modest decrease in photographic performance. Sample 104 incorporating DIR compound D-2 also shows a modest decrease in photographic performance. Surprisingly, sample 106, which incorporates both a first coupler (A) and a second coupler (B) shows an improvement in photographic performance. Samples 102 and 105 which include the non-preferred BARC coupler BA-1 both show large losses in photographic performance.

Sample 201 is a control sample. Sample 203, which differs from sample 201 in that it incorporates a DIR coupler (A) shows a large decrease in photographic performance. Sample 204, which differs from sample 203 in that it incorporates both a DIR coupler (A) and a BARC coupler (B) shows a large improvement in photographic performance. The net improvement in going from sample 203 to sample 204 is +63.2%. This is substantially larger than the 20% improvement which might be anticipated considering the performance of samples 201 and 202.

Within sample sets 301 to 305, 401 to 404 and 501 to 504, the combination including both the DIR coupler (A) and the BARC coupler (B) enables the largest improvement in photographic performance over the control position.

These photographic samples were additionally exposed as before and processed in another color developer as described below:

| | |
|---|---|
| Pre-Bath (pH 9.26 buffer) | 10 s |
| Wash | 5 s |
| Color Developer (pH 10.2 at 106 F) | 180 s |
| Stop bath (pH <1.0) | 30 s |
| Wash | 30 s |
| Bleach (pH 6.5) | 180 s |

-continued

| | |
|---|---|
| Wash | 60 s |
| Fix (pH 6.5) | 120 s |
| Wash | 120 s |
| Stabilizer Bath (photoflo) | 10 s |

The color developer and bleach solutions employed in this experiment had the following compositions:

| | |
|---|---|
| **Color Developer:** | |
| Water | 850 ml |
| Anti-calcium agent | 2 ml |
| Sodium Sulfate (desicated) | 2 ml |
| Anti-foggant | 0.22 g |
| Sodium Bromide (anhydrous) | 1.20 g |
| Sodium Carbonate (anhydrous) | 25.6 g |
| Sodium Bicarbonate | 2.7 g |
| developing agent, 4-amino-3-methyl N-ethyl-N-β-(methane sulfonamido)-ethylaniline sulfate | 4.0 g |
| diluted to 1.0 l with water; showing a pH of 10.2 +/− 0.02 at 27° C. | |
| **Bleach:** | |
| Water | 900 ml |
| Potassium Ferricyanide | 40 g |
| Sodium Bromide | 25 g |
| diluted to 1.0 l with water; showing a pH of 6.5 +/− 0.5 at 27° C. | |

The processed samples were analyzed in the same manner and the results are listed in Table II.

TABLE II

| Coating | DIR Coupler | BARC Coupler | σ/γ at Speedpoint × 1000 | Relative Sensitivity (S) | Relative σ/γ | Relative Photographic Performance (P) |
|---|---|---|---|---|---|---|
| 101 Control | DIR-1 | None | 23.3 | 100.0 | 100.0 | 0 |
| 102 Prior Art | DIR-1 | BA-1 | 22.2 | 77.6 | 95.3 | −17.7 |
| 103 Prior Art | DIR-1 | B-1 | 20.1 | 79.4 | 86.3 | −6.9 |
| 104 Prior Art | D-2 | None | 19.8 | 83.2 | 85.0 | −1.8 |
| 105 | D-2 | BA-1 | 19.0 | 70.8 | 81.6 | −11.5 |
| 106 Inventive | D-2 | B-1 | 17.2 | 75.9 | 73.8 | +2.1 |
| 201 Control | DIR-2 | None | 9.6 | 100.0 | 100.0 | 0 |
| 202 Prior Art | DIR-2 | B-1 | 9.0 | 83.2 | 93.8 | −10.6 |
| 203 Prior Art | D-1 | None | 9.1 | 79.4 | 94.8 | −15.4 |
| 204 Inventive | D-1 | B-1 | 8.7 | 91.4 | 90.6 | +0.6 |
| 301 Control | DIR-3 | None | 14.8 | 100.0 | 100.0 | 0 |
| 302 Prior Art | DIR-3 | B-1 | 14.2 | 93.3 | 86.0 | −2.7 |
| 303 Prior Art | D-103 | None | 13.6 | 79.4 | 91.9 | −12.5 |
| 304 | D-103 | BA-1 | 12.7 | 70.8 | 85.8 | −15.0 |
| 305 Inventive | D-103 | B-1 | 11.3 | 89.1 | 76.4 | +12.7 |
| 401 Control | DIR-4 | None | 30.5 | 100.0 | 100.0 | 0 |
| 402 Prior Art | DIR-4 | B-32 | 32.9 | 125.9 | 107.9 | +18.0 |
| 403 Prior Art | D-2 | None | 30.3 | 97.7 | 99.3 | −2.2 |
| 404 Inventive | D-2 | B-32 | 31.9 | 123.0 | 104.6 | +18.4 |
| 501 Control | DIR-3 | None | 31.8 | 100.0 | 100.0 | 0 |
| 502 Prior Art | DIR-3 | B-32 | 33.8 | 102.3 | 106.3 | −4.0 |
| 503 Prior Art | D-102 | None | 31.0 | 162.2 | 97.5 | +64.7 |
| 505 Inventive | D-102 | B-32 | 30.2 | 162.2 | 95.0 | +67.2 |

As can be readily appreciated, within each sample set, i.e. each series of photographic samples comprising a common emulsion, the inventive combinations comprising a DIR coupler (A) and a BARC coupler (B) as previously defined, show the largest improvement in photographic performance relative to the control sample.

As can be further appreciated after examination of the performance (P) listed in Tables I and II, the addition of a BARC coupler (B) to a photographic element comprising a DIR coupler (A) enables a surprisingly larger improvement in performance than is observed on addition of a BARC coupler (B) to a photographic element comprising a prior art DIR coupler. It can be further appreciated that the related BARC couplers, typified by BARC coupler BA-1, do not show this effect.

Photographic Sample 601 was prepared like photographic sample 101 but layer 2 comprised in this case a red-sensitized silver iodobromide emulsion (3.9 mole percent iodide, average grain diameter 0.60 microns, average grain thickness 0.09 microns) at 645 mg; cyan dye-forming image coupler I-2 at 285 mg; DIR compound DIR-5 at 34 mg and gelatin 1720 mg.

Photographic Sample 602 was prepared like photographic sample 601 but with the addition of 36 mg of compound BA-1 to layer 2.

Photographic Sample 603 was prepared like photographic sample 601 but with the addition of 33 mg of compound B-1 to layer 2.

Photographic Samples 604, 605 and 606 were prepared like photographic samples 601, 602 and 603 respectively but with the replacement of DIR compound DIR-5 by 25 mg of DIR compound D-2.

Photographic Samples 701 through 706 were prepared like photographic samples 601 through 606 respectively but with the replacement of image coupler I-2 by 384 mg of image coupler I-6.

These samples were exposed, processed and analyzed in the same manner as the samples shown earlier in Table I. The results of this comparison are reported in Table III. As can be readily appreciated, within each sample set, the inventive combinations enabled the largest improvements in photographic performance.

DIR-5

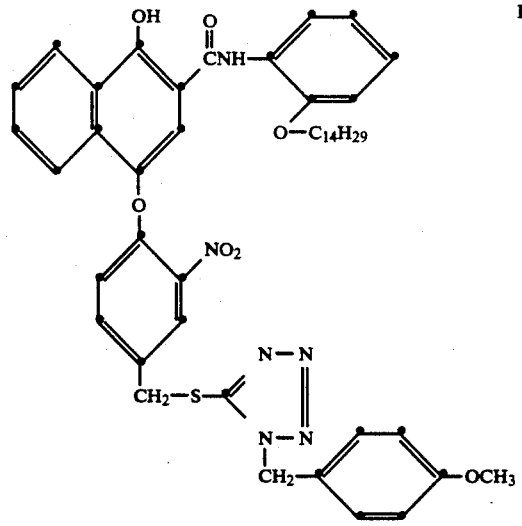

I-6

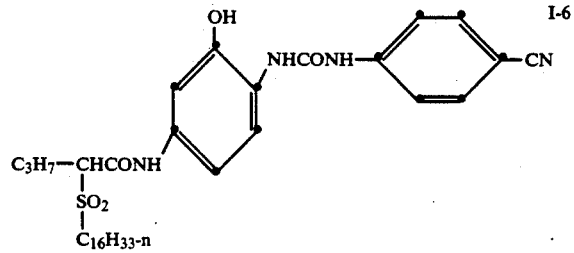

TABLE III

| Coating | DIR Coupler | BARC Coupler | σ/γ at Speedpoint × 1000 | Relative Sensitivity (S) | Relative σ/γ | Relative Photographic Performance (P) |
|---|---|---|---|---|---|---|
| 601 Control | DIR-5 | None | 14.1 | 100.0 | 100.8 | 0 |
| 602 Prior Art | DIR-5 | BA-1 | 12.2 | 138.0 | 86.5 | +41.5 |
| 603 Prior Art | DIR-5 | B-1 | 10.9 | 144.5 | 77.3 | +67.2 |
| 604 Inventive | D-2 | None | 9.8 | 89.1 | 69.5 | +19.6 |
| 605 | D-2 | BA-1 | 10.6 | 114.8 | 75.2 | +39.6 |
| 606 Inventive | D-2 | B-1 | 10.9 | 158.5 | 77.3 | +81.2 |
| 701 Control | DIR-5 | None | 13.8 | 100.0 | 100.0 | 0 |
| 702 Prior Art | DIR-5 | BA-1 | 12.3 | 85.1 | 89.1 | −4.0 |
| 703 Prior Art | DIR-5 | B-1 | 12.0 | 104.7 | 87.0 | +17.7 |
| 704 Inventive | D-1 | None | 11.0 | 83.2 | 79.7 | +3.5 |
| 705 | D-1 | BA-1 | 10.4 | 74.1 | 75.4 | −1.3 |
| 706 Inventive | D-1 | B-1 | 10.7 | 104.7 | 77.5 | +27.2 |

The invention has been described in detail with particular reference to preferred embodiments thereof, but it will be understood that variations and modifications can be effected within the spirit and scope of the invention.

What is claimed is:

1. A photographic element comprising a aupport bearing at least one photographic silver halide emulsion layer, and, in reactive association:

(a) a first coupler represented by the formula:

$$COUP_1—(TIME)n—INH—(Q)m$$

wherein:

$COUP_1$ is a coupler moiety from which (TIME)-n—INH—(Q)m is released during development;

TIME is a timing group;

INH—(Q)m together constitute a development inhibitor moiety;

Q comprises from 1 to 4 thioether moieties, in each of which the sulfur atom is directly bonded to a saturated carbon atom but is not directly bonded to an INH heterocyclic ring;

n is 0, 1, or 2; and m is 1, 2 or 3; and (b) a second coupler represented by the formula:

$$COUP_2—(TIME)_n—S—R_1—R_2$$

wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

2. A photographic element as in claim 1 comprising an image-dye forming coupler.

3. A photographic element as in claim 1 wherein the INH part of INH—Q comprises a heterocyclic ring having from 5 to 6 atoms in a monocyclic ring or from 5 to 10 atoms in a bicyclic ring system.

4. A photographic element as in claim 1 wherein the INH part of the INH—Q is an oxazole, thiazole, diazole, triazole, oxadiazole, thiadiazole, oxathiazole, thiatriazole, benzotriazole, tetrazole, benzimidazole, indazole, isoindazole, mercaptotetrazole, selenotetrazole, mercaptobenzothiazole, selenobenzothiazole, mercaptobenzoxazole, selenobenzoxazole, mercaptobenzimidazole, selenobenzimidazole, benzodiazole, mercaptooxazole, mercaptothiadiazole or benzisodiazole.

5. A photographic element as in claim 1 wherein the INH—Q comprises a 1,2,3,4-tetrazole moiety having the structure:

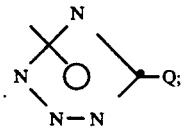

a 5-mercapto-1,2,3,4-tetrazole moiety having the structure:

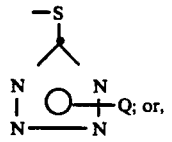

a benzotriazole moiety having the structure:

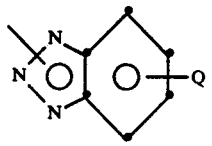

6. A photographic element as in claim 1 wherein the first coupler is

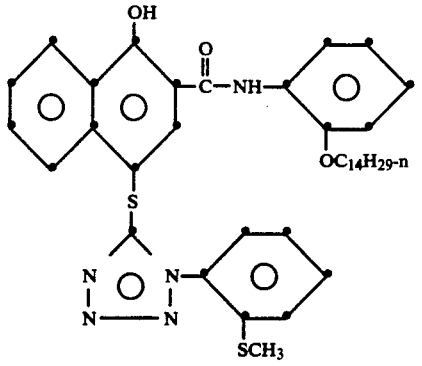

or

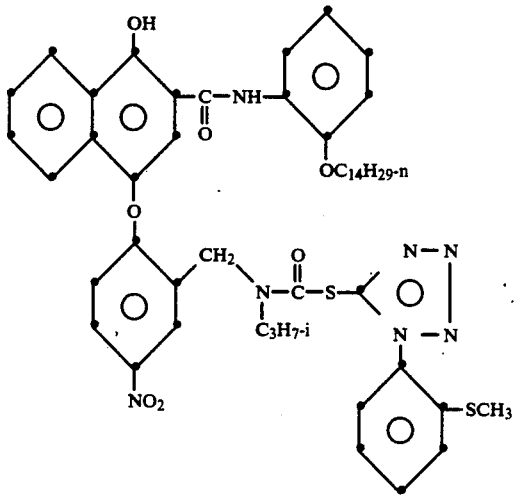

7. A photographic element as in claim 1 wherein the second coupler is represented by the formula:

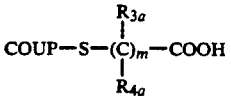

wherein

COUP is a coupler moiety;

m is 1 to 8;

$R_{3a}$ and $R_{4a}$ individually are hydrogen or alkyl containing 1 to 4 carbon atoms; and wherein the total number of carbon atoms in

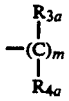

is 1 to 8.

8. A photographic element as in claim 1 wherein the second coupler is

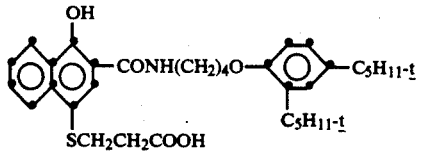

9. A photographic element as in claim 1 comprising at least one red-sensitive silver halide emulsion layer comprising at least one cyan image-dye forming coupler; at least one green-sensitive silver halide emulsion layer comprising at least one magenta image-dye forming coupler; and at least one blue-sensitive silver halide emulsion layer comprising at least one yellow image-dye forming coupler.

10. A process of developing an exposed photographic element as defined in claim 9 comprising developing a dye image in the photographic element in a color developer.

* * * * *